US011425938B2

(12) United States Patent
Weiland et al.

(10) Patent No.: US 11,425,938 B2
(45) Date of Patent: Aug. 30, 2022

(54) SOCK

(71) Applicant: PEDILAY CARE GMBH, Grebenhain (DE)

(72) Inventors: Hannes Weiland, Starnberg (DE); Heinz Weiland, Munich (DE); Gabriele Brandt, Sauerlach (DE); Elisabetta Birmelin, Oberschleissheim (DE); Sebastian Camerer, Berlin (DE)

(73) Assignee: PEDILAY CARE GMBH, Grebenhain (DE)

( * ) Notice: Subject to any disclaimer, the term of this patent is extended or adjusted under 35 U.S.C. 154(b) by 23 days.

(21) Appl. No.: 16/915,646

(22) Filed: Jun. 29, 2020

(65) Prior Publication Data

US 2020/0323276 A1 Oct. 15, 2020

Related U.S. Application Data

(63) Continuation of application No. 16/083,724, filed as application No. PCT/EP2017/055466 on Mar. 8, 2017, now abandoned.

(30) Foreign Application Priority Data

Mar. 8, 2016 (DE) ..... 10 2016 104 206.4
Jul. 1, 2016 (DE) ..... 10 2016 112 126.6

(51) Int. Cl.
*A41B 11/00* (2006.01)
*A41B 11/12* (2006.01)
*A41B 11/01* (2006.01)

(52) U.S. Cl.
CPC ..... *A41B 11/00* (2013.01); *A41B 11/01* (2013.01); *A41B 11/125* (2013.01);
(Continued)

(58) Field of Classification Search
CPC ..... A41B 11/00; A41B 11/01; A41B 11/003; A41B 11/005; A41B 11/125;
(Continued)

(56) References Cited

U.S. PATENT DOCUMENTS 1,359,377 A * 11/1920 Hollenbeck ..... A43B 3/106 36/11
1,802,634 A * 4/1931 Dreyfus ..... A41B 11/00 2/239

(Continued)

FOREIGN PATENT DOCUMENTS

AT 194803 B 1/1958
CN 2472519 Y 1/2002

(Continued)

OTHER PUBLICATIONS

Extended European Search Report dated Apr. 16, 2021 of the corresponding EP patent application No. 20 207 407.6.

(Continued)

*Primary Examiner* — Heather Mangine
(74) *Attorney, Agent, or Firm* — Muncy, Geissler, Olds & Lowe, P.C.

(57) ABSTRACT

The invention relates to a sock (10). The sock (10) has a sole part (100) which is suitable for covering the sole of a foot (1) when the sock (10) is being worn. Furthermore, a toe region (200) of the sock (10) is suitable, together with the sole part (100), for receiving the entire toe region of the foot (1) when the sock (10) is being worn. The sock (10) furthermore comprises an instep part (300) which is suitable for at least partially covering the arch of the foot (1) when the sock (10) is being worn. A heel part (400) of the sock (10) is suitable for covering the heel of the foot (1) when the sock (10) is being worn. The sock (10) comprises an ankle closure part (600) which is suitable for closing the sock (10) in a releasable manner at the ankle of the foot (1) when the sock (10) is being worn.

13 Claims, 44 Drawing Sheets

(52) U.S. Cl.
CPC ..... *A41B 2300/32* (2013.01); *A41B 2400/44* (2013.01); *A41B 2400/52* (2013.01); *A41B 2500/30* (2013.01)

(58) Field of Classification Search
CPC ..... A41B 2400/44; A41B 2400/52; A41B 2500/30; A61F 13/00038; A61F 13/08; A61F 13/085; A43B 3/106; A43B 23/042
USPC ..... 2/239, 240; 602/28, 65; 28/882
See application file for complete search history.

(56) References Cited

U.S. PATENT DOCUMENTS 1,912,539 A * 6/1933 Paul ..... A41B 11/00 36/10
1,968,967 A * 8/1934 Snader ..... A41B 11/01 2/239
1,984,970 A * 12/1934 Goodman ..... A41B 11/01 2/239
2,157,399 A 5/1939 Cohn
2,526,663 A * 10/1950 Sonjas ..... A41B 11/00 2/239
2,642,678 A 6/1953 Fula
2,714,771 A 8/1955 Olfene
3,106,790 A 10/1963 Zimmon
3,492,674 A 2/1970 Poole
3,605,122 A 9/1971 Myers
3,634,954 A * 1/1972 Larsen ..... A43B 5/18 36/7.3
3,654,629 A * 4/1972 Crisman ..... A41B 13/10 2/49.1
3,856,008 A 12/1974 Fowler et al.
4,176,475 A * 12/1979 Arcamonte ..... A43B 23/042 36/9 R
4,197,845 A 4/1980 Browning
4,313,433 A 2/1982 Cramer
4,476,858 A 10/1984 Curtis
4,514,863 A 5/1985 Tuyet-Van
4,599,812 A 7/1986 Harmsen
4,615,188 A 10/1986 Hursh et al.
4,649,656 A 3/1987 Cox et al.
4,722,143 A 2/1988 Everett
5,007,111 A 4/1991 Adams
5,020,164 A * 6/1991 Edwards ..... A41B 11/00 2/239
5,050,620 A 9/1991 Cooper
5,133,088 A 7/1992 Dunlap
5,185,000 A 2/1993 Brandt et al.
5,209,801 A 5/1993 Smith
5,244,716 A 9/1993 Thornton et al.
5,269,748 A 12/1993 Lonardo
5,367,789 A 11/1994 Lamont
5,412,957 A 5/1995 Bradberry et al.
5,553,399 A * 9/1996 Strong ..... A43B 3/16 36/44
5,575,013 A 11/1996 Kraeck
5,592,690 A * 1/1997 Wu ..... B32B 7/12 2/67
5,609,570 A * 3/1997 Lamont ..... A43B 5/0415 602/27
5,673,448 A 10/1997 Lang et al.
5,683,335 A 11/1997 Groves et al.
5,762,622 A * 6/1998 Lamont ..... A43B 5/0415 602/27
5,774,898 A 7/1998 Malpee
5,802,742 A * 9/1998 Baude ..... A43B 19/00 36/10
5,832,539 A 11/1998 Williams
5,893,222 A 4/1999 Donnelly
5,897,518 A 4/1999 Shaw
5,898,948 A 5/1999 Kelly et al.
6,012,177 A 1/2000 Cortinovis
6,083,185 A 7/2000 Lamont
6,139,929 A 10/2000 Hayton et al.
6,266,820 B1 * 7/2001 Gupta ..... A41B 13/10 2/49.1
6,393,734 B1 5/2002 Ou
6,641,550 B1 11/2003 Johnson
6,684,411 B1 2/2004 Bachert et al.
6,931,762 B1 8/2005 Dua
7,475,501 B1 * 1/2009 DeToro ..... A43B 1/0081 36/110
7,753,865 B1 7/2010 Hely
7,988,654 B2 8/2011 Leatherwood-Maxwell
8,425,442 B2 4/2013 Lundberg
8,603,019 B1 12/2013 Hermanson et al.
8,734,371 B2 5/2014 Robertson
9,044,063 B2 6/2015 Loverin et al.
2002/0023288 A1 2/2002 Garneau
2003/0135146 A1 7/2003 Daneshvar
2003/0157288 A1 * 8/2003 Bouchette ..... B32B 5/26 428/40.2
2005/0124924 A1 6/2005 Slautterback et al.
2005/0166427 A1 8/2005 Greene et al.
2006/0156456 A1 7/2006 Teixeira
2006/0206987 A1 9/2006 Turner
2006/0211968 A1 9/2006 Gordon, Jr. et al.
2007/0032771 A1 2/2007 Abed et al.
2007/0163145 A1 7/2007 Lavers
2007/0179421 A1 8/2007 Farrow
2008/0103460 A1 * 5/2008 Close ..... B32B 7/02 604/292
2008/0131657 A1 * 6/2008 Bauer ..... D06Q 1/00 428/124
2009/0165190 A1 7/2009 Araki et al.
2009/0187157 A1 7/2009 Hornung et al.
2011/0162122 A1 7/2011 Wright et al.
2011/0224594 A1 * 9/2011 Mueller ..... A61F 13/085 602/75
2012/0172922 A1 * 7/2012 Sesi ..... A61F 13/085 606/201
2012/0198601 A1 8/2012 Shinga et al.
2013/0035625 A1 2/2013 Kobayashi
2013/0174443 A1 7/2013 Mankowski et al.
2013/0282046 A1 10/2013 Ravikumar
2013/0283500 A1 10/2013 Lipshaw et al.
2013/0291293 A1 11/2013 Jessiman et al.
2014/0101824 A1 4/2014 Spanks
2014/0101825 A1 4/2014 Vedula et al.
2015/0051524 A1 2/2015 Messier
2015/0059209 A1 3/2015 Dekovic et al.
2015/0173451 A1 * 6/2015 Cammeyer ..... A41B 11/00 36/103
2015/0289584 A1 10/2015 Nurse et al.
2016/0030267 A1 2/2016 Lipshaw et al.
2016/0040328 A1 2/2016 Yoshida et al.
2016/0051413 A1 2/2016 Moreland et al.
2016/0113356 A1 4/2016 Clough et al.
2016/0206462 A1 7/2016 Iida
2016/0278439 A1 9/2016 Thorp
2016/0310327 A1 * 10/2016 Rule ..... A61F 13/00029
2017/0143059 A1 * 5/2017 Gallagher ..... B32B 7/08
2017/0239098 A1 8/2017 Schettler
2017/0280789 A1 10/2017 Wilson et al.
2017/0354543 A1 12/2017 Mazourik et al.
2018/0289100 A1 10/2018 Bell et al.
2018/0338868 A1 11/2018 Biddulph et al.
2019/0029330 A1 1/2019 Thorp
2019/0150522 A1 * 5/2019 Weiland ..... A41B 11/003
2019/0159549 A1 5/2019 Lopez
2021/0030104 A1 * 2/2021 Knoll ..... A43B 5/1616

FOREIGN PATENT DOCUMENTS

CN 201146826 Y 11/2008
CN 103519356 A 1/2014
CN 104172477 A 12/2014
CN 205250363 U 5/2016
DE 2820793 A1 11/1979
DE 29901284 U1 6/1999
DE 29918743 U1 4/2000
DE 10052825 C2 3/2002

(56) References Cited

FOREIGN PATENT DOCUMENTS

| | | | |
|---|---|---|---|
| DE | 202004005881 | U1 | 7/2004 |
| DE | 102004024687 | A1 | 11/2005 |
| DE | 102004024687 | A1 | 11/2005 |
| DE | 102004005556 | B4 | 1/2006 |
| DE | 102005016659 | A1 | 11/2006 |
| DE | 202007011165 | U1 | 12/2007 |
| DE | 102008030941 | A1 | 1/2010 |
| DE | 202009013912 | U1 | 4/2010 |
| DE | 102008030941 | B4 | 4/2011 |
| DE | 202013001021 | | 3/2013 |
| DE | 202013101111 | U1 | 4/2013 |
| DE | 202013005558 | U1 | 7/2013 |
| DE | 202013007578 | U1 | 10/2013 |
| EP | 2207447 | B1 | 1/2016 |
| GB | 997516 | A | 7/1965 |
| GB | 2432774 | A | 6/2007 |
| JP | H067925 | U | 2/1994 |

OTHER PUBLICATIONS

Office Action dated Dec. 23, 2019 in CN Application No. 201780028162.8.

* cited by examiner

SOCK

CROSS REFERENCE TO RELATED APPLICATIONS

This application is a Continuation of co-pending application Ser. No. 16/083,724, filed on Sep. 10, 2018, which is a 371 of International Application PCT/EP2017/055466, filed on Mar. 8, 2017; and this application claims priority of Application No. 10 2016 104 206.4 filed in Germany on Mar. 8, 2016, and Application No. 10 2016 112 126.6 filed in Germany on Jul. 1, 2016 under 35 U.S.C. § 119), the entire contents of all of which are hereby incorporated by reference.

The invention relates to a sock, in particular, a disposable sock or a booty, in particular, a disposable booty, and, in particular, a disposable booty or a sock, in particular, a disposable sock made of a fiber-based material, which is used in health care, in particular, in connection with podiatric care, in the cosmetics, personal hygiene and hygiene industries, in the transport industry and hotel business, as well as in social facilities and/or healthcare facilities, as well as a method for manufacturing such a sock or booty. The invention further relates to a bandage-similar booty or a bandage sock or a bandage shoe.

The use of reusable booties or socks, which are made of cotton or plastics, have the problem, when used in hospitals, nursing homes or other facilities where traditional socks or booties are intended for a plurality of different persons and types of feet, that ensuring hygiene and, in particular, sterility of the booties is associated with great efforts. For this reason, the use of disposable booties makes sense even from an ecological point of view. Furthermore, the use of reusable booties comprises putting them on and taking them off, as well as recirculation to cleaning, which additionally increases the efforts. In addition, traditional socks are suited to a limited degree only to walk with them without additional shoes since socks usually have low slip resistance.

Such disposable booties are, for example, known from DE 100 52 825 C2 or DE 299 18 743 U1. These provide for a paper stocking, in particular, a paper sock made of soft, durable, absorbent, elastic paper, wherein the paper sock is a disposable/single-use item. This item is made from a one-piece, flat paper cutting, and furthermore is joinable in a true-to-shape manner on the foot during the application. In this process, cutting edges located in the heel and toe zones are, in a true-to-shape manner, glued together, or can, in a true-to-shape manner, be sewn or glued together. Thus, the foot of a user is, as a whole, enclosed in a preferably fold-free manner.

A manufacturing method for a disposable booty made of nonwoven is known from DE 10 2008 030 941 B4, where a cutting pattern of a disposable booty is given, and the cutting pattern has at least two first cutting pattern edges, two second cutting pattern edges, and two third cutting pattern edges.

The nonwoven material is provided as rolled or sheet goods. The sheet goods are imprinted and/or embossed. Furthermore, at least one elastic strip element is fastened to the third cutting pattern edges on the nonwoven material, wherein the third cutting pattern edges define the opening for the foot. In addition, micro beads are introduced into the nonwoven material, and then the first and second cutting pattern edges intended for this purpose are joined. Finally, the nonwoven material is punched out or cut out in another adequate manner based on the cutting pattern.

DE 10 2004 005 556 B4 describes a textile stocking, sock, pantyhose or bandage to be worn in close contact to the skin, which contains layers of active substances with an active substance deposit which is gradually released. In this process, predefinable areas of the inside of a textile, which are in contact with the skin, and/or pads, which can be brought into a composite therewith, which are predefinable according to a targeted indication or can be determined according to known acupressure points, meridians or the like, are provided with an inorganic metal oxide powder with incorporated organic liquids and/or oils, manufactured according to a sol-gel process.

The invention is therefore based on the object to provide a sock, in particular, a disposable sock or a disposable booty as well as a method for its manufacture, which can easily be applied to a foot of a user in a true-to-shape manner.

This object is solved by the subject matter of the independent claims. Advantageous embodiments and further developments of the invention are described in the subclaims.

Hence, according to the invention, a sock, in particular, a disposable sock or a disposable booty is provided, comprising a sole part, which is adapted, when the sock or the disposable booty is donned, to cover the sole of a foot; a toe part, which is adapted, when the sock or the disposable booty is donned, to completely receive or accommodate the toe area of the foot together with the sole part; and an instep part, which is adapted, when the sock or the disposable booty is donned, to cover, at least partly, the back of the foot.

According to an embodiment, the toe part can also be adapted, when the sock or the disposable booty is donned, to receive, together with the sole part, the toe area of the foot at least partly. According to an embodiment, the sock or the disposable booty can further comprise a heel part, which is adapted, when the sock or the disposable booty is donned, to cover the heel of the foot. The sock or the disposable booty can further comprise an ankle fastening part, which is adapted, when the sock or the disposable booty is donned, to releasably fasten the sock or the disposable booty at the ankle or in the area of the ankle of the foot.

To facilitate the application of the sock, in particular, by a third person such as a caregiver, it is advantageous if the instep part is separated into a first, left and into a second, right part of the instep part by an instep opening opposite to the sole part and running along the back of the foot, wherein the instep opening is, at least partly, fastenable by the ankle fastening part. Since an opening on the front side of the sock or ankle sock particularly facilitates applying the sock, it is convenient if the instep opening extends from the toe part, in particular, from an instep opening end, in the transition area from the toe part to the instep part, to a closing edge in a cuff area of the sock, in particular, to a cutting edge section adjacent to a cuff opening. For a simple manufacture of the sock it is advantageous if the instep opening is formed as a slit or a cutout, wherein the slit or cutout, when the sock is donned and in a non-fastened state at the back of the foot, can extend from the ankle area of the foot to the toe part. In order to ensure easy fastening of the sock or ankle sock by the ankle fastening part, it is advantageous if, between a cutting edge section of the sock adjacent to the instep opening and a cutting edge section of the sock adjacent to a cuff opening, a cutting edge corner section is provided in the area of the ankle fastening part, which has an angle in a range between 80° and 130°. For a cost-efficient manufacture, in particular, as a disposable sock, it is advantageous if at least one of the parts of the sock is made of a prefabricated flat material, which comprises a nonwoven material. For a true-to-shape adjustment of the sock to the foot of a user, as well as for the provision of only one sock size in the contracted state for different foot sizes it is convenient if at least one of the parts of the sock is made of a prefabricated stretch material. In this process, it is advantageous if the stretch material has a stretch of at least 50%. In this process, it is advantageous if the stretch material has an extensibility of 100% to 30%. In this process, it is advantageous if the stretch material has a or only a single stretch direction, which, in the contracted state of the stretch material, runs substantially parallel to a closing edge in a cuff area of the heel part, and intersects a cutting edge section adjacent to the sole area at an angle in the range between 10° and 80° in deviation of the normal direction of the cutting edge section. In this process, it is advantageous if the stretch direction intersects substantially vertical a cutting edge section adjacent to the leg area of the heel part. For a simple manufacture of the stretch material, it is advantageous if the stretch material comprises a composite structure made of a material layer and elastifying means where the material layer is, in undulating form, connected to the contracted elastifying means in such a manner that the composite structure is stretchable at least along a stretch direction. In this process, it is convenient if the elastifying means comprise elastic strands or an elastic film. In order to provide a stretch in the direction of the seam it is advantageous if at least two of the parts of the sock are connected to a seam which is elastic in the direction of the seam. For the use of only one sock size in the contracted state for different foot sizes, it is advantageous if the sock, in a contracted state, has a measurement along the longitudinal direction of the sock of less than 40 cm in the contracted state, and, when donned, is stretched into an extended state in such a manner that the heel part is pulled over the heel of the foot and fastened at the ankle by the ankle fastening part.

According to the invention, a disposable booty is further provided, which comprises the following parts. The disposable booty comprises a sole part, which is adapted, when the disposable booty is donned, to cover the sole of a foot. The disposable booty further comprises a toe part, which is adapted, when the disposable booty is donned, to completely receive or accommodate the toe area of the foot together with the sole part. The disposable booty further comprises an instep part, which is adapted, when the disposable booty is donned, to cover, at least partly, the back of the foot. Preferably, a section of a cutting edge of the instep part can run diagonally across the back of the foot to an ankle area of the foot. Preferably, the disposable booty comprises a heel part, which is adapted, when the disposable booty is donned, to cover the heel of the foot. Preferably, at least the sole part, the heel part and the toe part can be formed as a one-piece cutting pattern. For a simple manufacture of the disposable booty, it is advantageous if the sole part, the heel part, the instep part and the toe part are formed as a one-piece cutting pattern. To enable firm true-to-shape application of the disposable booty to a foot of a user, it is particularly advantageous if the disposable booty further has an instep fastening part, which is adapted, when donned, to releasably fasten the disposable booty at the back of the foot. According to an embodiment of the instep fastening part, the instep fastening part comprises a flap part, which is fastened to the sole part and has a bonding element for releasable fastening of the flap part to the instep part or to the sole part. According to another embodiment, the instep fastening part comprises an adhesive tape, which is adapted, when the disposable booty is donned, to enclose, at least partly, the sole part and the instep part. According to another advantageous embodiment of the invention, the disposable booty further comprises an ankle fastening part, which is adapted in such a manner that, when the disposable booty is donned, it releasably fastens the ankle fastening part at the ankle of the foot. According to an embodiment, the ankle fastening part comprises at least a flap part, which is fastened to the heel part and has a bonding element for releasable fastening of the flap part to the ankle fastening part or to the heel part. According to another advantageous embodiment of the invention, the ankle fastening part comprises at least an adhesive tape, which is adapted, when the disposable booty is donned, to enclose the ankle of the foot at least once. For a cost-efficient and simple manufacture of the disposable booty, it is advantageous if at least two of the parts of the disposable booty are connected to one another by gluing, sewing, bonding or welding. To ensure a particularly well, true-to-shape adjustment of the disposable booty to a right or left foot, it is particularly convenient if the sole part, the instep part and the toe part are adapted in such a manner that the disposable booty can be applied to either a left foot or a right foot in a true-to-shape manner. In this process, it is advantageous if the section of the cutting edge of the instep part runs, when the disposable booty is donned, from a toe area on an inside of the foot to an ankle area on an outside of the foot. Furthermore, it is advantageous if the sole part has a form which encloses a vertical projection of the foot in a true-to-shape manner. For a particularly cost-efficient mass manufacture of the disposable booty, it is particularly convenient if at least one of the parts of the disposable booty is made of a prefabricated flat material such as nonwoven, paper or textile. To achieve true-to-shape adjustment to the foot of a user for even intermediate sizes, it is particularly convenient if the flat pre-cut part has a preferred direction in which the flat pre-cut part is more stretchable or more extensible than in other directions along the cutting plane. In this process, it is convenient if, in the case of the sole part, the preferred direction is parallel to the longitudinal direction of the foot. Furthermore, it is advantageous if, in the case of the heel part, the preferred direction is diagonal to the normal of the sole part. In addition, it is particularly advantageous if, in the case of the toe part, the preferred direction is diagonal or substantially orthogonal to the longitudinal direction of the foot. For use in the nursing and hospital field, it is particularly advantageous if at least a part of the disposable booty has a skincare or medically active substance embedded therein. According to the invention, a method for manufacturing the disposable booty according to the invention is further provided, which comprises the following steps. First of all, a roll or a stack of a flat material is provided. Thereafter, the parts of the disposable booty are separated from the flat material according to a given cutting pattern. Subsequently, the parts are connected in accordance with predefined connecting areas of the parts of the disposable booty. Among the parts of the disposable ankle sock, all features should be included which are introduced into the description and the claims as a part, in particular, the sole part, the toe part, the instep part, the heel part, the instep fastening part, the ankle fastening part, as well as the flap part.

According to the invention, a disposable booty is further provided, which comprises the following parts. The disposable booty comprises a sole part, which is adapted, when the disposable booty is donned, to cover the sole of a foot. The disposable booty further comprises a toe part, which is adapted, when the disposable booty is donned, to completely receive or accommodate the toe area of the foot together with the sole part. The disposable booty further comprises an instep part, which is adapted, when the disposable booty is donned, to cover, at least partly, the back of the foot. The disposable booty further comprises a heel part, which is adapted, when the disposable booty is donned, to cover the heel of the foot. The heel part can have a receiving part, which is adapted to receive an insert. According to an embodiment, the receiving part is adapted, when the disposable booty is donned, to run from the back of the foot around the heel of the foot and, at least partly, underneath the ball of the foot. Advantageously, the heel of the foot can be enclosed therewith. If the insert then includes a material for pressure protection, the foot, and, in particular, the heel, can be protected from excessive mechanical stress. For example, the insert can include or be a silicon pad, a gel pad, a cushion, a sponge, a foam cushion or a cotton pad, which is, in particular, adapted to cover, at least partly, the back of the foot, the ankle of the foot and/or the sides of the foot. Furthermore, also inserts are conceivable, which are adapted to increase the stability of the foot through supporting measures. This is all the more effective, the further the receiving part reaches, along the ankle of the foot, upwards. In addition, inserts are conceivable, which are adapted to act as a kind of insole and support the foot from the sole. In order to minimize a friction on the skin, the surface areas of the disposable booty, which are adapted, when the disposable booty is donned, to contact the foot, can include a friction-reducing material. In addition to the mechanical and/or geometrical properties of the disposable booty according to the invention, such as elasticity and tensile strength, also a felt haptic "softness" (i.e. a processing without edges, which, in particular, is smooth, clean, etc.) is advantageous for the wearer and/or the foot. For example, the friction-reducing material can include a friction-reducing basic material or an impregnated textile or a coating of the surface areas. To create a lubrication effect between the skin of the foot and the disposable booty, a textile strip can be provided which includes a lotion. The textile strip can, in particular, be adapted to cover, at least partly, the back of the foot, the ankle of the foot and/or the sides of the foot. In addition to reducing skin irritations (for example, through a lubrication effect), the disposable booty can further include an active substance applied to the disposable booty, which acts as friction-reducing, odor-inhibiting, antibacterial, bacteriostatic, fungistatic, antiviral, hemostatic or pain-relieving. According to an advantageous embodiment, the disposable booty includes a donning aid fastened to the heel part. The donning aid can be adapted to facilitate putting on and/or taking off the disposable booty. For example, the donning aid can facilitate the putting on and/or taking off of the disposable booty in that one can grab the disposable booty at the donning aid, in order to pull the heel part over the heel and/or off the heel. For example, the donning aid, in a particularly simple and cost-efficient embodiment, can include a flap, an eyelet or a cloth extending away from the heel part.

Preferably, the sole part, the heel part, the toe part and furthermore the instep part can be formed as a one-piece cutting pattern. Preferably, the whole disposable booty can be formed as a one-piece cutting pattern. The one-piece cutting pattern can have at least a cutting edge corner area with a cutting edge angle equal to or greater than 70°, in particular, equal to or greater than 75°, and/or equal to or less than 90°, in particular, equal to or less than 85° and/or preferably approximately equal to 80°. Alternatively or additionally, the one-piece cutting pattern has a semicircular recess in an area corresponding to the toe part. Furthermore, the multi-layer material can include a diaper material or a stretch material. Alternatively or additionally, the multi-layer material can include a localized material layer, which provides, in a localized or spatially limited area, a particular function for that area. Furthermore, an instep fastening part can be provided, which is adapted, when the disposable booty is donned on the foot, to releasably fasten the disposable booty at the back of the foot. The instep fastening part can have an elastic material. Furthermore, the disposable booty can be manufactured without seams.

Hence, according to the invention, a disposable booty is provided, which is adjusted for a true-to-shape receipt or accommodation of a foot. In this process, the disposable booty has a sole part which is formed as a flat prefabricated part, which, according to a preferred embodiment, has the form of a foot sole. Furthermore, the disposable booty has a heel part connected to the sole part, which, together with the sole part, forms a bag for receiving the heel. In addition, the disposable booty has a toe part connected to the sole part, which, together with the sole part, forms a bag for receiving the toes. The disposable booty further has an instep part, which, along a longitudinal side of the sole part, is connected to the sole part and, together with the sole part, forms a bag for receiving the midfoot, which is open towards the opposite longitudinal side of the sole part. The disposable booty further has a heel part, which is adapted, when the disposable booty is donned, to cover the heel of the foot. The disposable booty can have a heel part, a receiving part, which is adapted to receive an insert. The receiving part can, in particular, be formed bag-shaped. In this connection, the receiving part can also be designated as a bag or a heel part bag.

Thus, a disposable booty is created, which has a true-to-shape foot sole, wherein bags are furthermore formed in the heel area and in the toe area, which receive the front part and the rear part of the foot. Furthermore, according to the invention, a bag for the midfoot is formed, which is open towards one side of the foot and closed towards the other side of the foot.

In this process, an edge of this bag for the midfoot runs from the opening side of the midfoot bag from the toe area to the ankle area diagonally towards the closed side of the midfoot bag. Thus, easy application of the disposable booty is achieved since the toe area can easily be inserted into the bag of the toe part, thereafter, the foot can be inserted into the bag formed by the heel part, wherein both procedures are conducted by slipping the booty over from one side of the foot. In an embodiment according to the invention, an instep fastening part is further formed on the opening side of the midfoot bag, which can then firmly apply the disposable booty to the foot of the user.

The invention is explained in more detail in the following text, for example, based on the drawings in which:

In the various figures of the drawings, components corresponding to each other are provided with the same reference numerals.

FIG. 1 shows a schematic perspective view of a sock 10 or a disposable booty 10 according to an embodiment of the invention.

Figure 1:
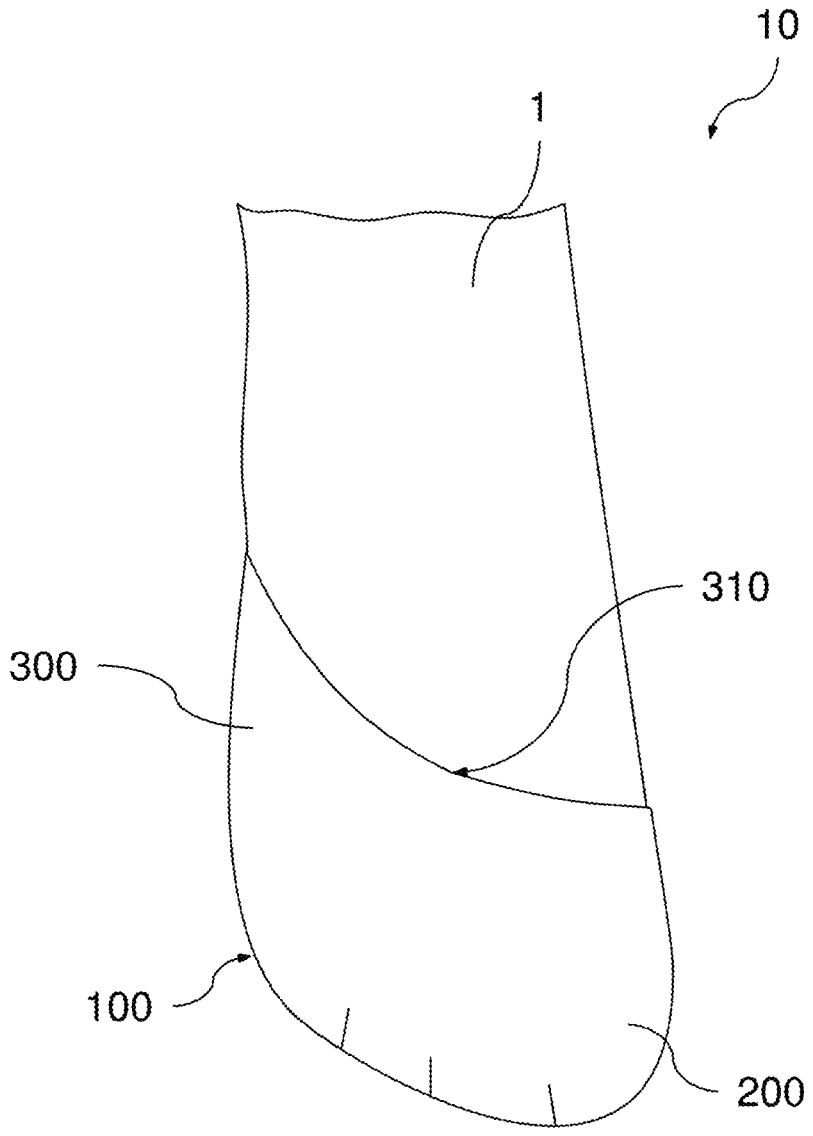
FIG. 1 shows a schematic perspective view of a disposable booty according to an embodiment of the invention.

The disposable booty 10 or the sock 10, in particular, the disposable sock 10, has a sole part 100, a toe part 200, and an instep part 300. The disposable booty 10 is manufactured in such a manner that it can be applied to a foot 1 in a true-to-shape manner. In this connection, the sole part 100 is adapted, when the disposable booty 10 is in a state applied to the foot 1, to cover the sole of the foot 1. The toe part 200 is adapted, when the disposable booty 10 is donned, to completely receive, together with the sole part 100, the toe area of the foot 1. To this end, the instep part 300 is adapted, when the disposable booty 10 is in a state applied to the foot 1, to cover, at least partly, the back of the foot 1. The terms "instep", "arch of the foot" and "back of the foot" are to be regarded as synonymous.

As can be seen from FIG. 1, a section of a cutting edge 310 of the instep part 300 can, according to an embodiment of the invention, diagonally run from the toe area of the foot 1 across the back of the foot 1 to an ankle area of the foot 1. By providing such a running cutting edge 310 of the instep part 300, it is made possible that, when the disposable booty 10 is applied to the foot 1, the toe area of the foot 1 is first of all slipped into the toe part 200 from the open side of the instep part 300 into the toe part 200, so that applying the disposable booty 10 to the foot 1 is facilitated.

Figure 2A:
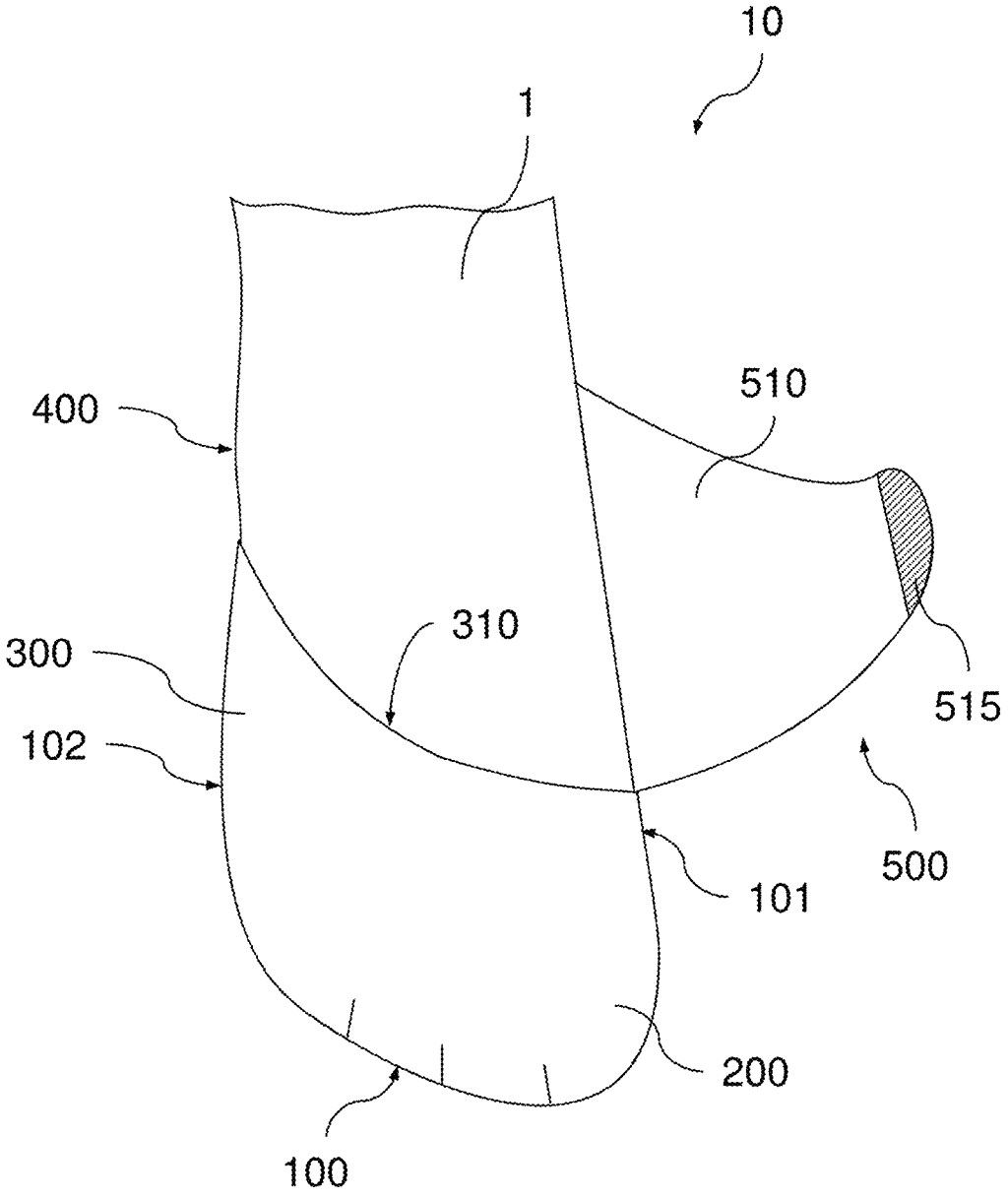
FIGS. 2A and 2B show a schematic perspective view of a disposable booty according to another embodiment of the invention in an open and in a fastened state.
Figure 2B:
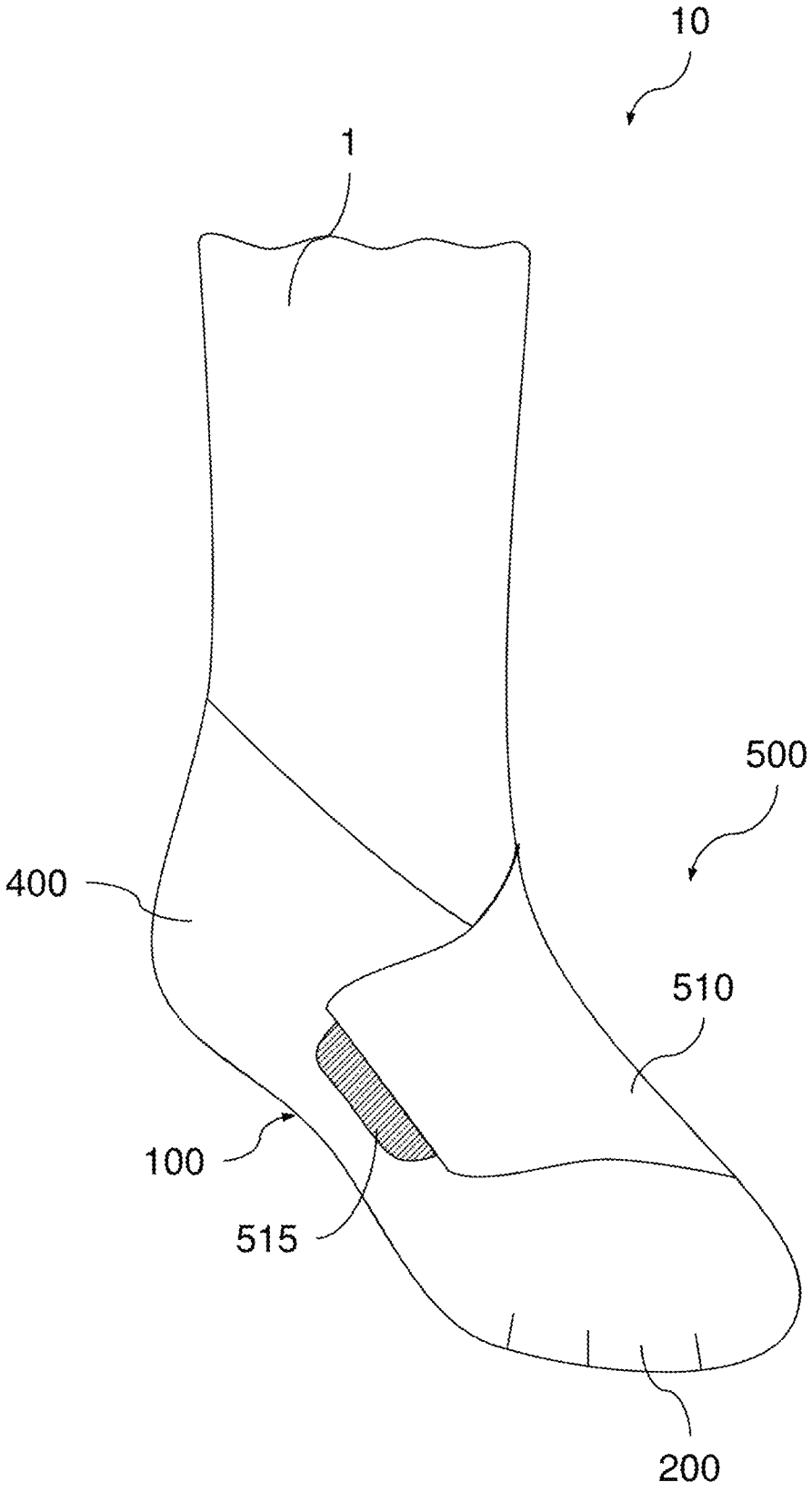

FIGS. 2A and 2B show a schematic perspective view of a disposable booty 10 according to another embodiment of the invention in an open and in a fastened state. As can be seen from FIGS. 2A and 2B, the disposable booty 10 or the sock 10, in particular, the disposable sock 10, further comprises, in addition to the sole part 100, the toe part 200 and the instep part 300, a heel part 400, which is adapted, when the disposable booty 10 is donned, to cover the heel of the foot 1. Furthermore, the disposable booty 10 or the sock 10, in particular, the disposable sock 10, has an instep fastening part 500, which is adapted, when the disposable booty 10 is in a state applied to the foot 1, to releasably fasten the disposable booty 10 at the back of the foot 1. According to the embodiment of the invention shown in FIGS. 2A and 2B, the instep fastening part 500 has a flap part 510, which is fastened to the sole part 100 and which has a bonding element 515 for releasable fastening of the flap part 510 to the instep part 300 or to the sole part 100.

As can be seen from FIG. 2A, the section of the cutting edge 310, as described above, runs from a first longitudinal side 101 of the sole part 100 to a second longitudinal side 102 of the sole part 100, starting from the toe part 200 of the disposable booty 10 to the heel part 400 of the disposable booty 10. According to an embodiment of the invention, the sole part 100, the instep part 300, and the toe part 200 are adapted in such a manner that the disposable booty can either be put on a left foot or, as shown, on a right foot 1 in a true-to-shape manner.

In the embodiment shown in FIG. 2A, the first longitudinal side 101 of the sole part 100 is on the inside of the foot, and the second longitudinal side 102 of the sole part 100 on the outside of the right foot 1. Hence, the section of the cutting edge 310 of the instep part 300 runs, when the disposable booty 10 is donned, from a toe area of the foot 1 which is received in the toe part 200, or from the toe part 200 on an inside of the foot, i.e. of the first longitudinal side 101 of the sole part 100, to an ankle area of the foot 1 on an outside of the foot 1, i.e. of the second longitudinal side 102 of the sole part 100. Thus, the section of the cutting edge 310 of the instep part 300 runs along the longitudinal sides 101, 102 of the sole part 100 alternately from the toe part 200 to the heel part 400. When adjusting a disposable booty 10 to a left foot, the first longitudinal side 101 of the sole part 100 corresponds to the inside of the left foot, and the second longitudinal side 102 of the sole part 200 to the outside of the left foot 1. Hence, when providing a pair of disposable booties 10 adjusted to a left and a right foot, two disposable booties 10 are provided which are formed symmetrically identical. As can be further seen from FIG. 2A and also in the subsequently described FIG. 8, the sole part 100 advantageously has a form which encloses a vertical projection of the foot 1 in a true-to-shape manner.

The flap part 510 of the instep fastening part 500 is advantageously fastened to the first longitudinal side 101 of the sole part 100, i.e. on an inside of the foot 1, to the sole part 100. As can be obtained from a comparison of FIGS. 2A and 2B, the foot 1, when the disposable booty 10 is applied to the foot 1, is first of all slipped with its toe area into the toe part 200 shaped as a bag from an inside of the foot, or from the first longitudinal side 101 of the sole part 100 into the toe part 200. This is facilitated through the fact that the instep part 300 is open towards the inside of the foot 1 or towards the first longitudinal side of the sole part 102. Furthermore, due to the course of the section of the cutting edge 310 of the instep part 300, applying the disposable booty 10 to the foot 1 is further facilitated due to the fact that the big toe in the toe area of the foot 1 can be slipped centrally into the toe part 200 from the inside of the foot or from the first longitudinal side 101 of the sole part 100 into the toe part 200, and then can be moved, through a swivel movement of the foot 1 in the toe part 200 towards the inside of the foot or towards the first longitudinal side 101 of the sole part 100, into the toe part 200. After the disposable booty has been applied to the toe area of the foot 1, the heel of the foot 1 is inserted into the heel part 400. Therefore, the instep fastening part 500 is fastened to an inside of the foot of the sole part 100, when adjusted to a left/right foot, i.e. on the side where the big toe is each located. In this process, the instep fastening part 500 fastens the open area of the instep part 300 and is opposite to the closed area of the instep part 300.

Similar to the toe part 200, the heel part 400 forms a bag for the corresponding toe area and the heel of the foot 1. Since the sole of the foot 1 is in contact with the sole part 100, the disposable booty 10 or the sock 10, in particular, the disposable sock 10, is fastened by the instep fastening part 500. To this end, the flap part 510 is moved across the back of the foot 1 in the direction of the outside of the foot 1 or in the direction of the second longitudinal side 102 of the sole part 100, wherein it sweeps over the section of the cutting edge 310 of the instep part 300. Due to an adhesive bond between the bonding element 515 and the instep part 300 or, where applicable, the bottom sole part 100, the disposable booty 10 or the sock 10, in particular, the disposable sock 10, is fastened by the instep fastening part 500. Hence, the instep fastening part 500 is formed in such a manner that it sweeps over the section of the cutting edge 310 of the instep part 300, when applying the disposable booty 10.

As can be seen from FIG. 2B, a particularly fitting or true-to-shape application of the disposable booty 10 to the foot 1 is, due to the provision of the instep fastening part 500 according to the invention, possible since a stepless adjustment due to different positions of the adhesive bond between the bonding element 515 and the instep part 300 is possible.

Figure 3A:
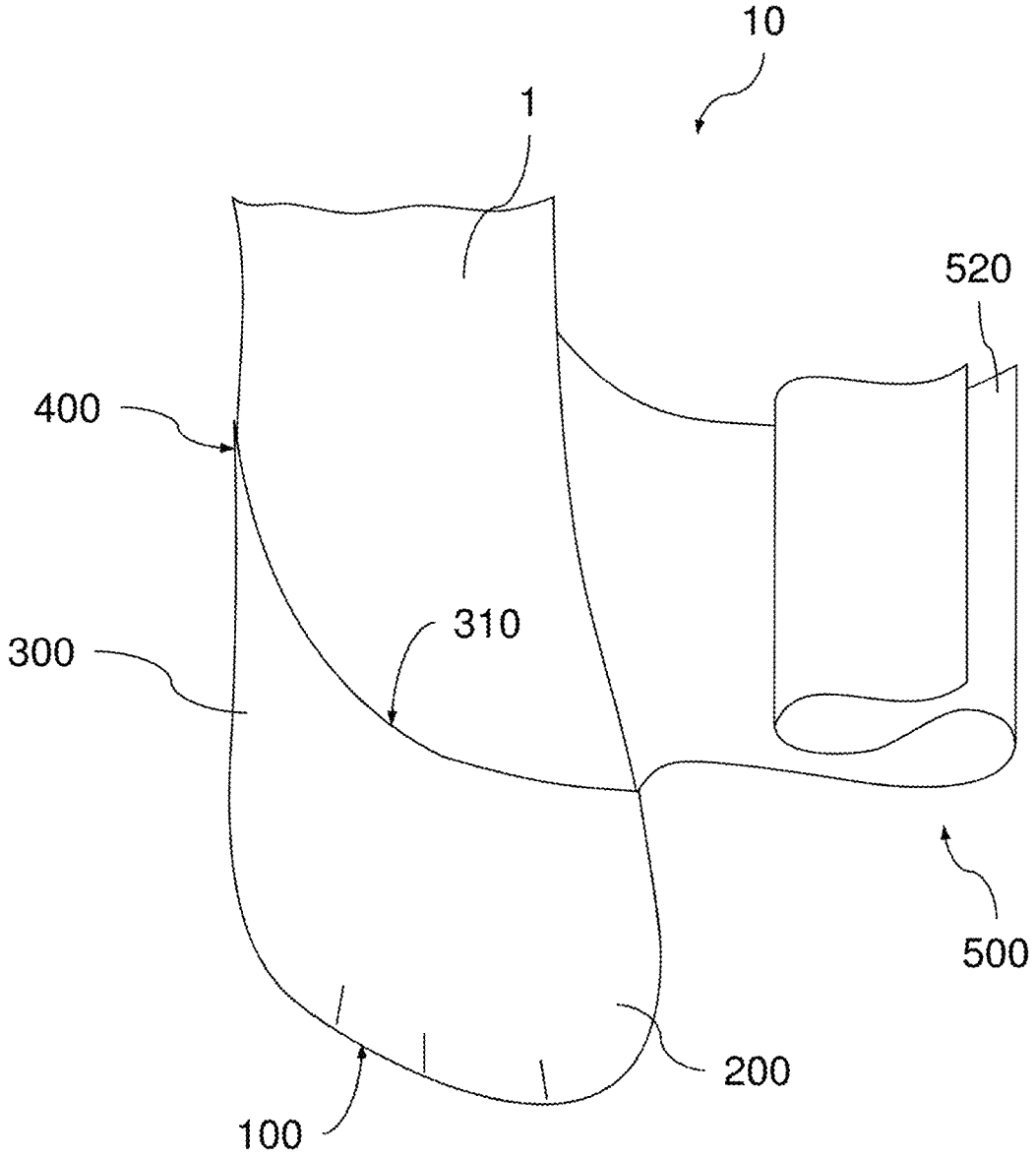
FIGS. 3A and 3B show a schematic perspective view of a disposable booty according to another embodiment of the invention in an open and in a fastened state.
Figure 3B:
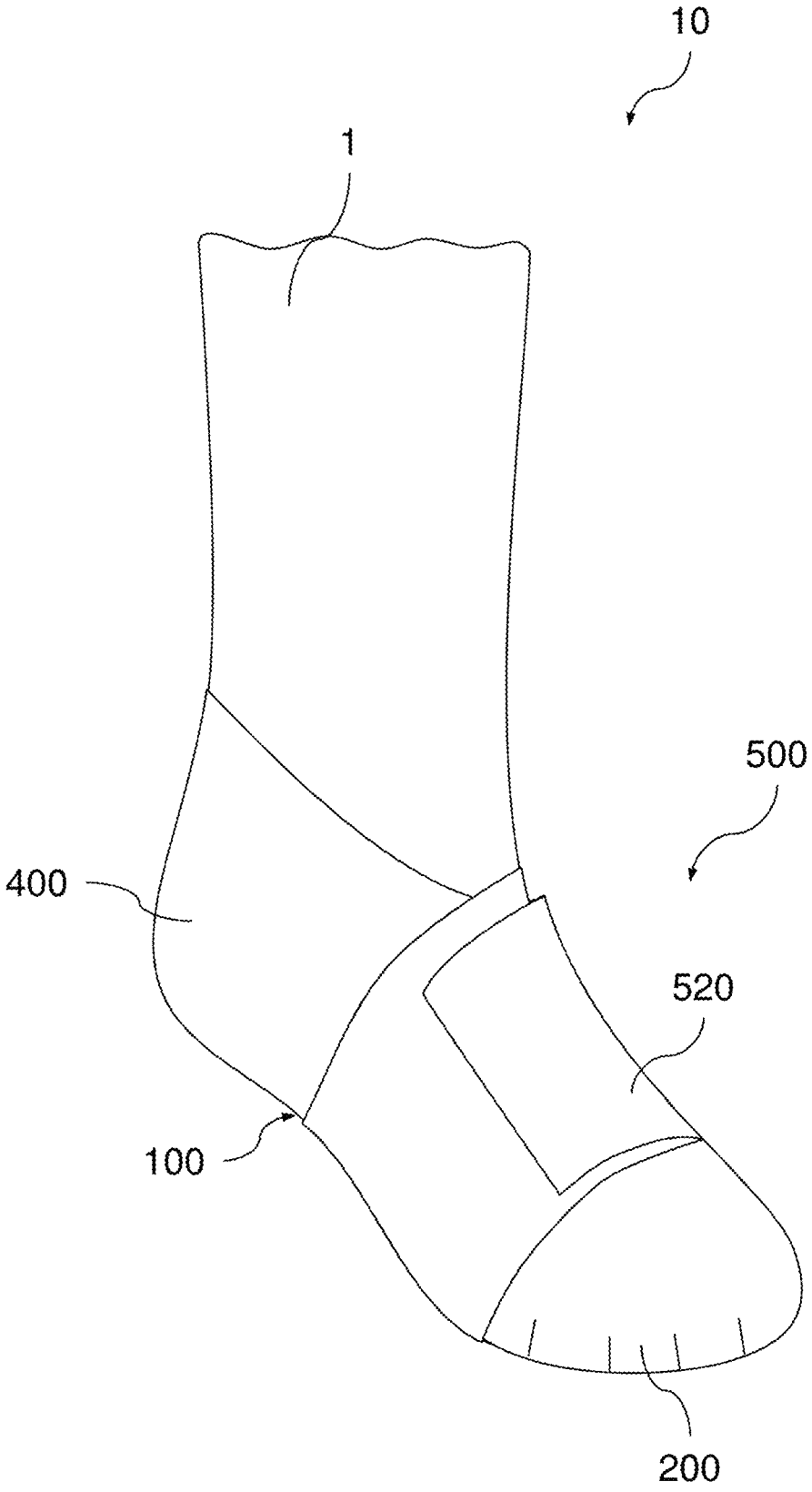

FIGS. 3A and 3B show schematic perspective views of a disposable booty 10 according to another embodiment of the invention in an open and in a fastened state. The disposable booty 10 shown in FIGS. 3A and 3B substantially differs from the disposable booty 10 shown in FIGS. 2A and 2B in that the instep fastening part 500 comprises, instead of a flap part 510, an adhesive tape 520, which is adapted, when the disposable booty 10 is in a state applied to the foot 1, to enclose the sole part 100 and the instep part 300 at least once. By "adhesive tape" a part of a functional bandage material is to be understood, which has the property of sticking to a roughened material or to a textile material or to itself. Therefore, when enclosing the midfoot area of the disposable booty 10 in the state applied to the foot 1, the adhesive tape 520 sticks to itself in an area, in which the adhesive tape 520 has enclosed or wrapped the disposable booty 10 in a midfoot area at least once.

An adhesive tape is also known as a support bandage or tape bandage. The adhesive tape is a self-adhesive pressure bandage which is applied, with a curative or preventative purpose, to restrict the mobility of joints, for example. Therefore, a tape bandage is a functional bandage. Hence, an adhesive tape, a support bandage, or a tape bandage is a fixed dressing to protect weak or damaged structures such as muscles and ligaments, for example, without having to immobilize them completely. Also, in the case of instabilities, the support bandage can, as a prophylaxis, be applied to prevent injuries. Furthermore, the adhesive tape, the support bandage, or the tape bandage has a specific elasticity in its longitudinal direction, in order to exert pressure on the enclosed part of the body. Hence, in the embodiment of the disposable booty 10 shown in FIGS. 3A and 3B, the adhesive tape 520 contributes in a particularly advantageous manner to the fact that the disposable booty 10 or the sock 10, in particular, the disposable sock 10, fits to the midfoot of the foot 1 in a true-to-shape or fitting manner. The adhesive tape 520 can also be a Kinesiotape or a bandage without an adhesive effect, which is fastened by means of clips after it has been wrapped around the disposable booty 10 in the midfoot section.

The adhesive tape 520 further has the advantage that the adhesive tape 520, when the disposable booty 10 is in a state applied to the foot 1, covers the sole part 100 as well and thus is in contact with a floor when a user is walking. In this process, the self-adhesive or adhesive properties of the adhesive tape 520 create slip resistance of the disposable booty 10 in the state applied to the foot 1, when the user walks on a floor underlay. Thus, according to the embodiment of FIGS. 3A and 3B of the disposable booty 10, both a particularly custom-fit application of the disposable booty 10 to the foot 1 as well as slip resistance while walking with the disposable booty 10 is achieved by using the adhesive tape 520.

Figure 4A:
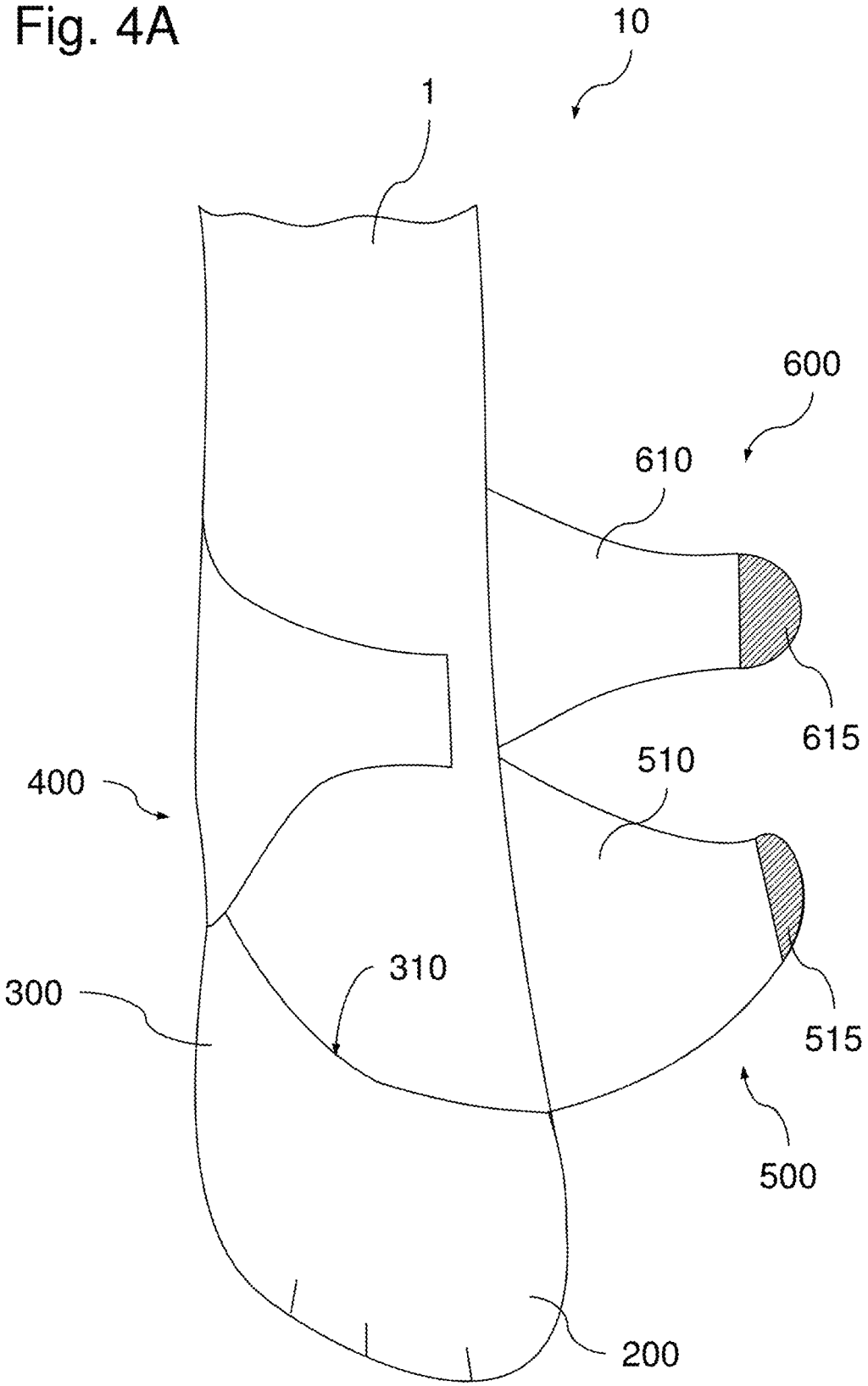
FIGS. 4A and 4B show a schematic perspective view of a disposable booty according to another embodiment of the invention in an open and in a fastened state.
Figure 4B:
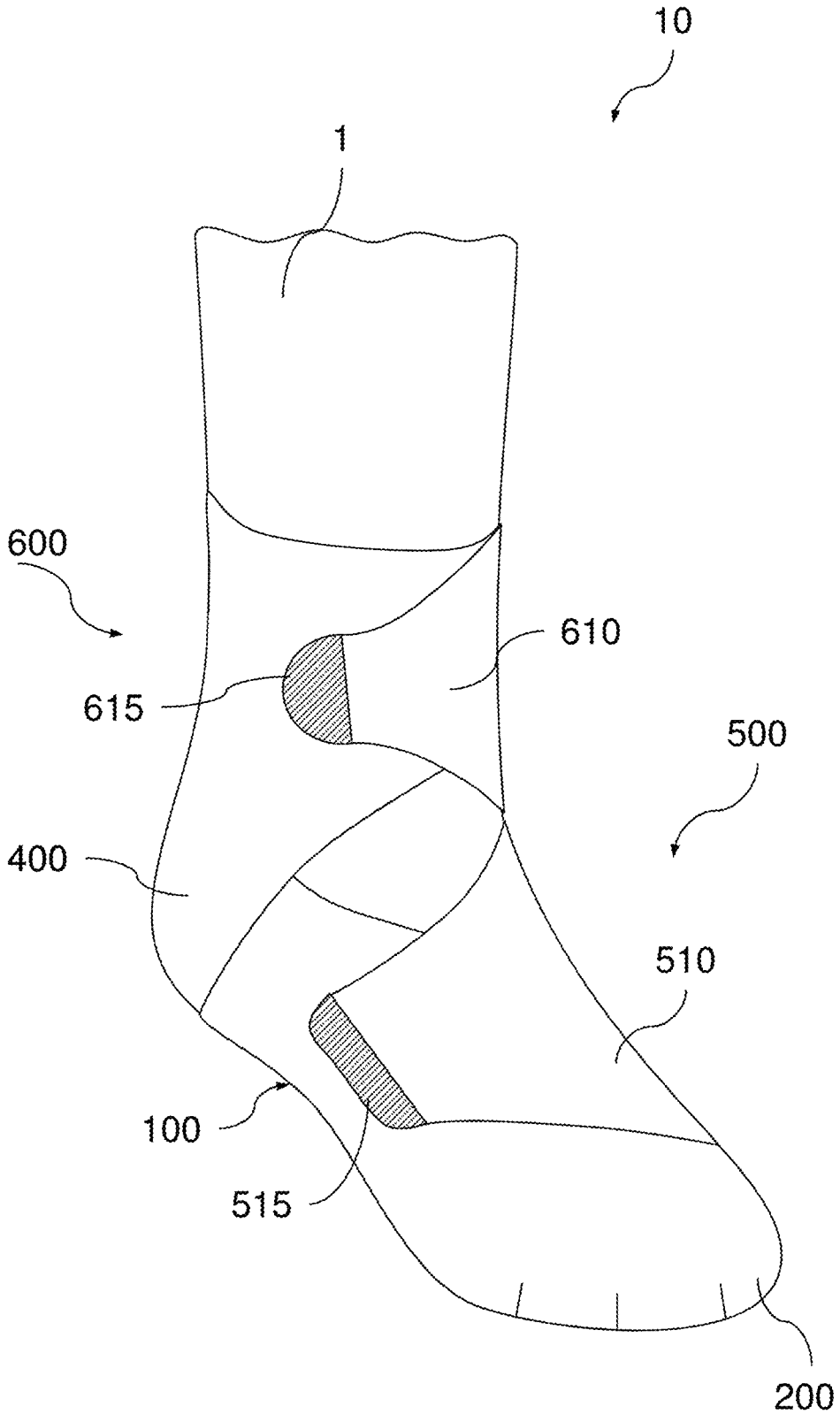

FIGS. 4A and 4B show schematic perspective views of a disposable booty 10 according to another embodiment of the invention in an open and in a fastened state. The disposable booty 10 shown in FIGS. 4A and 4B substantially differs from the disposable booty 10 shown in FIGS. 2A and 2B in that the disposable booty 10 or the sock 10, in particular, the disposable sock 10, further has an ankle fastening part 600, which is adapted, when the disposable booty 10 is donned, to releasably fasten the disposable booty 10 at the ankle of the foot 1. In the embodiment of the invention shown in FIGS. 4A and 4B, the ankle fastening part 600 encloses at least a flap part 610, which is fastened to the heel part 400 and which has a bonding element 615 for releasable fastening of the flap part 610 to the ankle fastening part 600 or to the heel part 400. The side of the sole part 100 facing the floor can be coated by machine in the manufacturing process with silicon, for example, in order to create slip resistance. This creates the same effect as in the embodiment of FIGS. 3A and 3B where an adhesive tape 520 is used, which is wrapped around the instep area of the foot 1.

The bonding element 615 of the ankle fastening part 600 as well as the bonding element 515 of the instep fastening part 500 can be configured as a Velcro fastener or as an adhesive strip. Furthermore, the bonding element 515, 615 can be configured as a silicon fastening element. For example, an OPSITE Flexifix by company Smith & Nephew can be used for the bonding element 615, 515.

As can be obtained from FIGS. 4A and 4B, when the disposable booty 10 is applied to the foot 1, the instep fastening part 500 is first fastened and then the ankle fastening part 600 is fastened at the ankle of the foot 1. By providing the ankle fastening part 600, it is achieved that the disposable booty 10 or the sock 10, in particular, the disposable sock 10, is firmly placed on the foot 1 when in the state applied to the foot 1, whereby releasing of the disposable booty 10 from the foot 1 is prevented even more strongly than this would be the case if the instep fastening part 500 is solely provided. Furthermore, the ankle fastening part 600 fits to an ankle area and to a heel area of the foot 1 in a true-to-shape and tailor-made manner, whereby a completely fitting disposable booty 1 is achieved across the foot 1 from the ankle area of the foot 1 to the toe area of the foot 1. Due to the tight fitting of the disposable booty 10 to the foot 1, it is achieved on one hand that the foot 1 is isolated by the disposable booty 10. On the other hand, it can be achieved due to the tight fitting of the disposable booty 10 to the foot 1 that the skincare or medically active substances incorporated into the disposable booty 10 can penetrate into the foot 1 as the disposable booty 10 or the sock 10, in particular, the disposable sock 10, is in direct contact with the foot 1 in a large area.

Figure 5A:
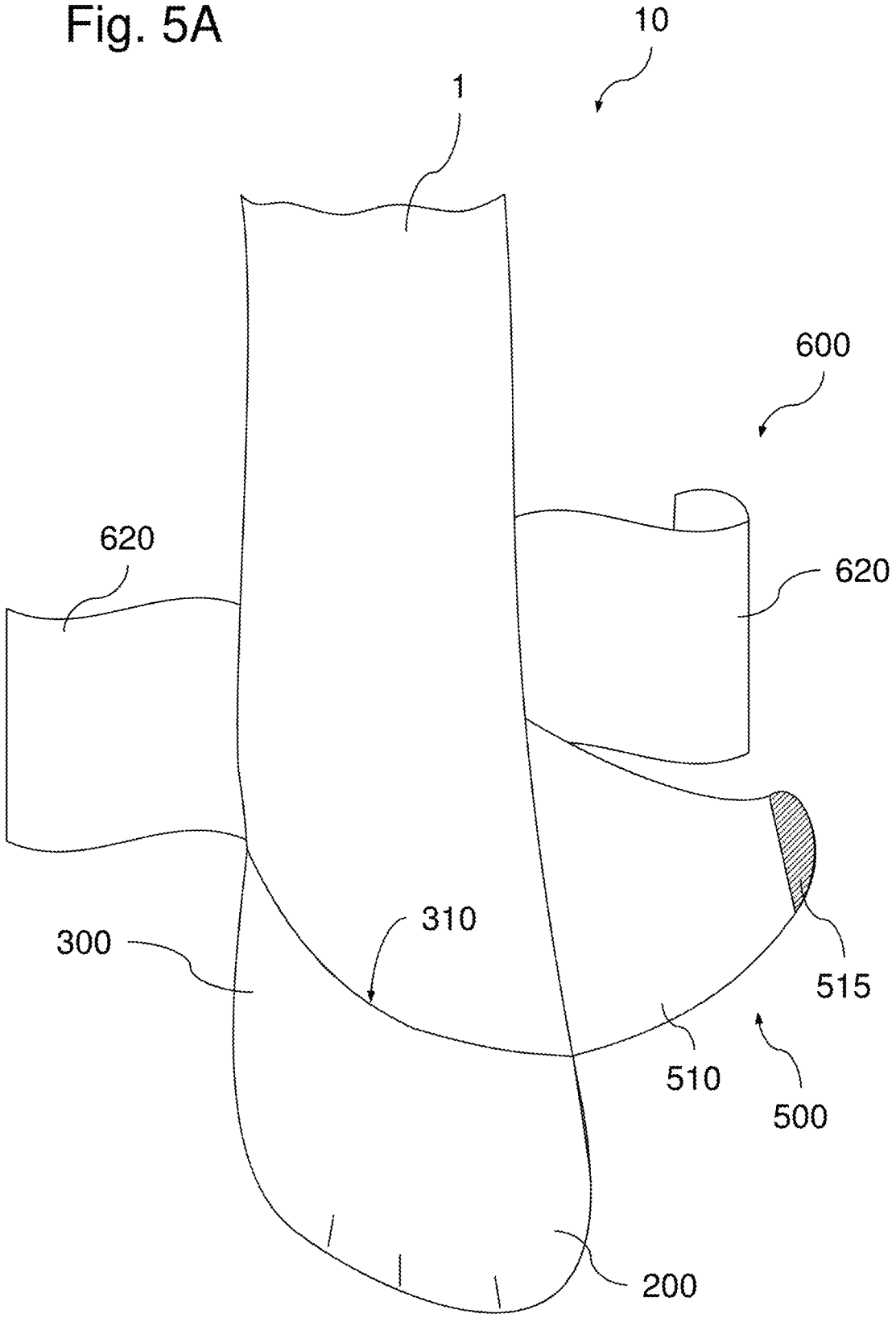
FIGS. 5A and 5B show a schematic perspective view of a disposable booty according to another embodiment of the invention in an open and in a fastened state.
Figure 5B:
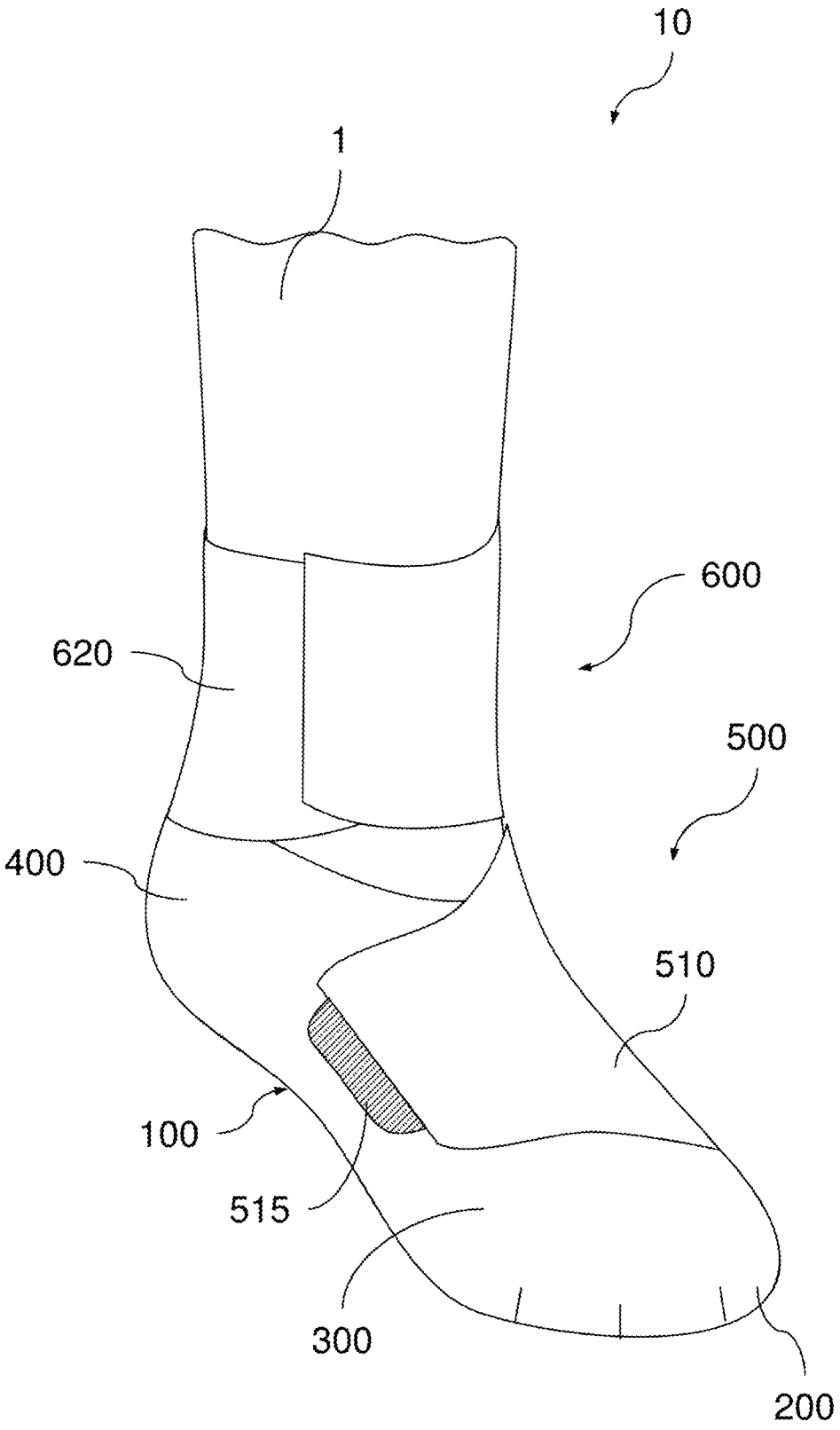

FIGS. 5A and 5B show a schematic perspective view of a disposable booty 10 according to another embodiment of the invention in an open and in a fastened state. The disposable booty 10 shown in FIGS. 5A and 5B substantially differs from the embodiment shown in FIGS. 4A and 4B in that the ankle fastening part 600 comprises at least an adhesive tape 620, which is adapted, when the disposable booty 10 is donned, to enclose the ankle of the foot 1 at least once. By providing at least one adhesive tape 620 of the ankle fastening part 600, the ankle area of the foot 1 can, as shown in FIG. 5B, be wrapped by the adhesive tape 620 either from one side or from two sides, whereby tight fitting of the ankle closing part 600 is achieved by means of two adhesive tapes 620 or by means of one adhesive tape 620.

Figure 6A:
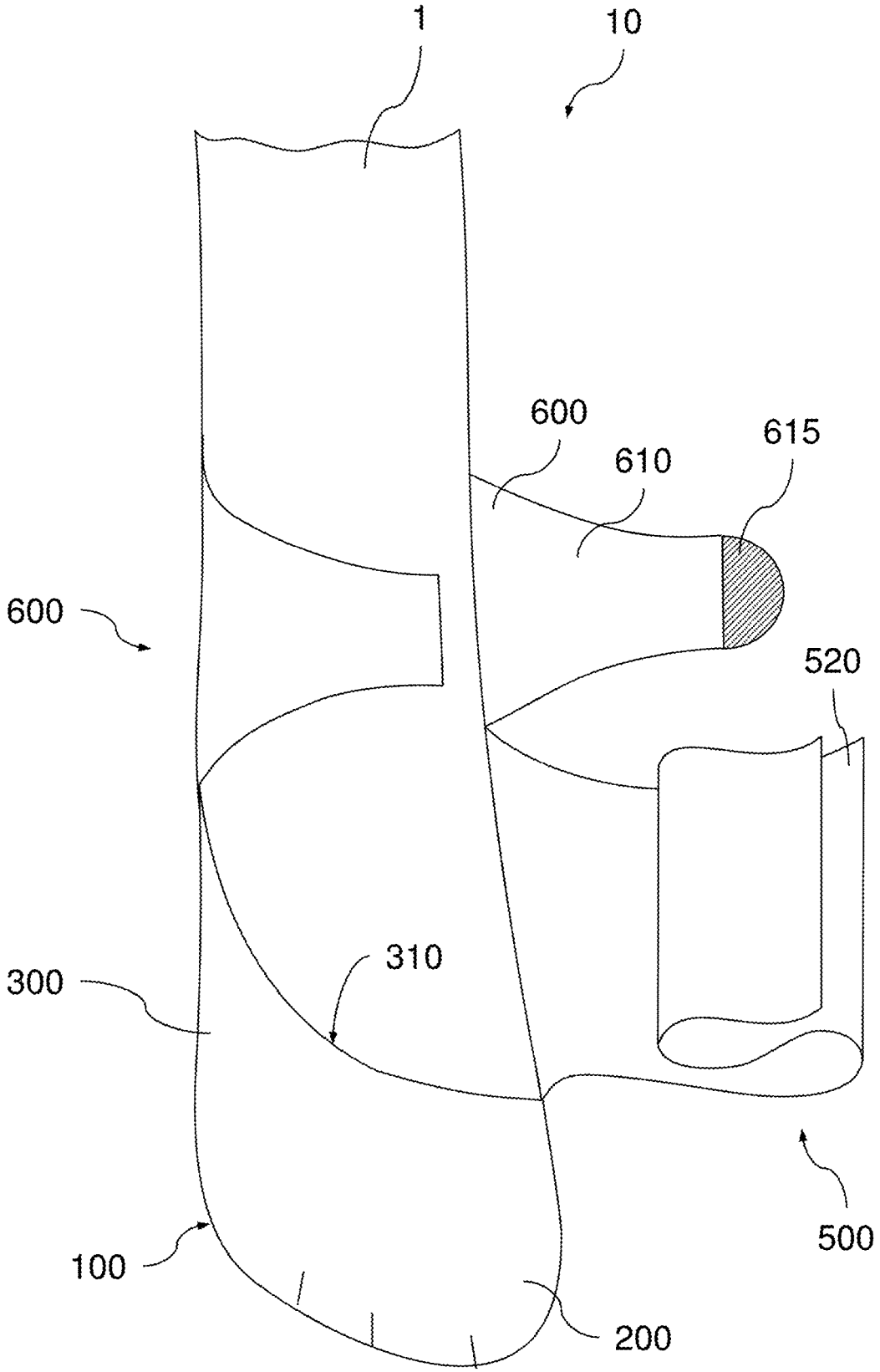
FIGS. 6A and 6B show a schematic perspective view of a disposable booty according to another embodiment of the invention in an open and in a fastened state.
Figure 6B:
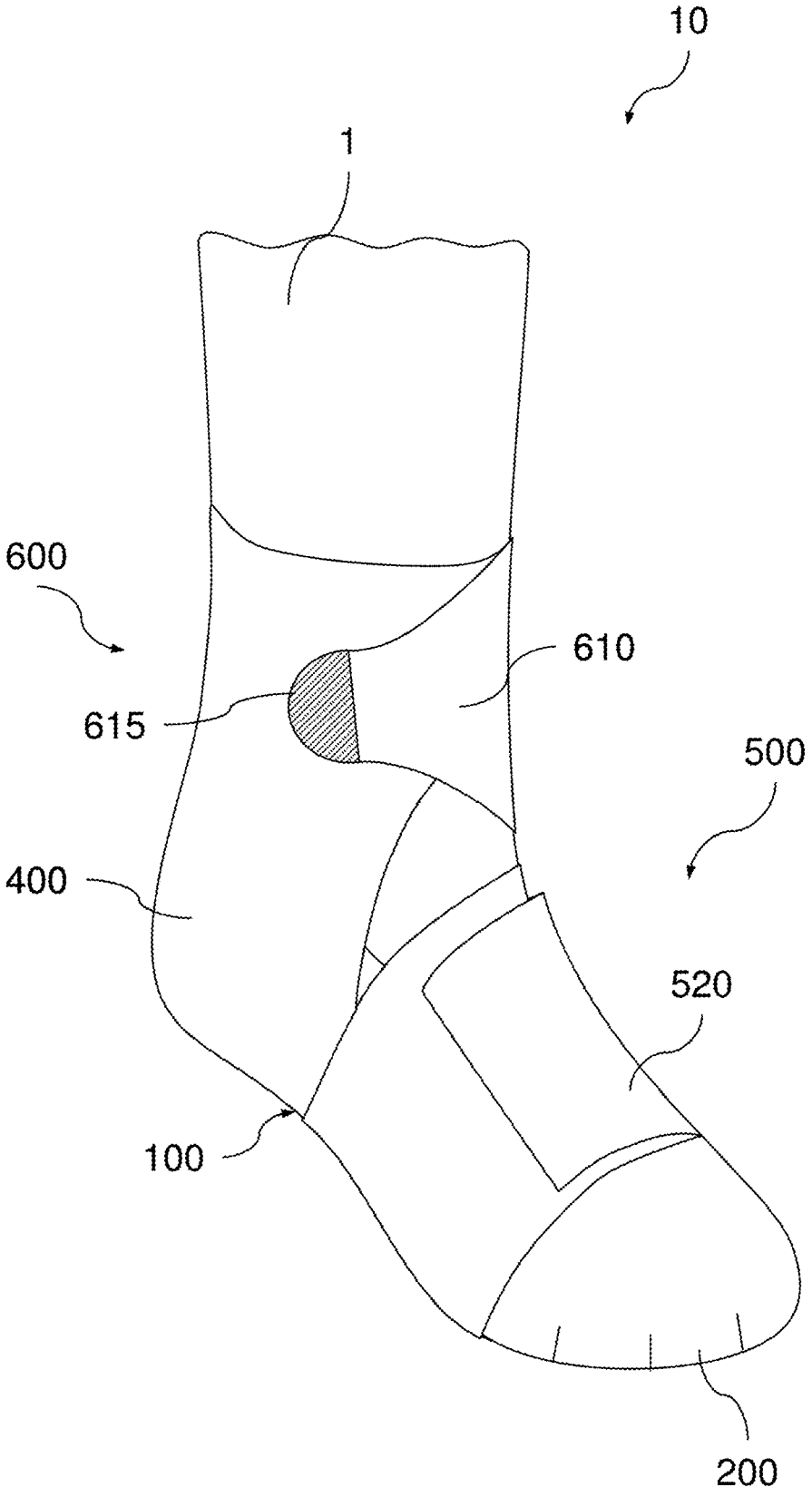

FIGS. 6A and 6B show schematic perspective views of a disposable booty 10 according to another embodiment of the invention in an open and in a fastened state. The disposable booty 10 shown in FIGS. 6A and 6B substantially differs from the disposable booty 10 shown in FIGS. 3A and 3B in that an ankle fastening part 600 is provided as it has been shown and described for the disposable booty 10 in FIGS. 4A and 4B. Due to the embodiment of the invention shown in FIGS. 6A and 6B, tight fitting of the disposable booty 10 to the midfoot of the foot 1 with slip resistance at the same time can be achieved on one hand, while, on the other hand, quick fastening of the disposable booty 10 at the ankle area of the foot 1 is achieved by the flap part 610 connected to the bonding element 615.

Figure 7A:
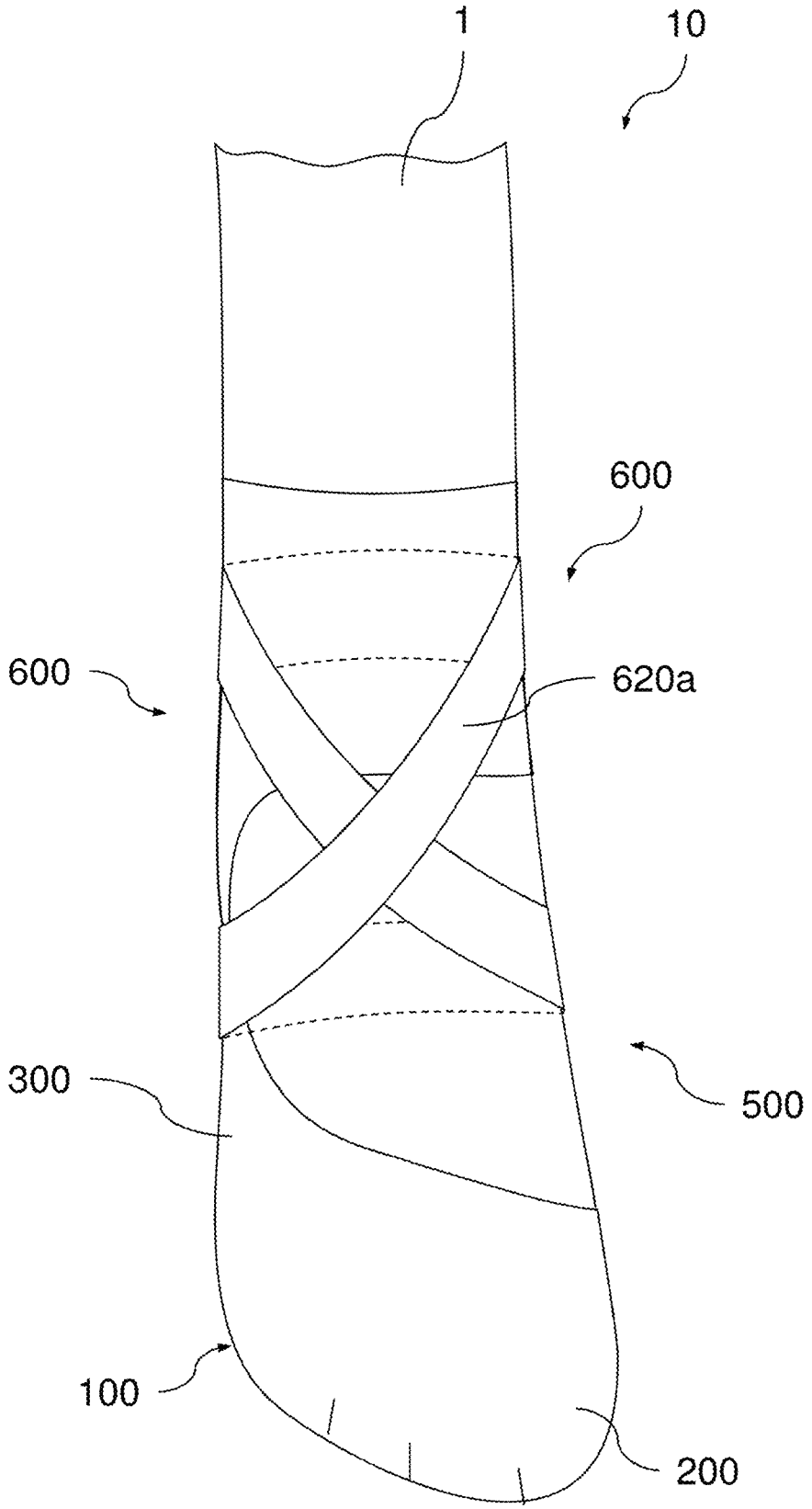
FIGS. 7A and 7B show schematic perspective views of a disposable booty according to another embodiment of the invention.
Figure 7B:
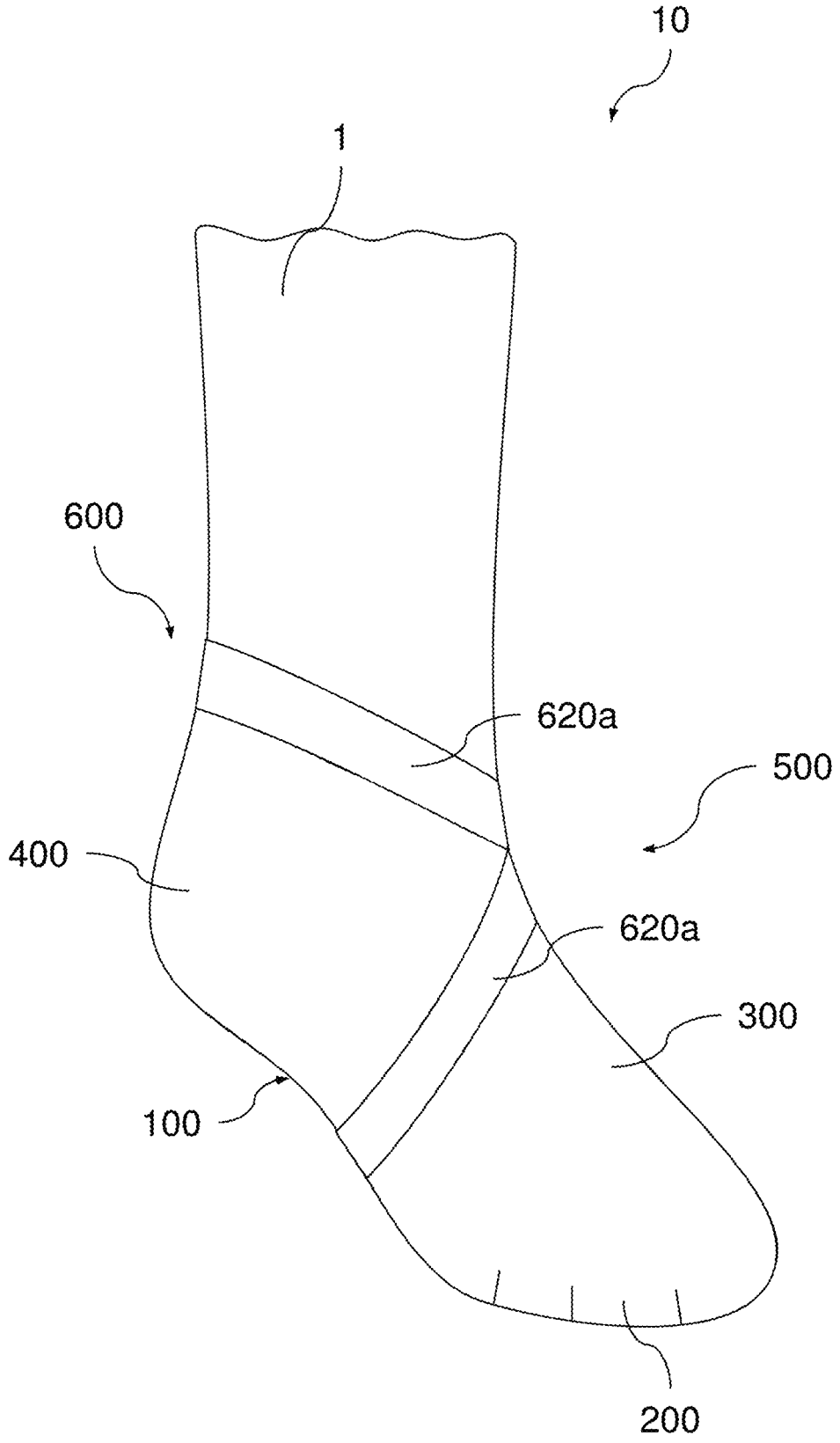

FIGS. 7A and 7B show schematic perspective views of a disposable booty 10 according to another embodiment of the invention. The disposable booty 10 shown in FIGS. 7A and 7B substantially differs from the disposable booty 10 shown in FIGS. 5A and 5B in that an ankle fastening part 600 is provided, which includes a tape 620*a*, which fastens the disposable booty 10 both in the instep area and in the ankle area due to alternately winding around both the ankle of a foot 1 and the instep of a foot 1. The tape 620*a* can be formed as an adhesive tape, as described above. However, the tape 620*a* can also be an elastic tape or bandage without an adhesive effect. In this case, the tape 620*a* can be secured by clips or adhesives. In the case of using an adhesive tape as tape 620*a*, the advantageous effect also occurs that there is increased slip resistance while walking.

In the following text, prefabricated parts of a cutting pattern of a disposable booty 10 according to the invention are described.

According to an embodiment of the invention, at least one of the parts 100, 200, 300, 400, 500, 510, 600 and 610 of the disposable booty 10 is made from a prefabricated part of a flat material. The flat material can be nonwoven, paper, a cellulose fiber nonwoven or textile.

A nonwoven material is a structure of fibers of restricted length, endless fibers (filaments) or cut yarns of any kind or any origin, which are somehow joined to a nonwoven (of a fiber layer, of a fibrous web) and somehow connected to each other. Whereas, by textile, a fabric is understood which is made by interlacing or intertwining of yarns as done during weaving, weft-knitting, warp-knitting, braiding, in lace production and in the manufacture of tufted products. Furthermore, foils and papers do not belong to nonwoven materials. Paper is a flat material substantially consisting of fibers of plant origin, which is formed on a sieve by the dewatering of a fibrous material suspension. In this process, a fiber felt emerges, which is subsequently compacted and dried (DIN 6730).

However, material blends consisting of paper and nonwoven, which can be used for the disposable booty 10, also exist.

Such a material blend is, for example, a creped cellulose fiber nonwoven. This is a soft and absorbent paper nonwoven. Cellulose serves as a high-quality raw material in the paper industry. Bleached pulps can meet very high requirements with regard to chemical purity, so that they are suitable for the manufacture of hygiene products. Cellulose fiber nonwoven is finely creped, briefly wet-strengthened, and very absorbent. It can be processed in a single layer or multiple layers. The nonwoven can be cut, punched or embossed. Due to embossing, a larger surface is created, whereby the paper can absorb more moisture. Various cellulose fiber nonwovens placed on top of each other during the processing into tissue papers additionally increase the absorbing capacity and breaking strength. Hygiene products can be provided with an application of balm. High-quality hygiene products such as toilet papers, diapers, sanitary napkins, etc. as well as medical wound bandages are made of cellulose fiber nonwovens.

A nonwoven material made of synthetic and/or natural fibers can be provided as nonwoven material. Synthetic nonwoven materials or blends of natural and synthetic nonwoven materials have an increased elasticity. For ecological reasons, the nonwoven material can virtually exclusively comprise natural fibers, in order to be ecologically degradable. For example, modal fibers or viscose fibers can be used as fibers. Furthermore, natural strands have a better absorption capacity compared to synthetic strands.

Nonwoven materials are largely flexible, textile fabrics, i.e. they are slightly pliable, their main structure elements are textile fibers, and they have a comparably low thickness compared to their length and width. Similarly, nonwoven materials exist, which, due to the fibers used such as non-textile short fibers or due to the solidification methods, rather resemble papers, foils or fiber increased plastics than textiles.

For the use as a flat prefabricated part of a disposable booty 10, a nonwoven material is preferably used, which is designated for use in hospitals and nursing homes. For example, patient quilts are already made of nonwoven material or compresses made of nonwoven material and are widely used.

In addition, at least a first nonwoven material can be embossed or mechanically compressed with at least another nonwoven material. Furthermore, the nonwoven material layers or sheets can be connected to each other by means of the air-laid method. Similar or different nonwoven materials can, at least partly, be glued on top of each other. In addition to the absorbing capacity, this also increases the wet strength of the composite nonwoven.

According to the invention, the nonwoven material can be provided on a roll and/or stack in such a manner that at least two cutting patterns with corresponding prefabricated parts can be processed parallel. For example, the nonwoven material can be supplied on a roll, stack or the like with a width of approx. 240 cm by the nonwoven manufacturer. Due to the parallel processing of a plurality of cutting patterns at the same time, the number of disposable booties 10 manufactured is considerably increased, without increasing the costs.

Furthermore, it is conceivable that paper is used as a flat material for a prefabricated part of one of the parts of the disposable booty 10. For this purpose, paper is particularly suited which has a specific stretch or extensibility, and which furthermore fits gently and softly to the skin of the foot. For example, cellulose wadding is preferred as paper material, which is used in tissue papers such as absorbent paper towels or toilet paper, for example.

The prefabricated parts made of a flat material of the parts 100, 200, 300, 400, 500, 510, 600 and 610 of the disposable booty 10 described in the following text can be provided, according to another embodiment of the present invention, with a label element for esthetic or similar reasons. Advantageously, one or more label elements such as logos or company signs can be embossed and/or imprinted thereon. In particular, this step can be made after the provision step, wherein a plurality of cutting patterns can be processed at the same time.

Figure 8:
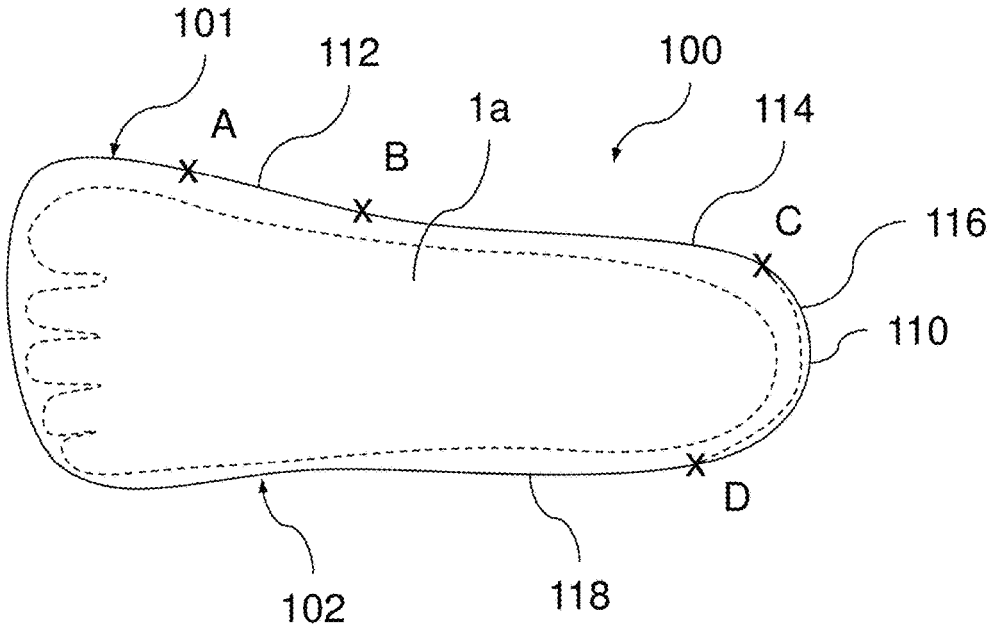
FIG. 8 shows a prefabricated part of a sole part of a disposable booty according to an embodiment of the invention.

FIG. 8 shows a prefabricated part of a sole part 100 from a cutting pattern of a disposable booty 10 according to an embodiment of the invention. As can be seen from FIG. 8, the sole part 100 has a form, which encloses a vertical projection 1*a* of the foot 1 (as shown in FIGS. 1 to 7) in a true-to-shape manner. In the embodiment of the sole part 100 shown in FIG. 8, the prefabricated part of the sole part 100 is adjusted to a left foot. However, for manufacturing reasons and cost reasons, the sole part 100 can be provided both for a left foot and a right foot and correspondingly formed identical for both feet. As already described with reference to FIGS. 2A and 2B, the sole part 100 has a first longitudinal side 101, which corresponds to the inside of the foot when adjusting the disposable booty 10 to a right or left foot. In addition, the sole part 100 has a second longitudinal side 102, which corresponds to the outside of the foot when adjusting the disposable booty 10 to a right/left foot.

The sole part 100 has four sections of the cutting edge 110 of the sole part 100. A first cutting edge section 112 extends from a toe area or front area of the sole part 100 on the first longitudinal side 101 of the sole part 100 to a central area of the sole part 100 on the first longitudinal side 101 of the sole part 100. Hence, as can be seen from FIG. 8, the first cutting edge section 112 extends from the point A to the point B along the cutting edge 110 of the sole part 100. A second cutting edge section 114 extends from the point B on the cutting edge 110 of the sole part 100 in the central area on the first longitudinal side 101 of the sole part 100 to a point C on the cutting edge 110 on the first longitudinal side 101 in the heel area of the sole part 100. A third cutting edge section 116 extends from the point C to the point D, which is located on the second longitudinal side 102 of the sole part 100 in the heel area. A fourth cutting edge section 118 runs from the point D on the cutting edge 100 again to the point A on the cutting edge 110 in a front area or toe area of the sole part 100 on the first longitudinal side 101.

Figure 9:
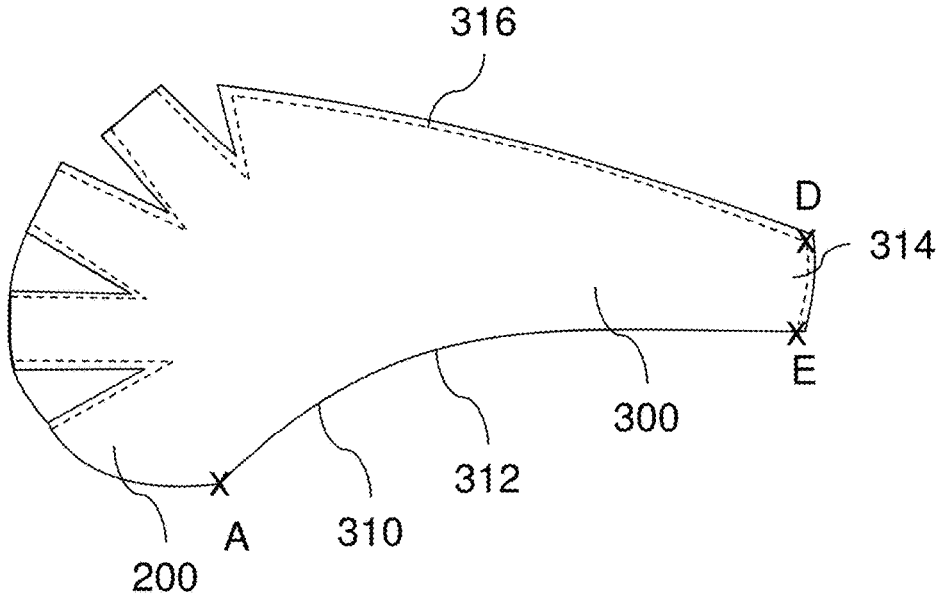
FIG. 9 shows a one-piece prefabricated part of a toe part and of an instep part of a disposable booty according to an embodiment of the invention.

In FIG. 9, a one-piece common prefabricated part of the toe part 200 and of the instep part 300 is shown. The prefabricated part with the toe part 200 and the instep part 300 includes the already described section of the cutting edge 310, which runs diagonally across the back of the foot 1, when the disposable booty 10 is in the state applied to the foot 1. This section is in FIG. 9 the first cutting edge section 312, which runs from a point A on the cutting edge 310 to a point E. A second cutting edge section 314, which runs to a point D on the cutting edge 310, connects to the first cutting edge section 312 at the point E. The third cutting edge section 316 of the one-piece prefabricated part of the toe part 200 and of the instep part 300 extends from a point B to the point A.

Figure 10A:
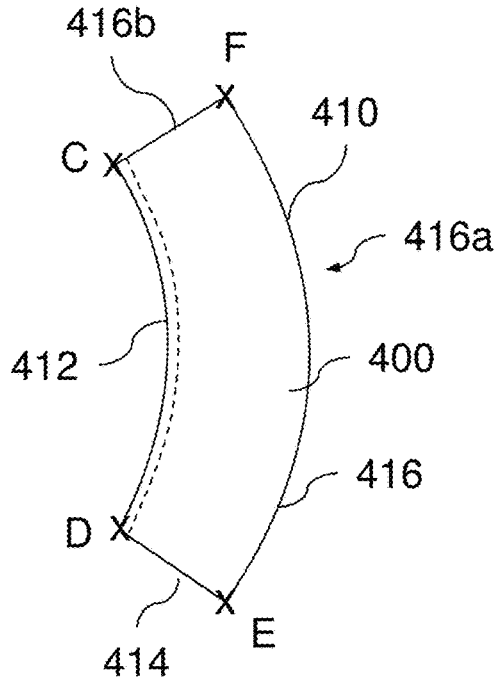
FIG. 10A shows a prefabricated part of a heel part of a disposable booty according to an embodiment of the invention.
Figure 10B:
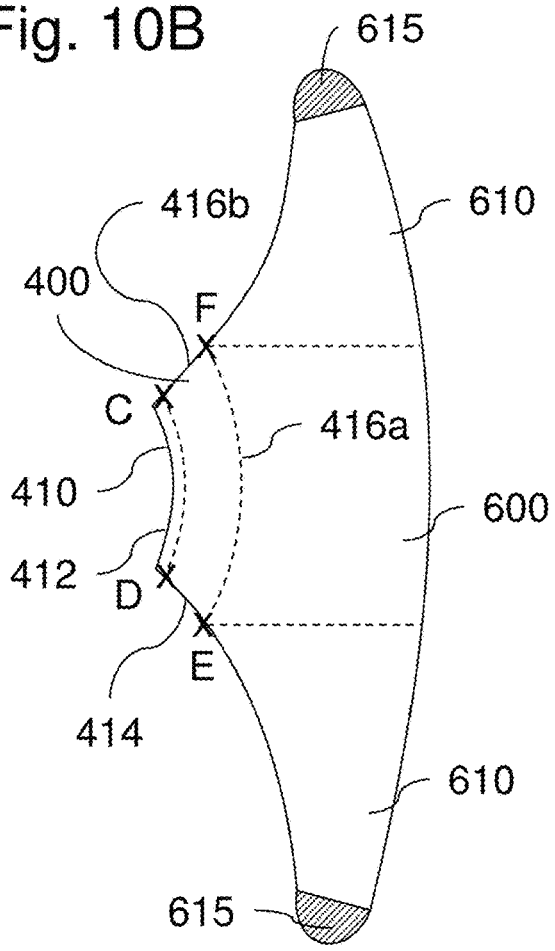
FIG. 10B shows a one-piece prefabricated part of the heel part and of an ankle fastening part of a disposable booty according to an embodiment of the invention.
Figure 10C:
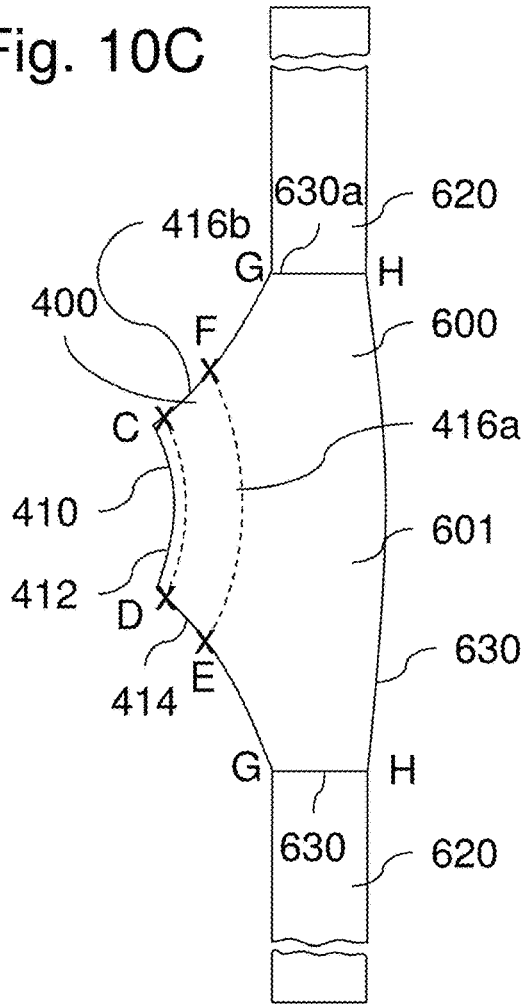
FIG. 10C shows a one-piece prefabricated part of the heel part and of the ankle fastening part of a disposable booty according to another embodiment of the invention.

Various embodiments of prefabricated parts for the heel part 400, the heel part 400 in combination with the ankle fastening part 600 comprising the flap part 610, as well as for the heel part 400 with the ankle fastening part 600 comprising an adhesive tape 620 are shown in FIGS. 10A to 10C.

As shown in FIG. 10A, a prefabricated part for the heel part 400 comprises a cutting edge 410, wherein a first cutting edge section 412 runs from the point C to the point D, a second cutting edge section 414 from the point D to the point E, and a third cutting edge section 416 from the point E to the point C. Optionally, the third cutting edge section 416 can be divided into two sections 416*a* and 416*b*, wherein the section 416*a* runs from the point E to a point F, and the second section 416*b* runs from the point F to the point C on the cutting edge 410 of the heel part 400.

As shown in FIG. 10B, the ankle fastening part 600 with the flap part 610 and the bonding element 615 integrally connects to the heel part 400. The area of the prefabricated part for the heel part 400 and the ankle fastening part 600 includes, as shown in FIG. 10A, the points C, D, E and F on the cutting edge 410, wherein the first cutting edge section 412 of the heel part 400 is provided similarly as in the case of the heel part 400 from FIG. 10A, the second cutting edge section 414 is provided likewise as in the case of the heel part 400 from FIG. 10A, however, the third cutting edge section 416*a* forms a borderline between the integrally formed heel part 400 and the ankle fastening part 600. In this process, the second cutting edge section 416*b* is similarly provided as in the case of the heel part 400 in FIG. 10A.

A one-piece prefabricated part for the heel part 400 and the ankle fastening part 600 to which an adhesive tape 620 is fastened is provided in FIG. 10C. The adhesive tape 620 can be connected to a central part 601 of the ankle fastening part 600 via a cutting edge section 630*a* of the cutting edge 630 between the points G and H of the central part 601 of the ankle fastening part 600 with the adhesive tape 620.

Figure 11A:
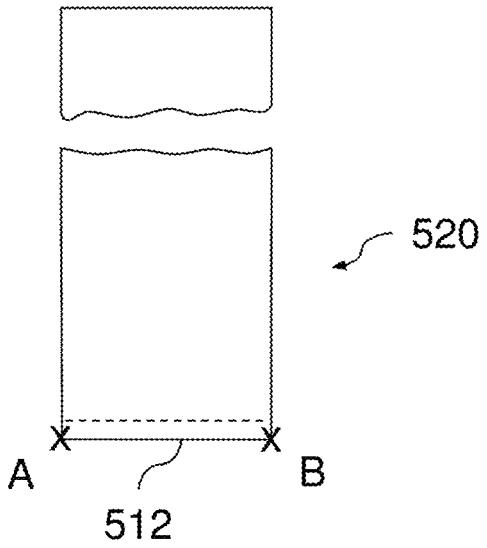
FIG. 11A shows an adhesive tape of the instep fastening part or of the ankle fastening part of a disposable booty according to an embodiment of the invention.

An adhesive tape 520 for use in an instep fastening part 500 is shown in FIG. 11A. The adhesive tape 520 has a cutting edge section 522 at one end of the adhesive tape 520, which runs from the point A to the point B.

Figure 11B:
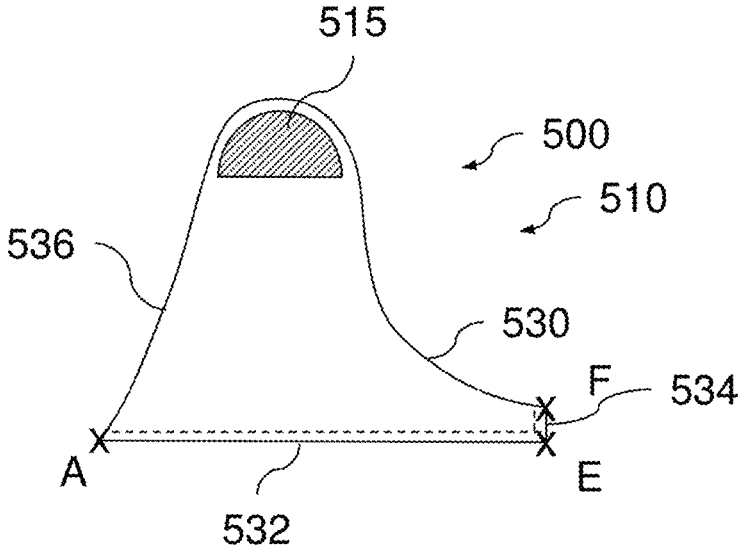
FIG. 11B shows a flap part of an instep fastening part of a disposable booty according to an embodiment of the invention.

A pre-cut part of an instep fastening part 500 with the flap part 510 and the bonding element 515 is shown in FIG. 11B. The instep fastening part 500 has a cutting edge 530, wherein a first cutting edge section 532 runs from a point A to a point E, a second cutting edge section 534 from a point E to a point F, and a third cutting edge section 536 from the point F to the point A again.

As can be seen from the review of FIG. 8 to FIG. 11B and from the embodiments of the disposable booty 10 shown in FIGS. 1 to 7B, the corresponding disposable booties 10 according to FIGS. 1 to 7B can be manufactured by compiling the various prefabricated parts from FIGS. 8 to 11B.

For example, the disposable booty 10 shown in FIG. 1 can be manufactured by combining the prefabricated parts shown in FIGS. 8 to 10A. However, in this process it is also conceivable that the prefabricated part shown in FIG. 9 and in FIG. 10A is formed as a one-piece prefabricated part, wherein the third cutting edge section 416 of the heel part 400 can run, without a corner point F, from the point E to the point C, in order to create a flat transition of the heel part 400 into the point C in the sole part 100. For the manufacture of the disposable booty 10 according to FIG. 1, the one-piece prefabricated part shown in FIG. 9 for the instep part 300 and the toe part 200 is connected from the point D (both the cutting edge 310 of the instep part 300 and of the cutting edge 110 of the sole part 100) beginning along the third cutting edge section 316 of the instep part 300 and along the fourth cutting edge section 118 of the cutting edge 110 of the sole part 100. In this process, the heel part 200 is brought into a true-to-shape form for the toe area through darts. The first cutting edge section 312 of the cutting edge 310 of the instep part 300 runs freely diagonally across the back of the foot or above the sole part 100 from the toe part 200 on the first longitudinal side 101 of the sole part 100 to the point D, i.e. to the heel part 400 on the second longitudinal side 102 of the sole part 100. Furthermore, for a connection between the instep part 300 and the heel part 400, the second cutting edge section 314 of the instep part 300 can be connected to the second cutting edge section 414 of the heel part 400.

A connection of the corresponding cutting edge sections can be effected by gluing, sewing, bonding or welding such as ultrasonic welding or laser welding, for example, or a combination of these methods. Thus, at least two of the parts of the disposable booty 10 are advantageously connected to each other by gluing, sewing, bonding or welding. When the cutting edge sections of the various parts are connected, preferably welding and/or gluing and/or bonding are used in the case of the use of a nonwoven material. The selection of the method can vary dependent on the nonwoven material used. Apart from sewing in, welding is preferred for synthetic nonwoven materials, while gluing and/or bonding are preferred for natural nonwoven materials. In particular, the adhesive can be applied selectively and connected to the mutual cutting edge section with a certain overlap. This overlap is also necessary for a bonding method.

In the case of the disposable booty 10 shown in FIGS. 2A and 2B, the sole part 100 from FIG. 8, the instep part 300 and the toe part 200 from FIG. 9, the prefabricated part of the heel part 400 from FIG. 10A, as well as the prefabricated part of the instep fastening part 500 from FIG. 11B are used for the cutting pattern of the disposable booty 10. In this process, the corresponding cutting edge sections are connected, which each run between points on the respective cutting edges with identical reference numerals, i.e. between the points A, B, C, D, E and F.

For the manufacture of the disposable booty 10 according to FIGS. 3A and 3B, the prefabricated part of the sole part 100 from FIG. 8, the one-piece prefabricated part of the instep part 300 and of the toe part 200 from FIG. 9, the prefabricated part of the heel part 400 from FIG. 10A, as well as the prefabricated part of the adhesive tape 520 from FIG. 11A can, according to an embodiment of the invention, be used, wherein, in turn, corresponding cutting edge sections, which run between common points A, B, C, D, E and F, are connected to each other.

The disposable booty 10 shown in FIGS. 4A and 4B can, according to an embodiment, be manufactured from the prefabricated part of the sole part 100 from FIG. 8, the one-piece prefabricated part of the instep part 300 and of the toe part 200 from FIG. 9, the one-piece prefabricated part of the heel part 400 and of the ankle fastening part 600 from FIG. 10B, as well as the prefabricated part of the instep fastening part 500 from FIG. 11B, wherein, in turn, corresponding cutting edge sections, which extend between the points A, B, C, D, E and F, are each connected to each other.

The disposable booty 10 shown in FIGS. 5A and 5B can, according to an embodiment of the invention, be manufactured from the prefabricated part of the sole part 100 from FIG. 8, the one-piece prefabricated part of the instep part 300 and of the toe part 200 from FIG. 9, and the one-piece prefabricated part of the heel part 400 and of the ankle fastening part 600 from FIG. 10C, as well as the prefabricated part of the instep fastening part 500 from FIG. 11B, wherein, in turn, corresponding cutting edge sections, which extend between the points A, B, C, D, E and F, are each connected to each other.

The disposable booty 10 shown in FIGS. 6A and 6B can, according to an embodiment of the invention, be manufactured from the prefabricated part of the sole part 100 from FIG. 8, the one-piece prefabricated part of the instep part 300 and of the toe part 200 from FIG. 9, the one-piece prefabricated part of the heel part 400 and of the ankle fastening part 600 from FIG. 10B, and the prefabricated part of the adhesive tape 520 from FIG. 11A, wherein corresponding cutting edge sections, which extend between the points A, B, C, D, E and F, are each connected to each other.

Figure 12:
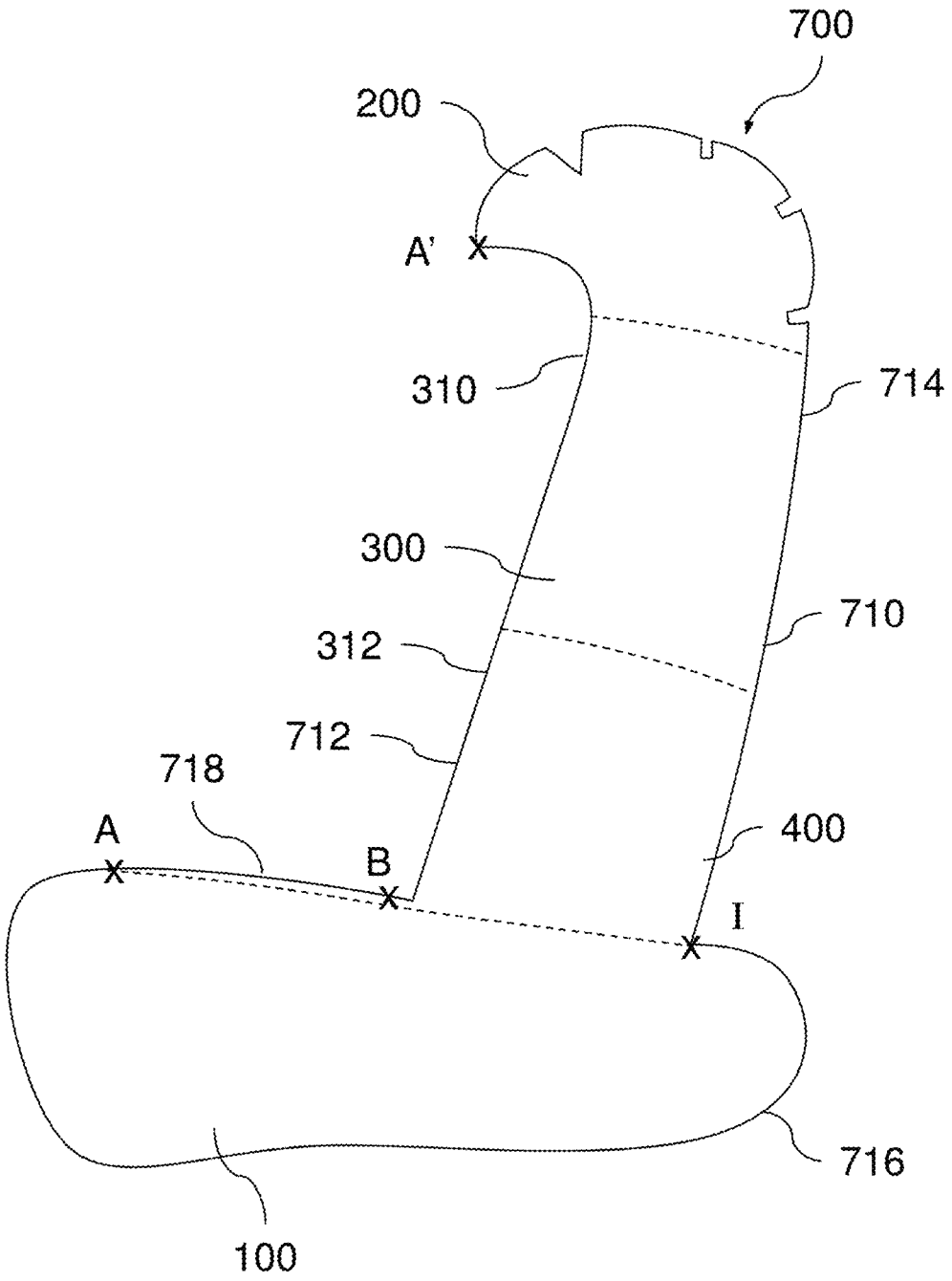
FIG. 12 shows a one-piece prefabricated part of the sole part, of the heel part, of the instep part and of the heel part of a disposable booty according to an embodiment of the invention.

According to another embodiment of the invention, as shown in FIG. 12, the sole part 100, the heel part 400, the instep part 300, and the toe part 200 can also be formed as a one-piece cutting pattern. The one-piece prefabricated part 700 of the sole part 100, of the toe part 200, of the instep part 300 and of the heel part 400 shown in FIG. 12 has a cutting edge 710. The cutting edge 710 has a first cutting edge section 712, which extends from a point B to a point A' on the cutting edge 710. The first cutting edge section 712 forms the section of a cutting edge 310 of the instep part 300 already described above, which runs, when the disposable booty 10 is donned, from a toe area diagonally across the back of the foot to an ankle area of the foot. The prefabricated part 700 further has a second cutting edge section 714, which extends from the point A' to a point I on the cutting edge 710. The point I of the single-piece prefabricated part 700 is located in an area of the sole part 100, which roughly corresponds to the point C from FIG. 8 of the prefabricated part of the sole part 100. A third cutting edge section 716 extends from the point I to the point A. A fourth cutting edge section 718 extends from the point A to the point B. For the manufacture of the disposable booty 10 from a prefabricated part 700 according to FIG. 12, the two points A and A' are connected to each other, wherein the second and third cutting edge sections 714 and 716 are, starting from the point I, each connected to each other up to the points A, A'. In this process, the connection line between the points B and I can form a folding line.

Figure 13:
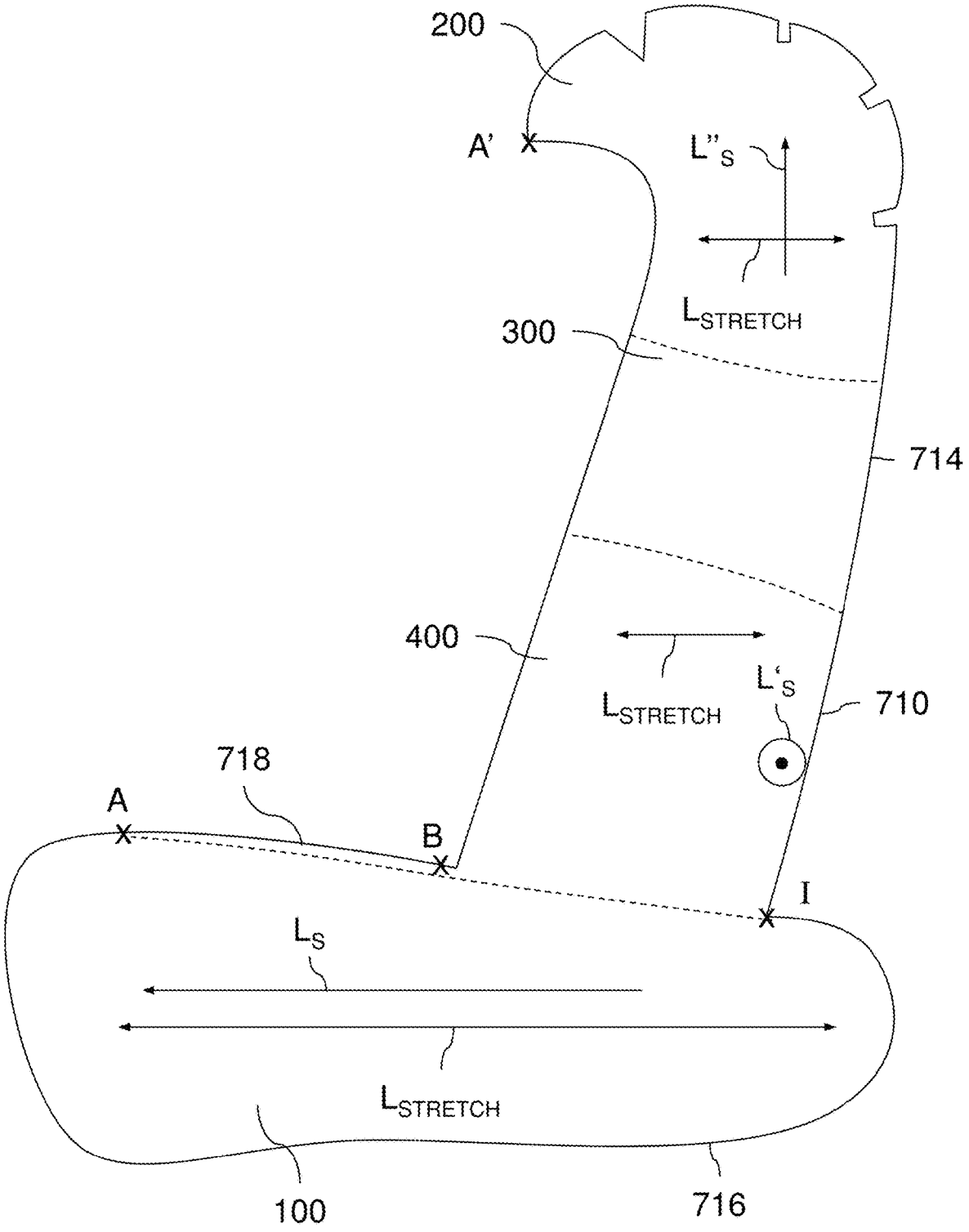
FIG. 13 shows the one-piece prefabricated part from FIG. 12 with the additional statement of a preferred direction of a flat prefabricated part in relation to the longitudinal direction of a foot in the case of a disposable booty made from the one-piece prefabricated part according to an embodiment of the invention.

FIG. 13 shows the one-piece prefabricated part 700 of the sole part 100, of the toe part 200, of the instep part 300 and of the heel part 400 according to another embodiment of the invention. As can be seen from FIG. 13, the flat prefabricated or cut-out part 700 can have a preferred direction Lstretch, in which the flat prefabricated or cut-out part 700 is more stretchable or more extensible than in other directions along the plane of the prefabricated or cut-out part 700 or along the cutting plane. By cutting plane a plane is to be understood, which is parallel to the surface of the flat material prior to connecting the corresponding cutting edge sections. Hence, the cutting plane is a plane, which is parallel to the sheet level of a corresponding cutting pattern. In this process, the flat prefabricated or cut-out part 700 preferably has one preferred direction only, therefore, the prefabricated or cut-out part of the flat material, such as a flat nonwoven material, for example, is formed from a so-called unistretch material. However, it is also possible to use a flat prefabricated or cut-out part with two preferred directions, wherein a so-called bistretch material is used for this purpose. In the case of a stretch material, perlon or nylon fibers can be processed in the nonwoven material, in order to create a stretch or stretchability along a preferred direction in the nonwoven material. Furthermore, also elastomers can be inserted into the nonwoven material, such as spandex or elastane, for example, to give the flat material a certain elasticity.

In the case of nonwoven, paper or textile, in addition to the stretch, the extensibility of the material is important. The extensibility describes to which extent a material gets into its original form again following an elongation. The German term "Dehnbarkeit" is to correspond here to the English term "stretch", while the German term "Rückstellfähigkeit" is to correspond to the English term "extensibility". In this process, a material is interesting if it is stretchable and partly has a good extensibility. For the use of a disposable product, full extensibility, i.e. a perfectly elastic behavior, is not necessary.

Hence, the material need not completely go back to its original form following an elongation but can remain in a stretched form following initial contracting. Thus, the extensibility can be less than 100%, wherein an extensibility of 100% corresponds to a perfectly elastic behavior. According to the invention, an extensibility of 100% to 30%, or from 100% to 50%, or from 100% to 70% is preferred. Stretch corresponds to the ability to withstand an elongation without any destruction such as tearing. The higher the stretch, the more the material can be stretched on a percentage basis. A well-known manufacturer of stretchable or extensible nonwoven materials is the company Micrex, for example.

When using a flat material which only has one preferred direction Lstretch, it is advantageous when, in the case of the sole part 100, the preferred direction Lstretch is parallel to the longitudinal direction Ls of the foot 1. Thus, a sole part 100, which has been manufactured for one size, can adjust to a slightly greater foot length of a foot 1 in the longitudinal direction Ls, in order to bridge between different sizes. Furthermore, it is advantageous if, in the case of the heel part 400, the preferred direction Lstretch is diagonal to the normal of the sole part 100. By a normal of the sole part 100, a normal of the plane of the sole part 100 is to be understood. This means that if the sole part 100 or the prefabricated or cut-out part of the sole part 100 is in a horizontal plane, the normal of the sole part 100 coincides with a vertical direction. In the embodiments of the heel part 400 shown in FIGS. 10A to 10C, the preferred direction Lstretch can be provided in such a manner that it, in the case of a completed disposable booty 10, i.e. after connecting the corresponding cutting edge sections, the preferred direction Lstretch is parallel to the sole plane and vertical to the longitudinal direction Ls of the foot 1.

Furthermore, according to an advantageous embodiment of the invention, the preferred direction Lstretch in the case of the toe part 200 can be diagonal or substantially orthogonal to the longitudinal direction Ls of the foot 1. In this process, the prefabricated or cut-out part, as shown in FIG. 9, for example, of the toe part 200 can be arranged relative to the preferred direction Lstretch of the flat material, which is made of nonwoven, for example, in such a manner that it, after connecting the corresponding cutting edge sections with the sole part 100, has a preferred direction, which is diagonal or substantially orthogonal to the longitudinal direction Ls of the foot 1.

According to a particularly preferred embodiment of the invention, a corresponding change of the preferred direction Lstretch is already achieved within the disposable booty 10 after connecting the corresponding cutting edge sections by a one-piece prefabricated or cut-out part 700, which comprises the sole part 100, the toe part 200, the instep part 300 and the heel part 400. As can be seen from FIG. 13, the one-piece prefabricated or cut-out part 700 is provided for the purpose that a flat prefabricated or cut-out part of the material according to the prefabricated or cut-out part 700 shown in FIG. 13 is separated or punched from this material. Thus, the preferred direction Lstretch is in all parts 100, 200, 300 and 400 parallel to each other if the prefabricated or cut-out part 700 is flat on a horizontal plane.

By connecting the second cutting edge section 714 and the third cutting edge section 716 starting from the point I to the points A, A', the preferred direction Lstretch is gradually rotated in the space, as illustrated by the differently plotted longitudinal directions L's in the heel part 400 and L"s in the toe part 200. For instance, in the heel part 400, the preferred direction Lstretch is, in the case of a completed disposable booty 10, diagonal in a plane, which is vertical to the longitudinal direction L's of the foot 1. Thus, an extension in the heel area of the foot 1 is possible in an area between the first longitudinal side 101 and of the second longitudinal side 102 of the sole part 100. For the completed disposable booty 10, the preferred direction Lstretch in the toe part 200 is furthermore vertical to the longitudinal direction L"s of the foot 1 and substantially parallel to the plane of the sole part 100. Thus, an extension of the toe part 200 vertical to the longitudinal direction Ls of the sole part 100 is possible. Hence, due to the specific embodiment of the prefabricated or cut-out part 700 of FIG. 13, it can be achieved that the disposable booty 10 or the sock 10, in particular, the disposable sock 10, is stretchable or extensible in the longitudinal direction in the sole area, is stretchable or extensible in the horizontal direction in the heel area, and is also stretchable or extensible horizontally and vertically to the longitudinal direction of the sole part 100 in the toe area.

According to another embodiment of the invention, at least one part 100, 200, 300, 400, 500, 510, 600 and 610 of the disposable booty 10 or of the booty has a skincare or medically active substance embedded therein. This active substance can include micro beads, for example. The micro beads can be introduced into the nonwoven material. In detail, resin beads and/or gelatin beads can be used as micro beads. A microencapsulation allows to surround solids and liquids with a casing. These micro beads can have a diameter of up to 800 μm. Appropriate capsule walls can be natural and synthetic polymers. Resin beads are preferably used due to their mechanical stability, higher temperature resistance, harder wall and their easy application to nonwoven.

Gelatin beads are particularly suitable due to low dermatological risks, a low production temperature required and only a low use of bonding agents required for their fixation. Different micro beads can be used for a continuous release of the stored substances over a longer period.

The micro beads can include skincare substances and/or fragrance substances as ingredients. In this process, each micro bead can be filled with different ingredients. Similarly, a micro bead can comprise different ingredients. For example, natural oils and fats can be used, such as jojoba oil, aloe vera, olive oil, avocado oil, shea butter, stearic acid, panthenol, vitamin E, glycerin and the like. Furthermore, antibacterial substances such as farnesol, polyaminopropyl biguanide, isopropyl alcohol or Clotrimazole, can be used. Oak bark, sage, chlorophyll (didecyldimonium chloride), tannic acid or *Hamamelis virginiana* can be used for the inhibition of moisture, while urea (carbamide) or lipid-containing ingredients can have the opposite effect. In addition, all natural fragrances, in particular, menthol and lavender oil, can be used. Tea tree oil or undecylenamide DEA (diethanolamine) can be used as odor-inhibiting substances.

However, the skincare or medically active substance can also be an oily active substance such as talcum, for example.

According to a method for manufacturing a disposable booty 10, the nonwoven material or the flat material can be provided on a roll and/or stack, wherein parts of the disposable booty 10 can be separated from the flat material according to a given cutting pattern, as described with reference to FIGS. 8 to 13. The parts of the disposable booty 10 can be separated from the flat material by cutting or punching. After separating the parts of the disposable booty from the flat material, the parts are connected in accordance with predefined connecting areas of the parts of the disposable booty 10, wherein the connecting areas are the aforedescribed corresponding cutting edge sections, which run between identical points A to F of the corresponding prefabricated or cut-out parts of the corresponding parts 100, 200, 300, 400, 500, 510, 600, 610. Hence, according to the invention, a method for manufacturing a disposable booty 10 is provided, comprising the following steps. First of all, a roll or a stack of a flat material is provided. Thereafter, the parts, selected from the parts 100, 200, 300, 400, 500, 510, 600, 610 of the disposable booty 10, are separated from the flat material in accordance with a given cutting pattern. Finally, the parts are connected, in accordance with predefined connecting areas, to the parts of the disposable booty 10. In this process, the heel part 400 is particularly preferably connected to the sole part 100 in such a manner that it is vertical to the sole part 100. Hence, a connecting edge is formed between the heel part 400 and the sole part 100, which has an angle in the range between 60 degrees and 120 degrees, or in the range between 70 degrees and 110 degrees, or in the range between 80 degrees and 100 degrees, or in the range between 85 degrees and 95 degrees between the heel part 400 and the sole part 100.

In the case of a higher proportion of plastic fibers or synthetic fibers such as polyester or polypropylene, the nonwoven material can also be welded. Additionally, the thermal molding method also exists in the textile industry. This method generates 3D objects, and the booty 10 can also be manufactured with this method. This, however, requires specific material properties such as a high proportion of synthetics. In the case that good compostability of the product after use is desired, which requires a lower proportion of plastic fibers, it is also preferred to use other connecting methods such as sewing or gluing.

Hence, according to the invention, a disposable booty 10 is provided, which consists of a nonwoven material, for example, wherein a cutting pattern from a one-piece prefabricated or cut-out part or a multi-piece prefabricated or cut-out part can be used. For example, a company logo can already be woven into the nonwoven material. In the case of a stretch or extensibility of the nonwoven material in a stretch direction, the disposable booty 10 or the sock, in particular, the disposable sock 10, is advantageously configured in such a manner that it is stretchable in the longitudinal direction in the sole area, is stretchable in a circumferential direction between the ankles of the foot in the heel area, and is stretchable or extensible vertical to the longitudinal direction of the foot in a toe area and in the circumferential direction of the back of the foot. Thus, an optimum adjustment of the disposable booty 10 to the foot can be conducted with a stretchable material. The stretch directions of the disposable booty 10 can be changed by sewing together or connecting different prefabricated or cut-out parts; it is, however, also possible to use a specifically shaped one-piece prefabricated or cut-out part, where the stretch direction rotates accordingly when integrating the disposable booty 10. Furthermore, an optimum adjustment of the disposable booty 10 to the foot 1 can be achieved by using an adhesive tape for the fastening of the disposable booty 10. In this process, an adhesive tape 520 provided as the fastening part, which is fastened to the sole part 100, is simply wrapped around the back of the foot and thus fastens the disposable booty 10. Furthermore, an adhesive tape 620 can also be used to fasten the disposable booty 10 at the ankle.

Additional embodiments of a disposable booty 10 are shown in FIGS. 14 to 17B, which and/or the features of which can be combined with the embodiments described herein and/or their features, whereby new embodiments emerge.

Figure 14:
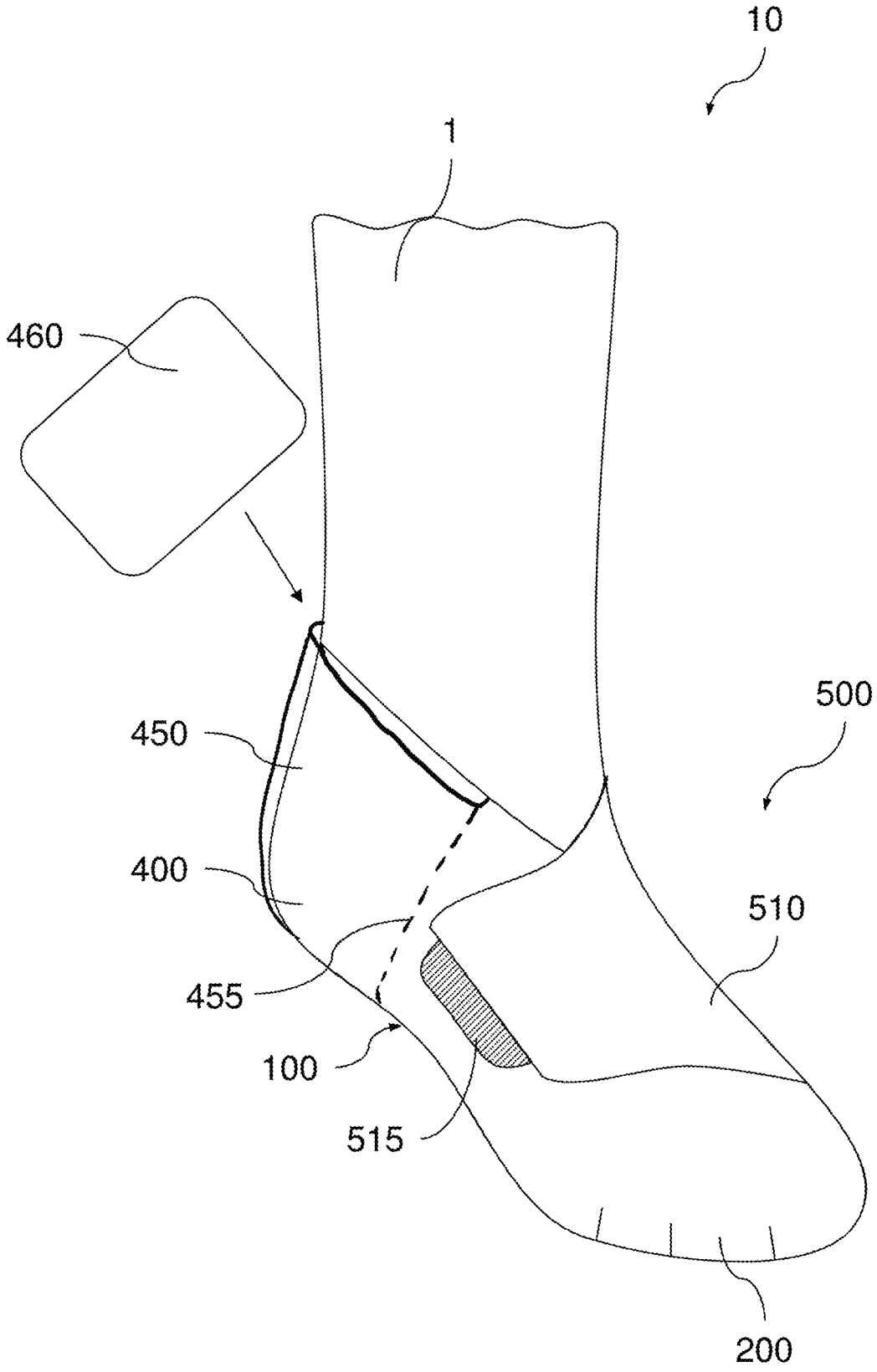
FIG. 14 shows a schematic perspective view of a disposable booty according to another embodiment of the invention in a fastened state.

FIG. 14 shows a schematic perspective view of a disposable booty 10 according to another embodiment of the invention in a fastened state. As can be seen from FIG. 14, the disposable booty 10 or the sock 10, in particular, the disposable sock 10, further comprises, in addition to the sole part 100, the toe part 200 and the instep part 300, the heel part 400, which is adapted, when the disposable booty 10 is donned, to cover the heel of the foot 1. Furthermore, the disposable booty 10 or the sock 10, in particular, the disposable sock 10, has a receiving part 450, which is adapted to receive an insert 460 (see the arrow in FIG. 14). Advantageously, the receiving part 450 is adapted, when the disposable booty 10 is donned, to run from the back of the foot 1 around the heel of the foot 1 and, at least partly, underneath the ball of the foot 1. For instance, the insert 460 can be inserted into the receiving part 450, in order to thereby enclose a rear part of the foot 1, in particular. The receiving part 450 can, in particular, be limited on the sides of the foot 1 by a boundary 455. The boundary can, in particular, be a connection between the receiving part 450 and the instep part 300. For example, the receiving part 450 and the instep part 300 are sewn together or welded at the boundary 455. Therefore, the boundary 455 can be a seam or a welding seam.

For example, the insert 460 can include or be a silicon pad, a gel pad, a cushion, a sponge, a foam cushion or a cotton pad, which is, in particular, adapted to cover, at least partly, the back of the foot 1, the ankle of the foot 1 and/or the sides of the foot 1.

Furthermore, inserts 460 are conceivable, which are adapted to support the foot or the ankle of the foot and thus increase the stability of the foot 1 through supporting measures. This is all the more effective, the further the insert 450 reaches, along the ankle of the foot 1, upwards. In addition, inserts 460 are conceivable, which are adapted to act as a kind of insole and support the foot 1 from the sole.

In order to minimize a friction on the skin, a surface area or surface areas of the disposable booty 10, which are adapted, when the disposable booty is donned, to contact the foot 1, can include a friction-reducing material. In addition to the mechanical and/or geometrical properties of the disposable booty according to the invention, such as elasticity and tensile strength, also a felt haptic "softness" (i.e. a processing without edges, which, in particular, is smooth, clean, etc.) is advantageous for the wearer and/or the foot.

The risk that friction has a negative effect on the skin (i.e. causes superficial skin abrasion or tissue deformations, for example) is, additionally to the impact by the material, increased by continued pressure. Increased pressure always occurs on locations where a small surface carries a relatively high weight, as, for example, at the heel of the foot, in particular, in low mobility patients. Similarly, the duration of the pressure plays a role. Therefore, the disposable booty 10 according to the invention includes the receiving part 450, into which a pressure-reducing insert 460, in particular, can be inserted.

The friction from skin to disposable booty can, for example, be reduced as follows: by using a material from preferably "manufactured man-made fibers", as they, amongst others, are distributed under the product name Parafricta. The "manufactured man-made fibers" have a low friction in mechanical processes, in order to prevent skin irritation, which, in turn, can lead from minor abrasions or redness to serious consecutive symptoms such as decubitus (due to bedsores) and thus are associated with significant costs for the healthcare industry; by using an impregnated material, which, for example, is impregnated by means of a formula directly worked into the material; and/or by using a formula applied onto the material which creates a lubrication effect between the skin and the disposable booty 10.

To create a lubrication effect between the skin of the foot 1 and the disposable booty 10, a textile strip (not shown) can further be provided which includes a lotion. The textile strip can, in particular, be adapted to cover, at least partly, the back of the foot 1, the ankle of the foot 1 and/or the sides of the foot 1.

In addition to the reduction of skin irritations (for example, through a lubrication effect), the disposable booty 10 or the sock 10, in particular, the disposable sock 10, can further include an active substance applied to the disposable booty 10, which acts as friction-reducing, odor-inhibiting, antibacterial, bacteriostatic, fungistatic, antiviral, hemostatic and/or pain-relieving. The active substance can also be applied onto the insert 460.

In addition, also moisture has a negative effect on the skin, created, for example, by incontinence or sweat. Moisture increases the friction factor between a material and the skin by a factor of approximately two. Therefore, the disposable booty 10 or the sock 10, in particular, the disposable sock 10, can also have moisture-absorbent properties, such as being made of a moisture-absorbent material and/or including a moisture-absorbent material, for example.

Figure 15:
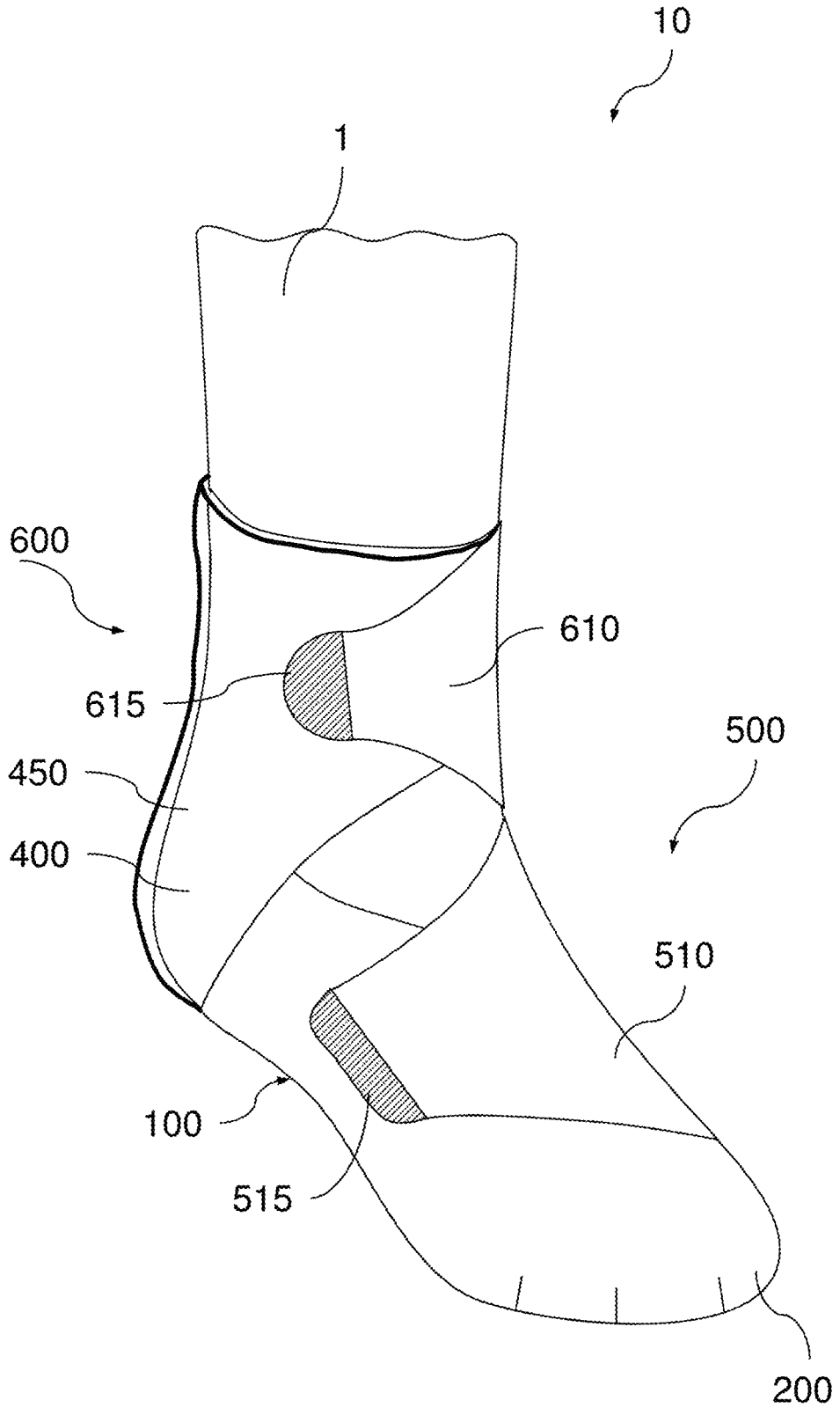
FIG. 15 shows a schematic perspective view of a disposable booty according to another embodiment of the invention in a fastened state.

As described herein, the embodiments and/or their features can be combined with each other, whereby new embodiments emerge. FIG. 14 shows the embodiment according to FIGS. 2A and 2B, however, the receiving part 450 can consequently be provided on every embodiment described herein. FIG. 15 shows the embodiment according to Figures FIGS. 4A and 4*b* with a receiving part 450, wherein, in particular, the advantages described herein are achieved.

Figure 16:
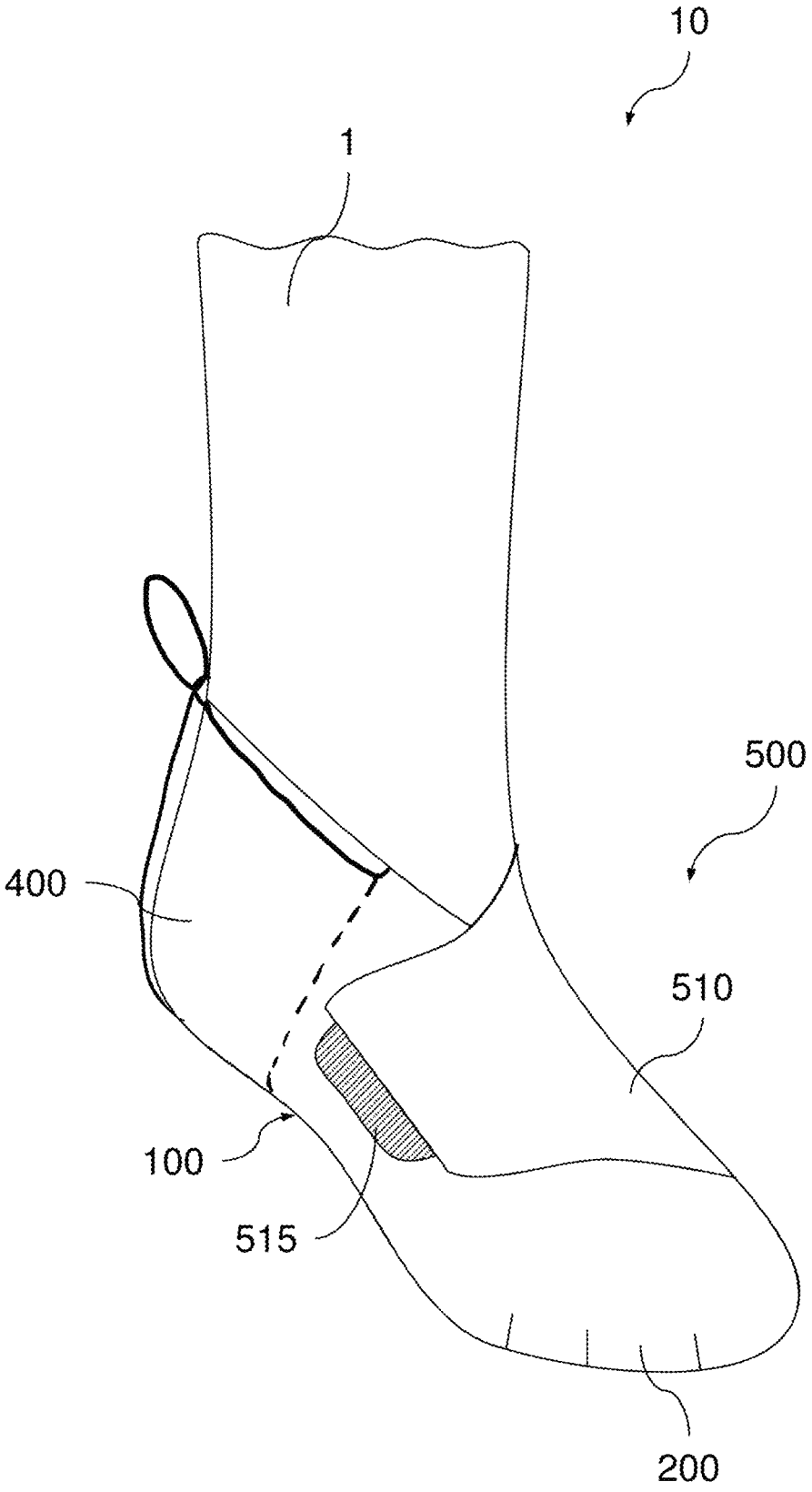
FIG. 16 shows a schematic perspective view of a disposable booty according to another embodiment of the invention in a fastened state.

FIG. 16 shows a schematic perspective view of a disposable booty 10 according to another embodiment of the invention in a fastened state. As can be seen from FIG. 14, the disposable booty 10 or the sock 10, in particular, the disposable sock 10, can have a donning aid 470, which is fastened to the heel part 400. The donning aid 470 can be adapted to facilitate putting on and/or taking off the disposable booty 10. For example, the donning aid 470 can facilitate the putting on and/or taking off of the disposable booty 10 in that one can grab the disposable booty 10 at the donning aid, in order to pull the heel part 400 over the heel and/or off the heel. For example, the donning aid, in a particularly simple and cost-efficient embodiment, can include a flap, an eyelet or a cloth extending away from the heel part 400. The embodiment according to FIG. 15 includes, in particular, the ankle fastening part 600. Advantageously, the receiving part 450 can extend from the heel part 400 to the ankle fastening part 600, in order to be thus able to receive a greater insert 460. A greater part of the foot 1 can thereby be protected and/or supported.

Furthermore, the disposable booty 10 or the sock 10, in particular, the disposable sock 10, can have a coating, for example, with silicon, at its inside, i.e. the side of the disposable booty 10 which is in contact with the skin in the area of the heel, in particular, in the direction of the ankle, in order to prevent that the disposable booty 10 or the sock 10, in particular, the disposable sock 10 slips over the heel after application. In addition, a coating with silicon on the inside of the disposable booty 10 can also exist selectively or extensively in other areas, in order to prevent shifting or twisting of the disposable booty 10 on the foot. Therefore, a slip-resistant coating can be applied onto the inside of the disposable booty 10, such as a basic material with a silicon coating, for example, which prevents the sock or the disposable booty 10 from unintentionally rotating within itself during the night, for example.

Figure 17A:
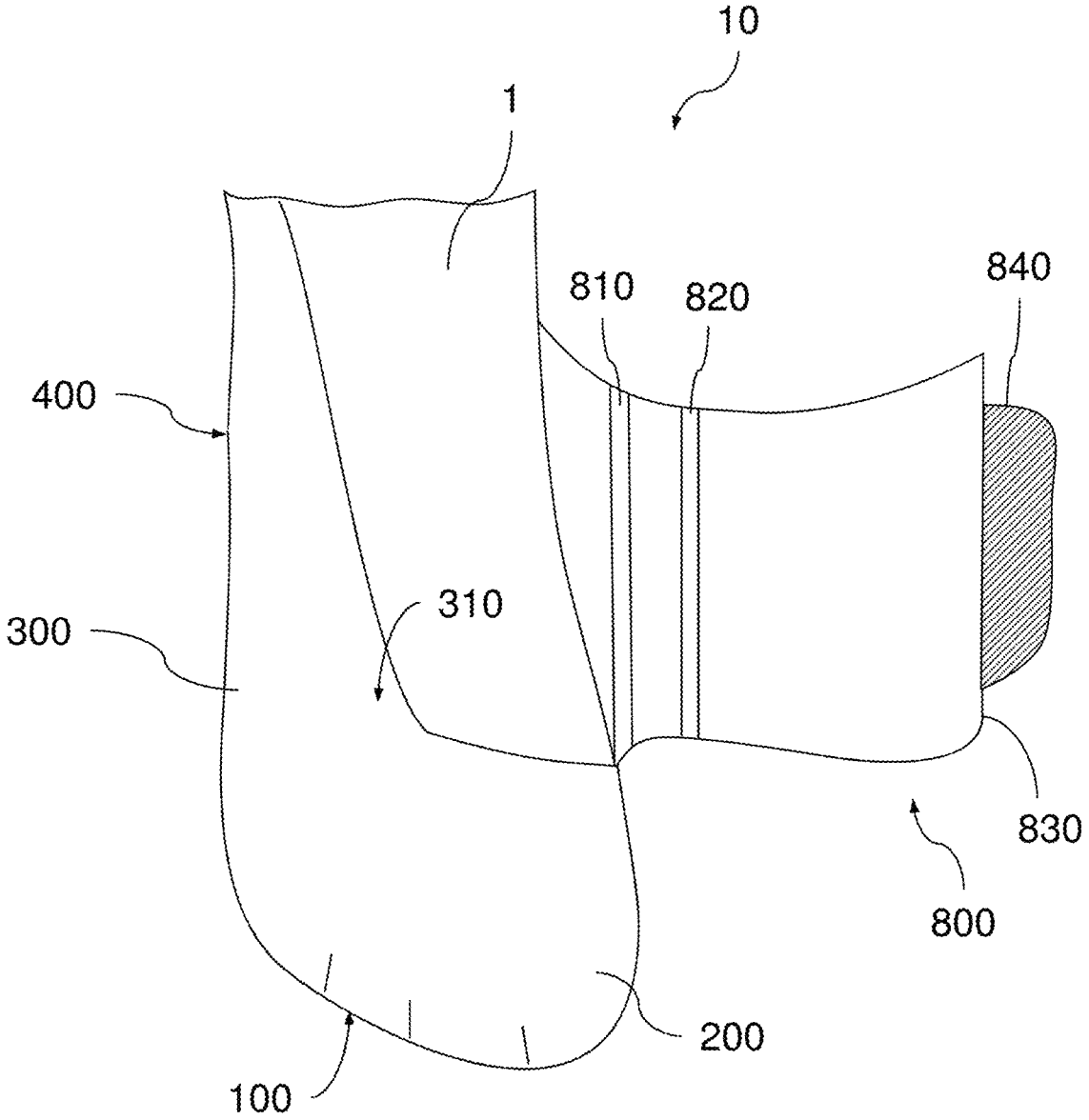
FIGS. 17A and 17B show schematic perspective views of a disposable booty according to another embodiment of the invention in a fastened state.
Figure 17B:
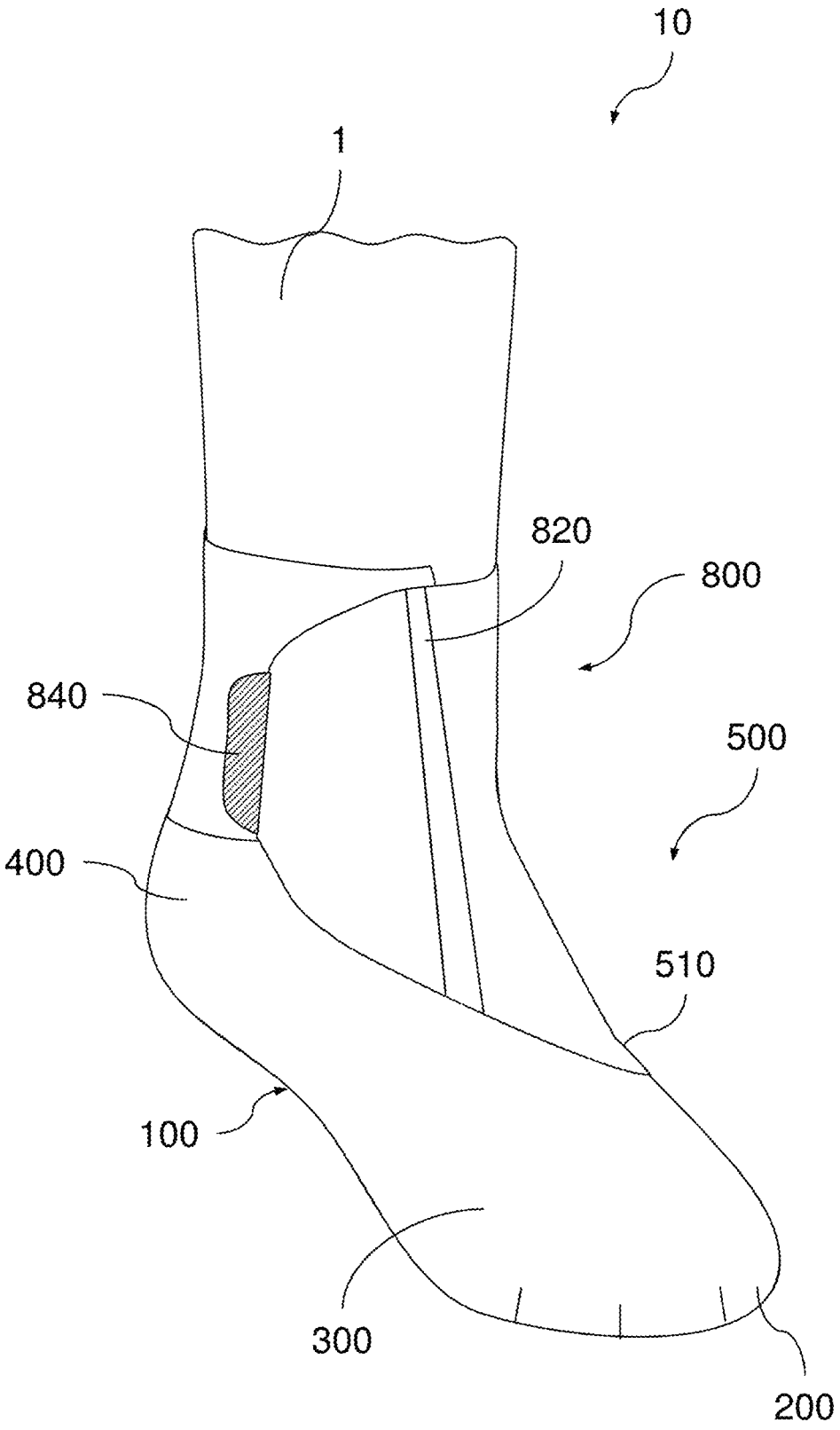

FIGS. 17A and 17B show schematic perspective views of a disposable booty 10 according to another embodiment of the invention. The disposable booty 10 shown in FIGS. 17A and 17B substantially differs from the disposable booty 10 shown in FIGS. 2A and 2B in that a rear fastening part 800 is provided, which includes an elastic material 810, 820 on the inside of the foot, wherein at one end 830 of the rear fastening part 800 an adhesive element 840 can be provided, which enables an adjustment above the instep of the foot 1 and in the direction of the heel of the foot 1. The elastic material 810, 820 can, in particular, be provided by means of sewing, welding or gluing to the rear fastening part 800. In particular, the rear fastening part 800 can be fastened rearward in the direction of the ankle of the foot.

The elastic material 810, 820 can be made of the same material, in particular, nonwoven, as the material of the disposable booty 10, in particular, the rear fastening part 800 or a separate nonwoven or woven material, which has elastic and high tensile properties. Due to the elastic material 810, 820, a tensile stress can be built up, which enables custom-fit application and fastening of the disposable booty 10.

The adhesive element 840 can include a high tensile Velcro, an adhesive or a tacky material, so that it can connect to the material located below it. A fastener, for example, similar to those for diapers, would be possible which enables repeated adjustment up to optimum fit. In particular, the adhesive element 840 can be made of the same material as the bonding element 515, 615 and/or have the same properties as the bonding element 515.

Such a formed disposable booty 10 can, in particular, be advantageous for persons who are still mobile and/or independent. These persons do not require assistance with putting on/taking off, but nevertheless consider a hygiene product to be advantageous for their foot condition (infection, allergy, open wounds, mycosis pedis, etc.). The disposable booty 10 enables that traditional socks as well as shoes can be pulled over. This embodiment can be advantageous, even without a receiving part.

In addition, the disposable booty 10 according to the invention can be selectively or extensively coated with a slip-resistant material, such as silicon, on the side of the sole of the foot 1, i.e. the side facing the floor. This enables that the user does not slip on smooth floors, but nevertheless the ability to slip into shoes is still possible.

Embodiments of the disposable booty according to the invention can have the following advantages: bacteriostatic, fungistatic, antiviral, non-toxic, highly absorbent, non-allergenic, breathable, hemostatic and/or biocompatible.

Figure 18:
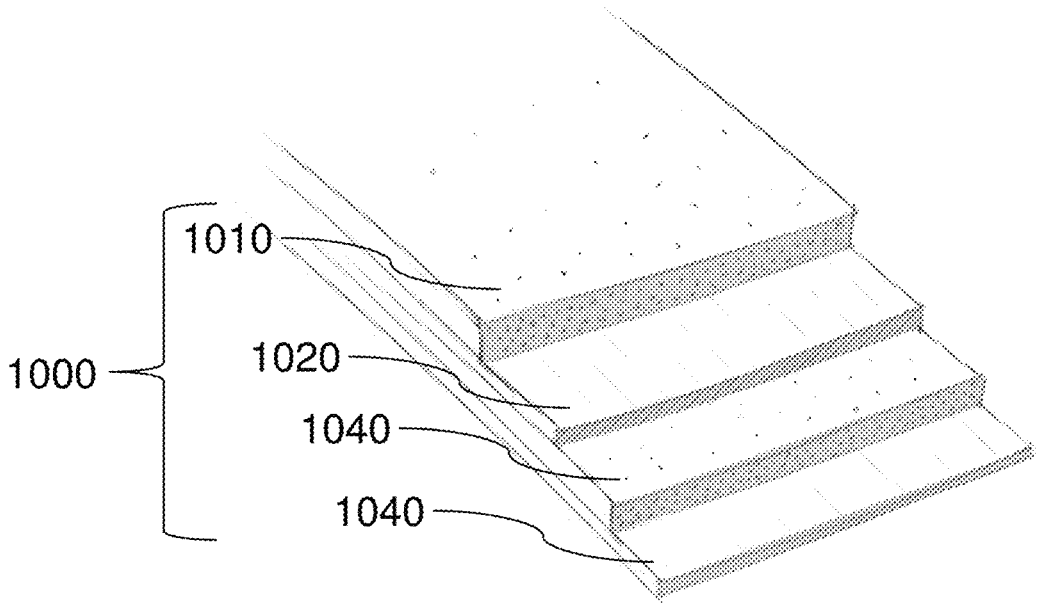
FIG. 18 shows a schematic perspective view of a multilayer material of a disposable booty according to an embodiment of the invention.

As shown in FIG. 18, at least a first nonwoven material can be embossed or mechanically compressed with at least another nonwoven material in embodiments. Furthermore, the nonwoven material layers or sheets can be connected to each other by means of the air-laid method. Similar or different nonwoven materials can, at least partly, be glued on top of each other. In addition to the absorbing capacity, this also increases the wet strength of the composite nonwoven.

According to embodiments, a material 1000 or multi-layer material 1000 can be provided. The multi-layer material 1000 can have layers of nonwoven material, in particular, a first nonwoven material and another nonwoven material. Furthermore, the multi-layer material 1000 can also have other layers in addition to the layers of nonwoven material or instead of the layers of nonwoven material.

The material 1000 can be a nonwoven or nonwoven material, as disclosed in DE 60 2004 002 206 T2, for example. In particular, the material 1000 made of nonwoven can be a porous or absorbent nonwoven fabric made of fibers or filaments, which can be obtained by willowing, spunbonding, meltblowing, air laying, wet laying or a blend thereof. Furthermore, hydro-entanglement can be used as web bonding method.

The fibers or filaments of the nonwoven material can be natural, for example, wood pulp, wool, cotton, linen and the like, naturally synthetic, such as regenerated cellulose, for example, viscose, modal, cupro, lyocell, cellulose acetate and the like, or synthetic, for example, polyvinyls, polyester, polyolefins, polyamides and the like.

The nonwoven material of the material 1000 can advantageously have a weight per unit area of 10-30 g/m2, more preferably of 15-25 g/m2. A spun-bonded fabric made of polypropylene, in particular, with a weight per unit area of 15-25 g/m2, can be particularly preferred for the material 1000.

In the example of FIG. 18, a first material layer 1010, a second material layer 1020, a third material layer 1030, and a fourth material layer 1040 are shown, which form the multi-layer material 1000. However, the multi-layer material 1000 can also have any other number of material layers, such as two, three, five, six and more, for example. Preferably, the first to fourth material layers 1010, 1020, 1030, 1040 are mechanically connected to each other, for example, laminated with each other.

For example, the first material layer 1010 can be a non-woven, absorbent, soft, cushioning, warming and/or highly elastic material layer, which preferably has a low friction coefficient. According to embodiments, the first material layer 1010 constitutes the inside of the disposable booty 10, i.e. the side which fits to the foot 1.

The second material layer 1020 can preferably be an elastic film material or elastic foil material. In particular, the second material layer 1020 can be a bistretch material, which enables elasticity in two spatial directions. Furthermore, the second material layer 110 can be permeable or semi-permeable, in order to allow moisture to pass. However, it preferably provides a microbial barrier function.

The third material layer 1030 can be a nonwoven and/or highly elastic material layer, which is resistant, in particular, with regard to abrasion, in order to provide high resistance.

The fourth material layer 1040 can constitute a coating, in particular, on the outside of the disposable booty 10. Preferably, the fourth material layer 1040 is slip-resistant, in order to prevent slipping while wearing the disposable booty 10. Furthermore, the fourth material layer 1040 can provide a non-permeable film as barrier function. The fourth material layer 1040 can provide the barrier function on some areas only. A barrier function can only be provided on those areas where it is required, whereas a higher moisture transport via the disposable booty can be ensured in other areas. Furthermore, the fourth material layer 1040 can include a tacky coating, in particular, in the areas in which the fastening mechanism is formed in the disposable booty.

Figure 19:
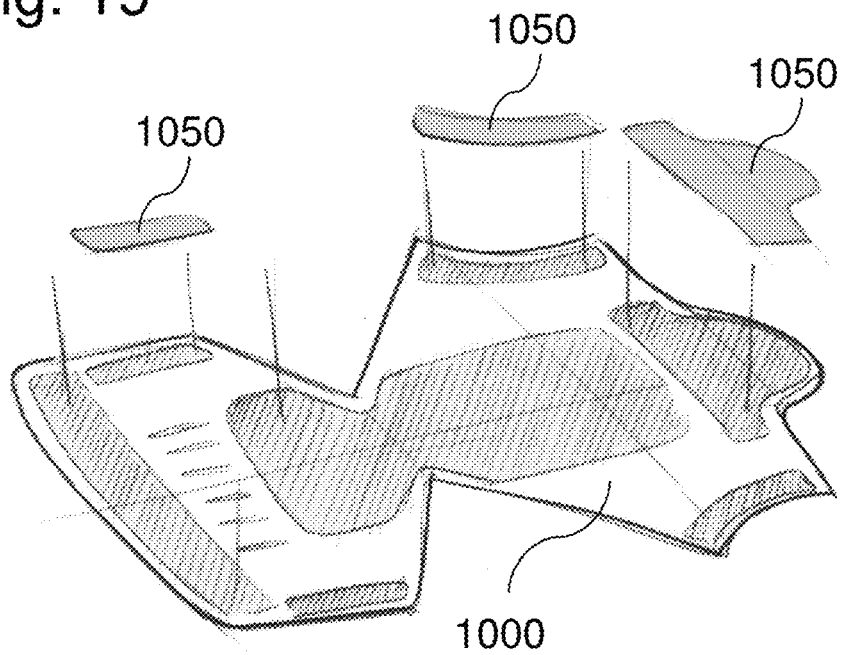
FIGS. 19 and 20 show schematic perspective views of a disposable booty according to another embodiment of the invention.
Figure 20:
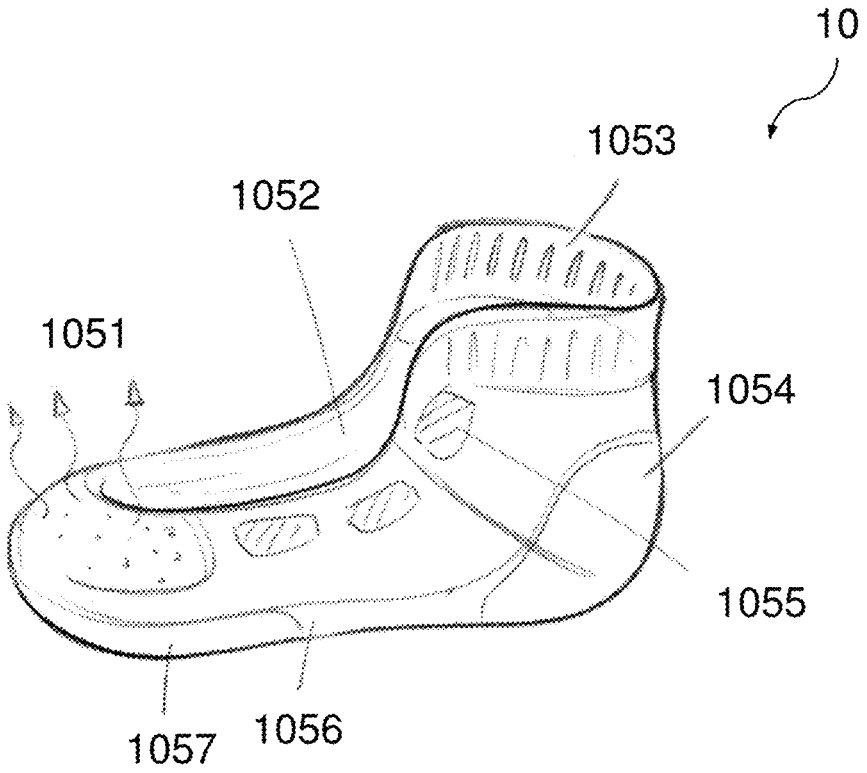

Furthermore, as shown in FIGS. 19 and 20, a fifth material layer 1050 or a localized material layer 1050 can be formed on the first material layer 1010 (see FIG. 19) or on the fourth material layer 1040 (not shown). The localized material layer 1050 can provide, in localized or spatially limited areas, a specific function for that area. The localized material layer 1050 can therefore form one or more functional areas. Furthermore, the other material layers of the multi-layer material layer 1000, where the first to fourth material layers 1010, 1020, 1030 1040 are configured in the area of the localized material layer 1050 in such a manner that they support the function in the localized area.

For example, a first functional area 1051 can provide an increased breathability in an area of the toe part 200. To this end, the localized material layer 1050 and/or the other material layers of the multi-layer material 1001 can include perforated material, a permeable foil can be provided in the multi-layer material layer 1000 in that area, another material can be provided for the first to fourth material layers 1010, 1020, 1030, 1040 in that area and/or the multi-layer material layer can have an opening in that area.

A second functional area 1052 can provide an increased elasticity, for example, in an area of the fastening mechanism, such as the instep fastening part 500. For example, a fastening mechanism with a high tolerance and/or a high overlap can thereby be created. If the functional area 1052 with increased elasticity is, for example, formed in an area of the back of the foot, folding on the back of the foot can be prevented.

A third functional area 1053 can provide a soft tactile feel in an upper area of the heel part 400, i.e. in the area in which the user grabs the disposable booty 10 for putting it on/taking it off. This can be achieved by a higher elasticity due to elastic strands introduced into or connected to the material layer 1000, which are arranged in a closer knit in the third functional area than in the other functional areas, for example, the seventh functional area 1057. Furthermore, a sticky coating can be provided on the inside of the disposable booty 10 in the ankle area. Furthermore, an extra compression with integrated elasticity can be provided in the area of the heel part 400, in order to facilitate putting on/taking off the disposable booty 10. Furthermore, the material can be formed thicker in that area, for example, by a double layer, in order to prevent tearing off or rupturing.

A fourth functional area 1054 can provide an additional cushion function. The cushion function can, for example, be provided by the multi-layer material layer 1000. Furthermore, a foam part can be provided between two material layers, in particular, between two non-woven material layers and/or applied onto the outer material layer by means of a Velcro fastener.

A fifth functional area 1055, which is designated as "landing zone" in the English technical terminology, can represent the or a part of a fastening mechanism or play a supporting role in such a mechanism. For example, Velcro fasteners or an elastic fastener can be attached to the outer material layer (glued, sewn or welded). Furthermore, a sticky coating can be provided, with the aid of which the material layers of the multi-layer material layer 1000 can stick to one another. The use of an adhesive can, compared to the use of Velcro fasteners, provide cost savings and thus be advantageous, in particular, in the case of a disposable booty 10.

A sixth functional area 1056 can provide absorbent properties. For example, an extra sole or a sole part made of a non-woven material or a foam material can be provided on the inside of the disposable booty 10 to absorb sweat. Furthermore, the multi-layer material layer 1000 can, in that area, provide increased breathability, in order to transport liquid, such as sweat, for example, from the inside of the disposable booty 10 to the outside, however, without drying out the skin. Furthermore, the sixth functional area 1056 can provide thermal insulation.

A seventh functional area 1057 can provide anti-slip properties. For example, a sticky coating, a silicon coating or an extra foil can be provided on the outside of the disposable booty 10. However, the seventh functional area 1057 can also comprise a roughened material or a material printed onto the material layer 1000. Furthermore, a visual pattern can be provided, which indicates anti-slip properties.

Figure 21:
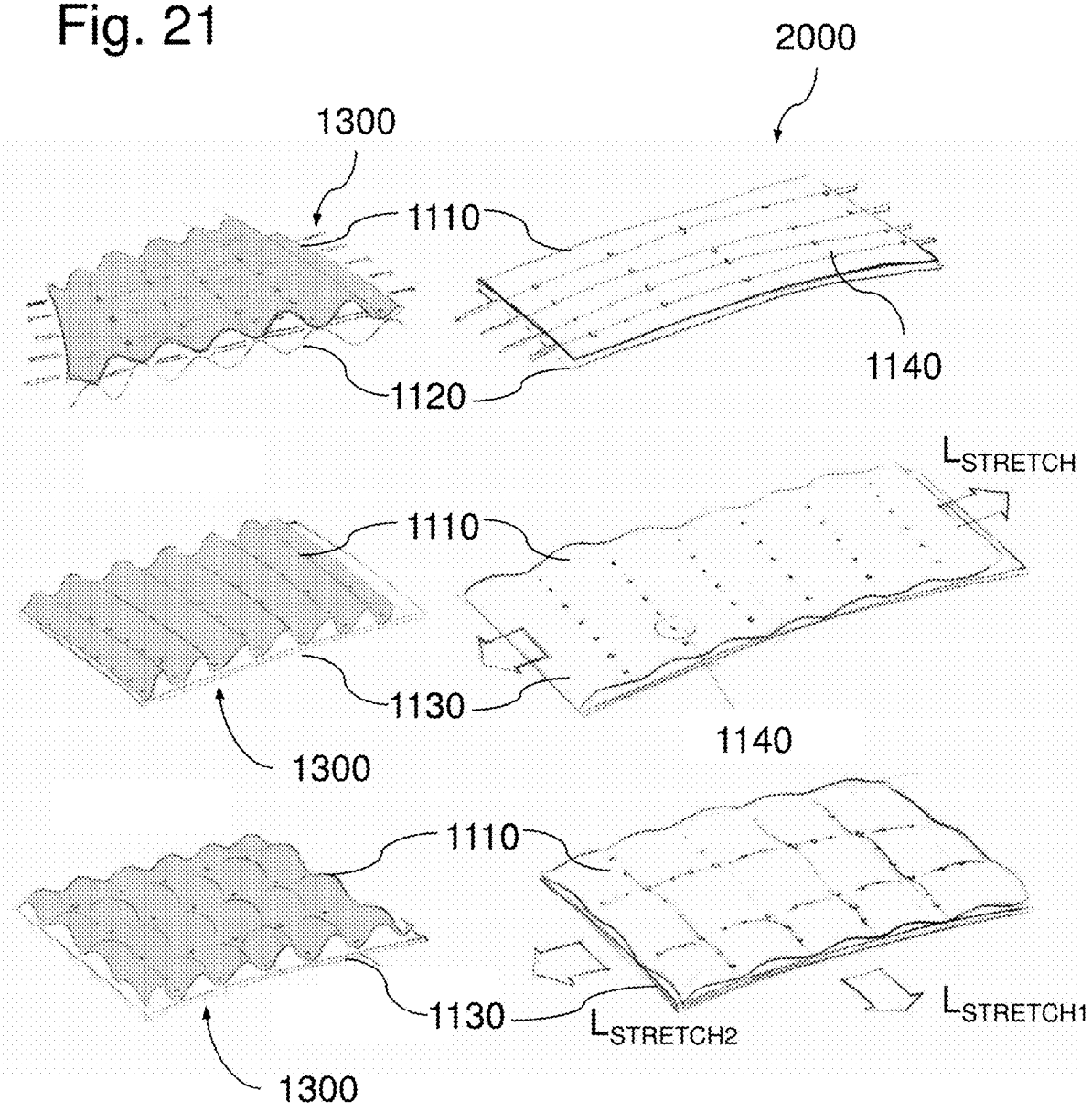
FIG. 21 shows a schematic perspective view of a multilayer material of a disposable booty according to an embodiment of the invention.

FIG. 21 illustrates the manufacture of a material layer with elastic properties, hereinafter referred to as stretch material 2000. A stretch material 2000 and its manufacture are, for example, described in DE 10 2007 055 524 A1 and/or DE 10 2005 011 059 B3. The stretch material 2000 comprises elastifying means 1300 and a material or a material layer 1000. For the manufacture of the stretch material 2000, the elastifying means 1300 can, for example, be secured to a chassis-forming shell material of the material 1000 under a preload (stretch bonding). In this process, the elastifying means 1300 under a preload are selectively connected to the shell material of the material 1000 at connecting points 1140, so that the material 1000—in an unloaded state of the elastifying means 1300, is folded like an accordion or wavelike along the preferred direction of the stretch, i.e. along the direction of the preload of the elastifying means 1300. The preload can be 1.5-6.00, in particular, 2.5-5.0. In this process, the preload can be defined as a factor of the degree of elongation compared to the unstretched/relaxed state of the elastic strands 1120.

As shown in the upper two illustrations of FIG. 21, the stretch material 2000 a material layer 1110 from a material 1000, for example, from a nonwoven material, can be applied, in undulating form, onto contracted elastifying means 1300, for example, elastic strands 1120. In this state, the material layer 1110 can have elevations and depressions. The elastic strands 1120 can be arranged parallel and connected to the depressions of the material layer 1110. In a practical realization, the elastic strands 1120 can be completely coated with a bonding layer and then be connected, under a preload, to the material layer 1110, which, in particular, is a nonwoven material layer. Since the nonwoven material consists of a plurality of fibers or filaments, a selective connection between the elastic strands 1120 and the material layer 1110 THUS EMERGES. If a pressure is exerted along the elastic strands 1120, then the undulating state of the material layer 1110 can switch to an extended state, and the material layer 1110 can extend in the direction along the elastic strands 1120, in particular, until a smooth state of the material layer 1110 is achieved. A restoring force in the direction of the undulated state can be provided by the elastic strands 1120. That way an elasticity can be produced in a material layer which has no intrinsic elasticity. The elastifying means 1300 preferably comprise strand or band-shaped elastifying means, such as rubber or polyether polyurethane for polyester polyurethane strands, preferably elastic strands such as Lycra® or Spandex® strands. The elastifying means 1300 can preferably have a strength of 300-1500 dtex, more preferably 500-1200 dtex, and most preferably 500-900 dtex. Thus, a unistretch material can be manufactured as the stretch material 2000, which has elastic properties along a single predetermined stretch direction $L_{STRETCH}$.

The material layer 1110 can, in the undulating state, provide a cushioning, which can prevent damage to the skin, and/or provide thermal insulation. Furthermore, the structure thus created can be used for covering seams and/or edges. Furthermore, friction can be reduced due to micro movements. In addition, a highly elastic stretch material 2000 IS THUS provided, which provides a high stretch with high extensibility at the same time.

The two central illustrations of FIG. 21 show a similar principle, however, instead of the elastic strands 1120, an elastic film 1130 is used as the elastifying means 1300, which film has an elasticity, at least in the spatial direction in which the non-woven material layer 1110 is undulated, in order to provide a stretch material 2000 with elastic properties. As shown in the right central illustration of FIG. 21, the connection between the non-woven material layer 1110 and the elastic film 1130 can be established via the connecting points 1140, effected via an ultrasound welding connection or an adhesive bond. This offers the advantage that a tear-resistant connection can be formed.

The bottom two illustrations of FIG. 21 show a transfer of the previously described one-dimensional principle to two spatial directions. In this process, the material layer 1110 is not undulated along one direction, as shown in the two upper and central illustrations of FIG. 21, but along two spatial directions. For this purpose, the elastic film 1130 is, preloaded in two directions, connected to the material 1000 via a grid of connecting points 1140. According to an embodiment, an elastic film can be applied onto the material layer 1110 made of the material 1000, wherein the elastic film contracts in a subsequent treatment. As an example for such a stretch material, the material Conforma from company H.B. Füller is mentioned. Thus, a bistretch material can be produced as the stretch material 2000, which has elastic properties in two spatial directions, i.e. a first stretch direction $L_{STRETCH1}$, as well as a second stretch direction $L_{STRETCH2}$.

Additional embodiments of a disposable booty 10 as well as associated cutting patterns are shown in FIGS. 22A to 27C, which and/or the features of which can be combined with the embodiments described herein and/or their features, whereby new embodiments emerge.

Figure 22A:
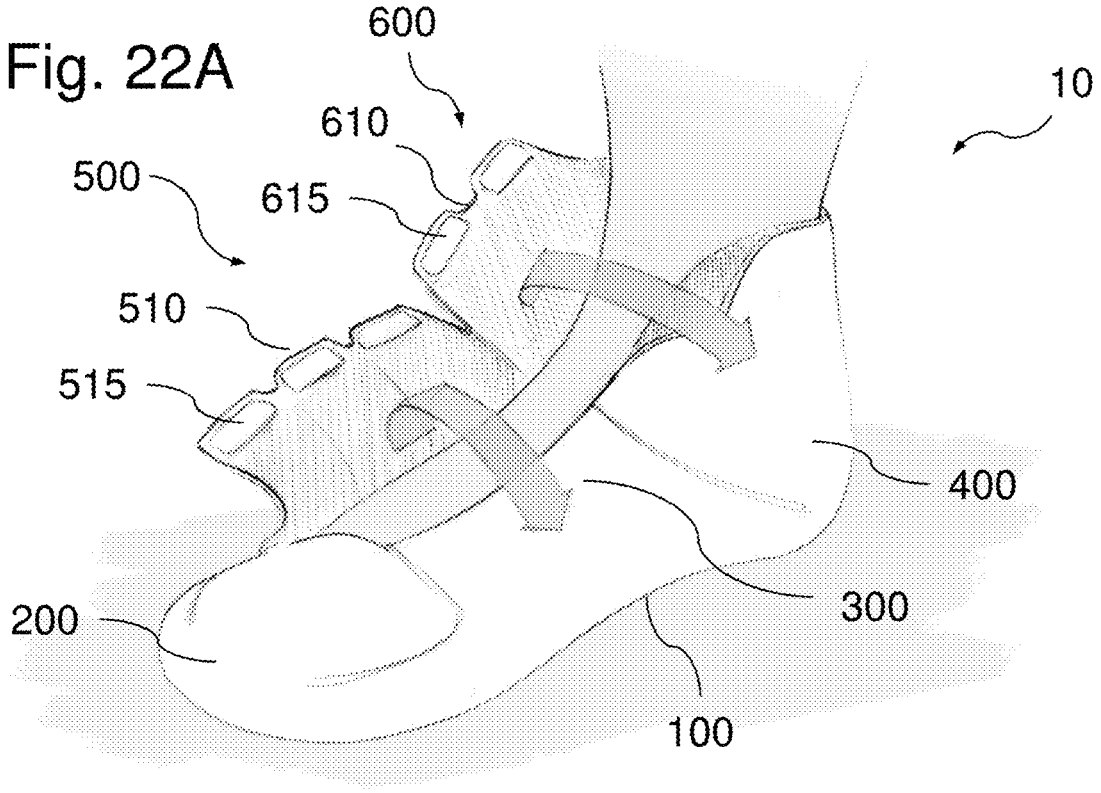
FIGS. 22A to 22C show schematic perspective views of a disposable booty according to another embodiment of the invention in an open state, in a fastened state, and of the associated cutting pattern.
Figure 22B:
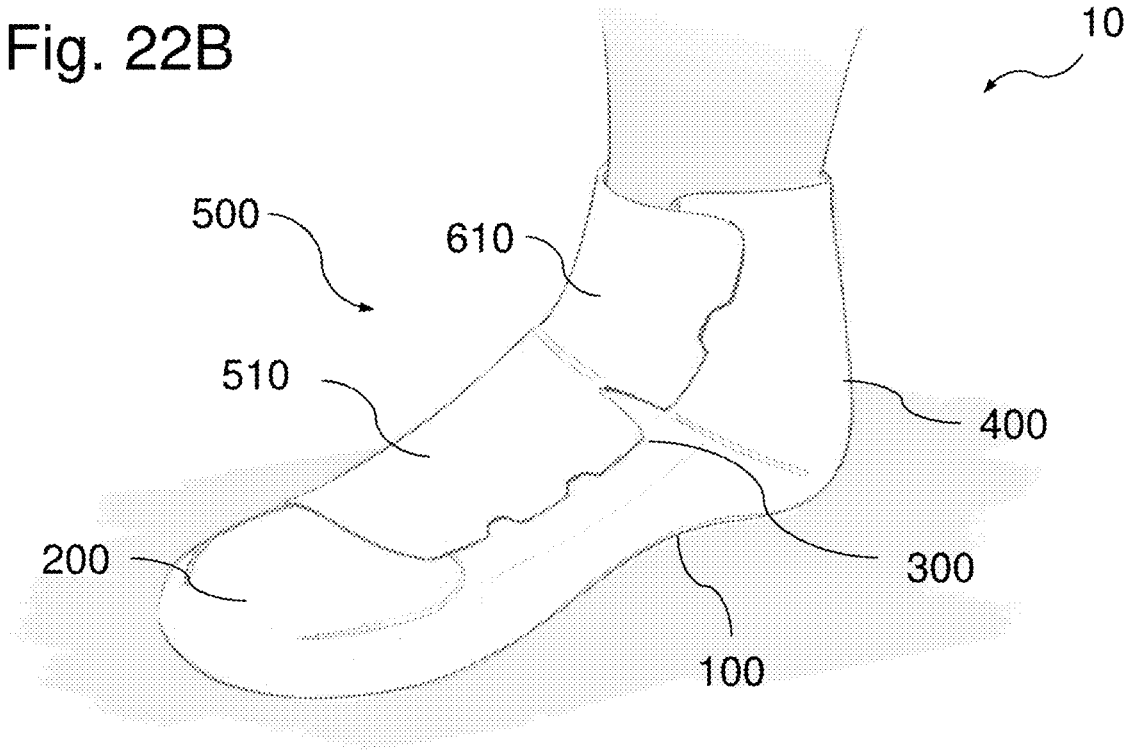
Figure 22C:
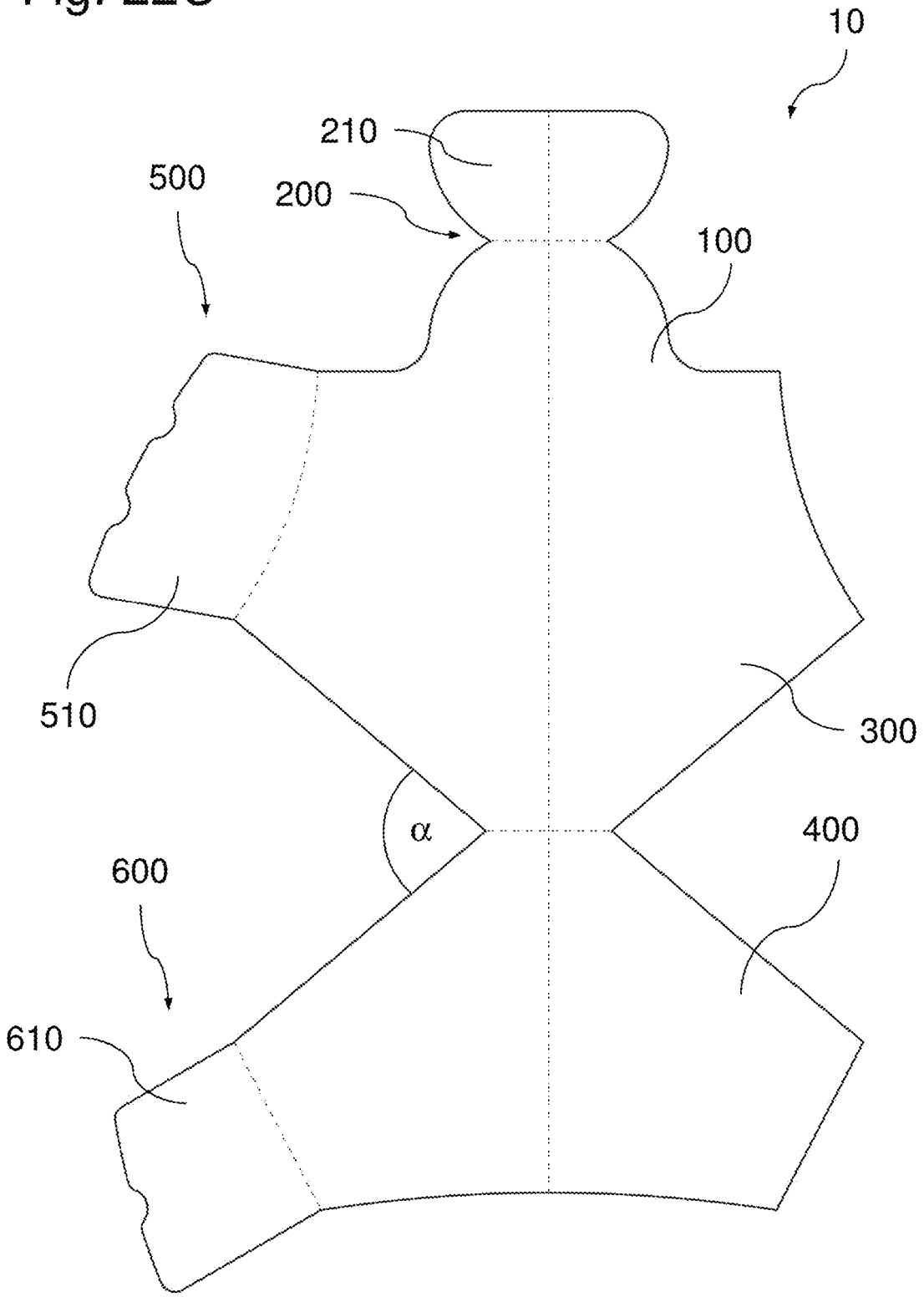

FIGS. 22A and 22B show schematic perspective views of a disposable booty 10 or of a sock 10 according to another embodiment of the invention, and FIG. 22C shows the associated cutting pattern. As can be seen from FIGS. 22A and 22B, the disposable booty 10 or the sock 10, in particular, the disposable sock 10, further comprises, in addition to the sole part 100, the toe part 200 and the instep part 300, furthermore, the heel part 400, which is adapted, when the disposable booty 10 is donned, to cover the heel of the foot 1. Furthermore, the disposable booty 10 or the sock 10, in particular, the disposable sock 10, has an instep fastening part 500, which is adapted, when the disposable booty 10 is in a state applied to the foot 1, to releasably fasten the disposable booty 10 at the back of the foot 1. According to the embodiment of the invention shown in FIGS. 22A and 22B, the instep fastening part 500 has a flap part 510, which is fastened to the sole part 100 and which has a bonding element 515 or a Velcro fastener for releasable fastening of the flap part 510 to the instep part 300 or to the sole part 100. Furthermore, the disposable booty 10 or the sock 10, in particular, the disposable sock 10, has an ankle fastening part 600, which is adapted in such a manner that it, when the disposable booty 10 is donned, releasably fastens the disposable booty 10 at the ankle of the foot 1. In the embodiment of the invention shown in FIGS. 22A and 22B, the ankle fastening part 600 encloses at least a flap part 610, which is fastened to the heel part 400 and which has a bonding element 615 for releasable fastening of the flap part 610 to the ankle fastening part 600 or to the heel part 400. Thus, both a firm enclosure of the back of the foot and a fastening of the disposable booty 10 upwards can be effected. Preferably, the instep fastening part 500 and/or the ankle fastening part 600 are formed elastically, in order to ensure both a leeway for movement and, at the same time, provide a secure hold.

According to an embodiment, at least the sole part 100, the heel part 400 and the toe part 200 can be formed as a one-piece cutting pattern. In particular, the sole part 100, the heel part 400, the toe part 200 and furthermore the instep part 300 can be formed as a one-piece cutting pattern. As shown in FIG. 22C, the instep part 300 and the heel part 400 each have a straight cutting edge section, wherein the straight cutting edge section of the instep part 300 and the straight cutting edge section of the heel part 400 diverge in a leg-shaped manner and enclose a cutting edge angle $\alpha$. Thus, the one-piece cutting pattern can have at least a cutting edge corner section with a cutting edge angle $\alpha$ equal to or greater than 70°, in particular, equal to or greater than 75°, and/or equal to or less than 90°, in particular, equal to or less than 85° and/or preferably approximately equal to 80°. The cutting edge angle $\alpha$ can be formed between two cutting edges, of which one is part of the instep part 300, and the other is part of the heel part 400. Preferably, the cutting edge angle $\alpha$ is formed on the same side as the instep fastening part 500 and the ankle fastening part 600. However, the cutting edge angle $\alpha$ can also be formed on the opposite side or on both sides between the instep part 300 and the heel part 400. By providing at least one cutting edge corner section in a cutting pattern, from which a straight cutting edge section of the instep part 300 and a straight cutting edge section of the heel part 400 proceed and enclose an angle less than 90°, a disposable booty 10 is produced when the cutting edge sections of the instep part 300 and of the heel part 400 are combined, in which the rear heel part 400 runs towards those in the area of the Achilles tendon, i.e. does not extend vertically upward from the sole part 100 but forms a bag for the heel. Thus, slipping out of the disposable booty 10 in the area of the heel part 400 is prevented or at least made difficult. Furthermore, the toe part 200 can have a toe receiving part 210. The toe receiving part 210 can, when donned, receive the toes, and thus enable easy slipping into the disposable booty 10 in order to put it on.

Figure 23A:
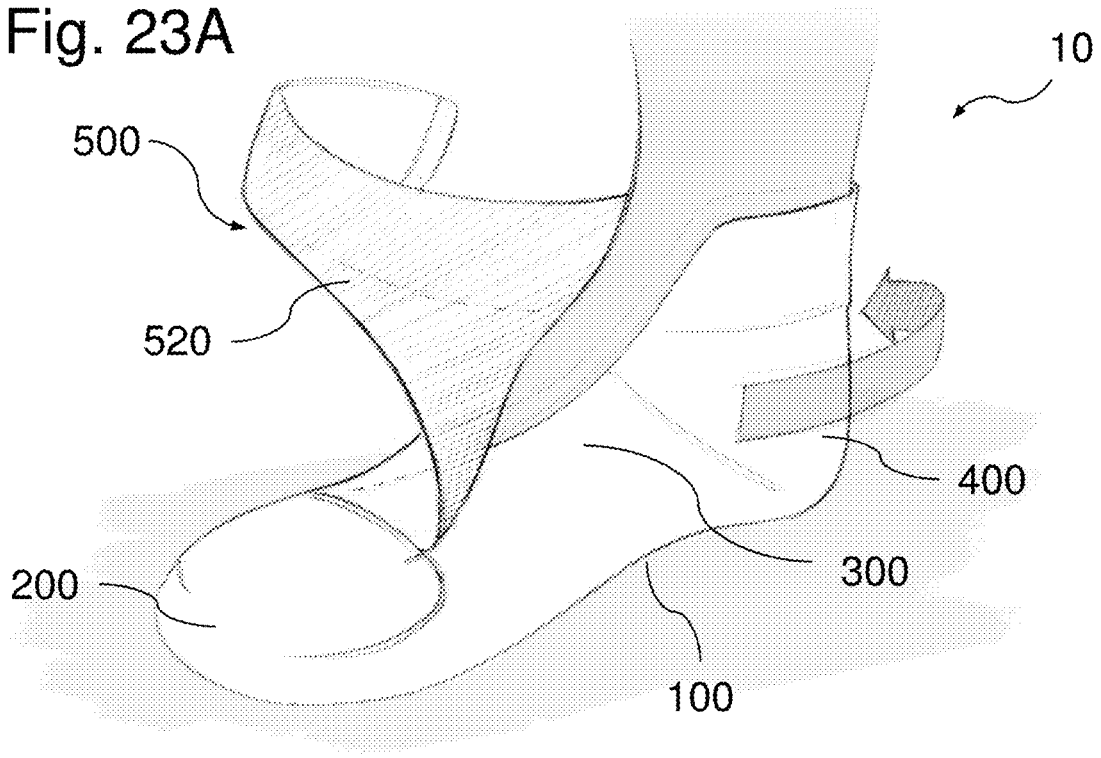
FIGS. 23A to 23C show schematic perspective views of a disposable booty according to another embodiment of the invention in an open state, in a fastened state, and of the associated cutting pattern.
Figure 23B:
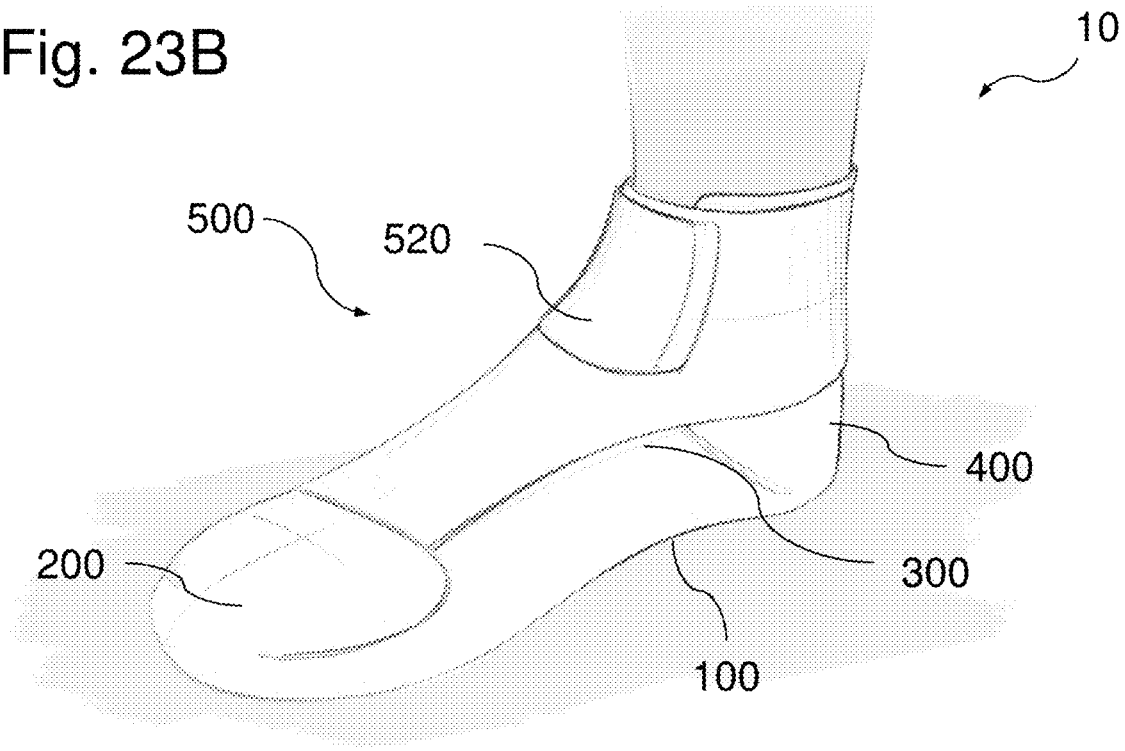
Figure 23C:
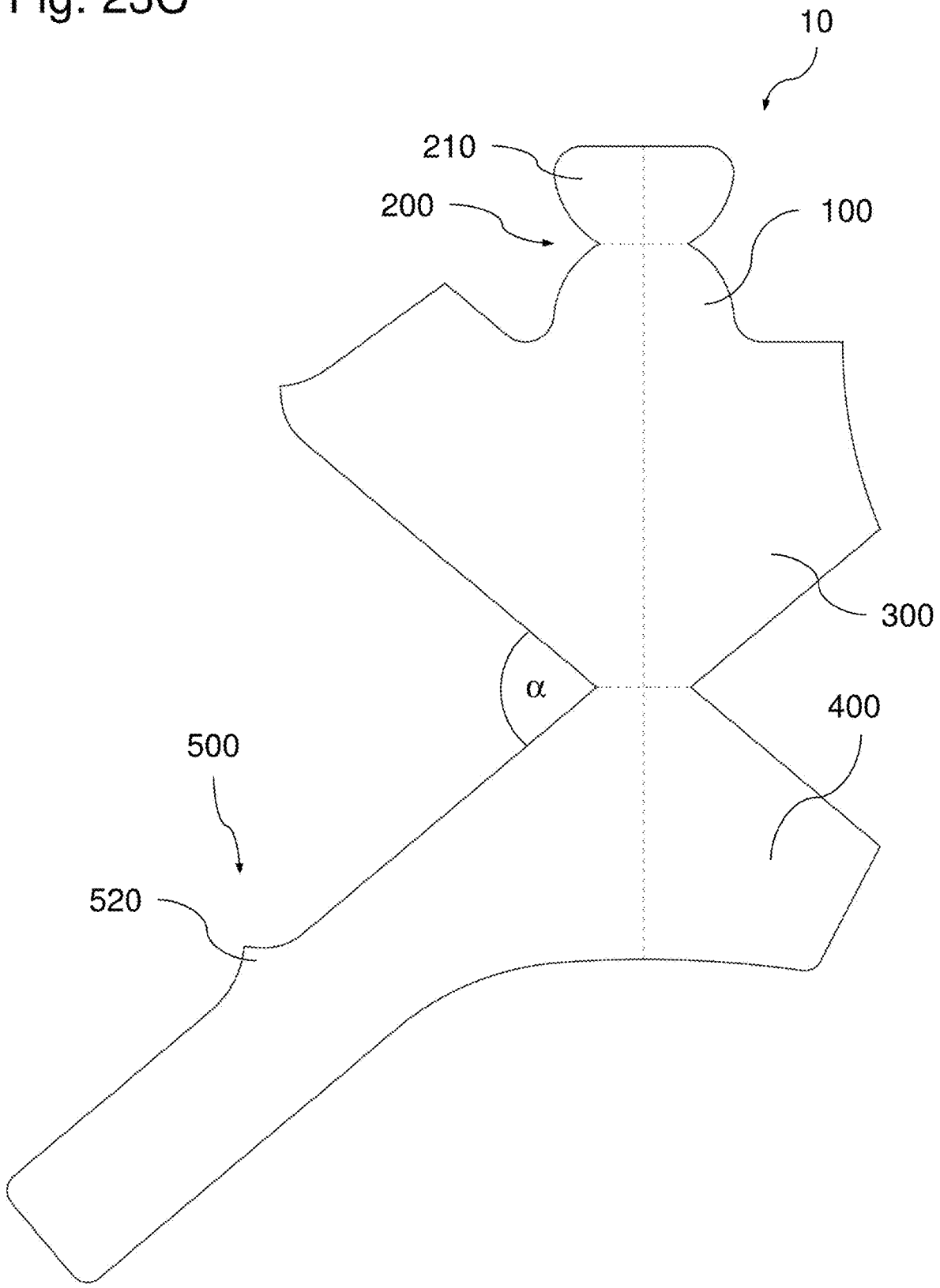

FIGS. 23A and 23B show schematic perspective views of a disposable booty 10 according to another embodiment of the invention, and FIG. 23C shows the associated cutting pattern. The disposable booty 10 shown in FIGS. 23A to 23C substantially differs from the disposable booty 10 shown in FIGS. 22A to 22C in that the instep fastening part 500 has a self-adhesive tape or adhesive tape 520 instead of a flap part 510 and instead of the ankle fastening part 600. The adhesive tape 520 is adapted, when the disposable booty 10 is in a state applied to the foot 1, to enclose the heel part 400 at least once (see the arrow in FIG. 23A). Furthermore, the heel part 400 can have the properties described in connection with FIGS. 3A and 3B.

The cutting pattern shown in FIG. 23C substantially differs from the cutting pattern shown in FIG. 22C in that the instep fastening part 500 is formed longer in order to represent the adhesive tape 520 and in that no area corresponding to the ankle fastening part 600 is provided. In particular, also a cutting edge corner section with the aforedescribed cutting edge angle α can be provided between the instep part 300 and the heel part 400.

Figure 24A:
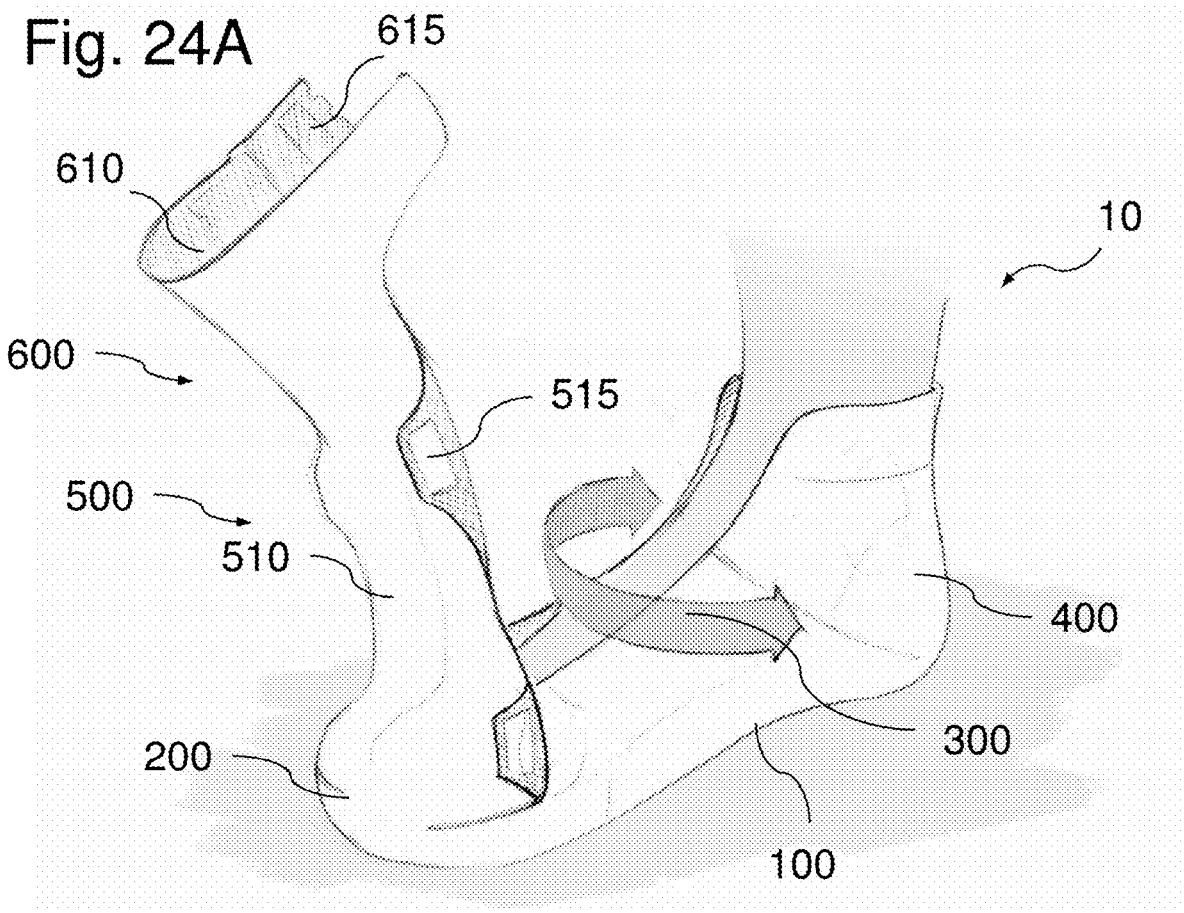
FIGS. 24A to 24C show schematic perspective views of a disposable booty according to another embodiment of the invention in an open state, in a fastened state, and of the associated cutting pattern.
Figure 24B:
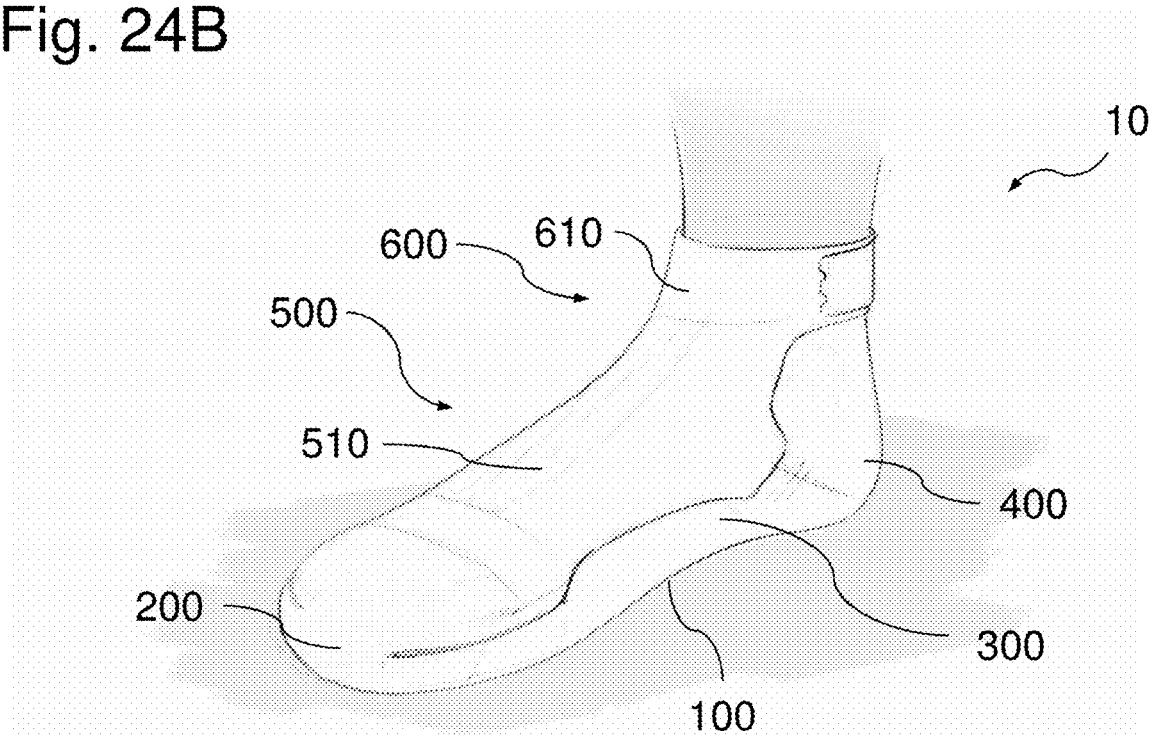
Figure 24C:
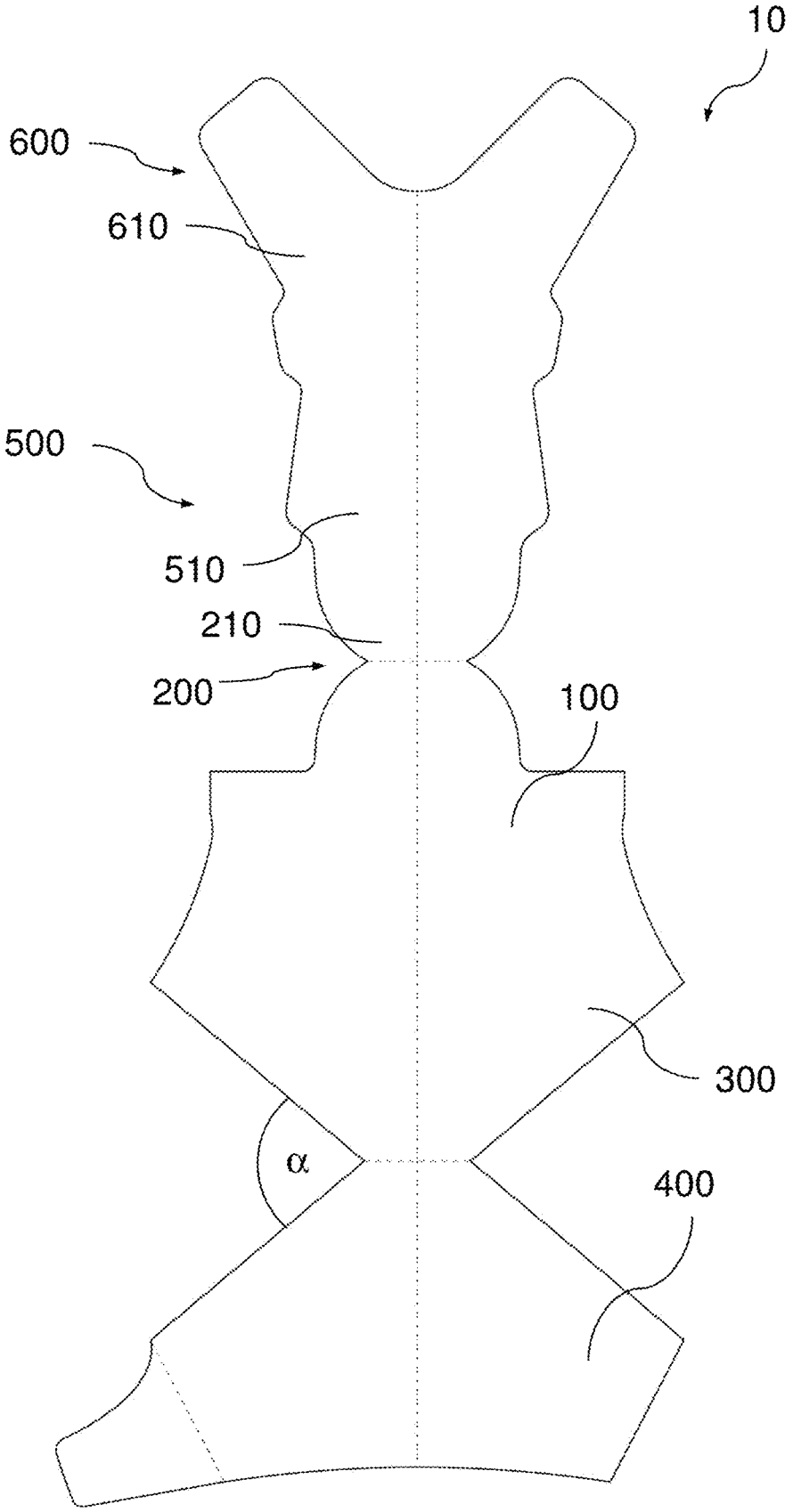

FIGS. 24A and 24B show schematic perspective views of a disposable booty 10 according to another embodiment of the invention, and FIG. 24C shows the associated cutting pattern. The disposable booty 10 shown in FIGS. 23A to 23C substantially differs from the disposable booty 10 shown in FIGS. 22A to 22C in that the instep fastening part 500 and the ankle fastening part 600 are fastened or connected to the toe part 200. In particular, the flap part 510 can be fastened to the toe part 200, and the flap part 610 can be fastened to the flap part 410. After a user has stepped into the disposable booty 10, in particular, with their toes into the toe part 200, the instep fastening part 500 and the ankle fastening part 600 can be flapped backwards starting from the toe part 200 and fastened to the instep part 300 and/or the heel part 400. For example, the instep fastening part 500 can include a bonding element 515 or a Velcro fastening element to fasten the instep fastening part 500 to the instep part 300 and/or the ankle fastening element 600 can include a bonding element 615 or a Velcro fastening element to fasten the ankle fastening part 600 to the heel part 400. In this process, the ankle fastening element 600 can include opposite extensions, which can be wrapped around the leg of the user and can be fastened to each other by means of the bonding element 615 or of the Velcro fastening element.

The cutting pattern shown in FIG. 24C substantially differs from the cutting pattern shown in FIG. 22C in that the instep fastening part 500 and the ankle fastening part 600 are provided on the toe part 200. In particular, the instep fastening part 500 and the ankle fastening part 600 can be connected to the toe receiving part 210. Furthermore, also the cutting edge corner section with the cutting edge angle α can be provided between the instep part 300 and the heel part 400.

Figure 25A:
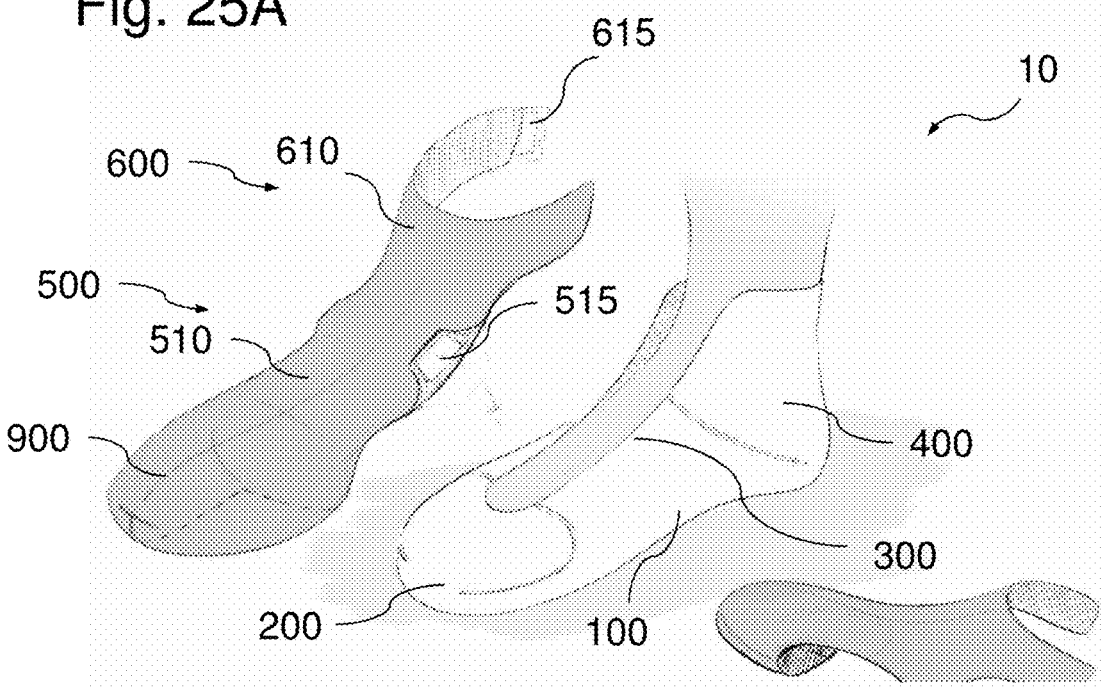
FIGS. 25A to 25C show schematic perspective views of a disposable booty according to another embodiment of the invention in an open state, in a fastened state, and of the associated cutting pattern.
Figure 25B:
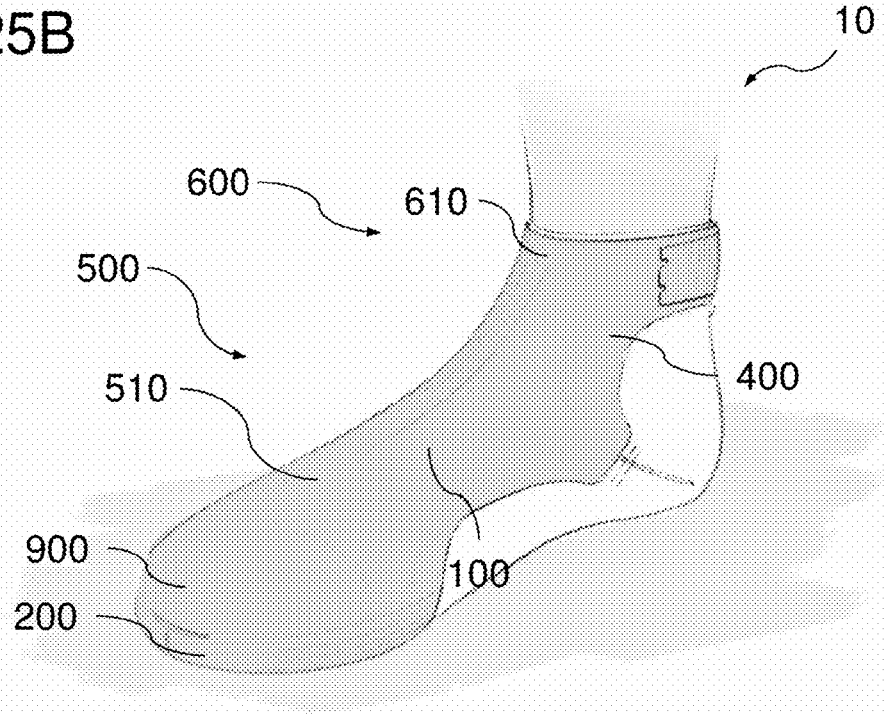
Figure 25C:
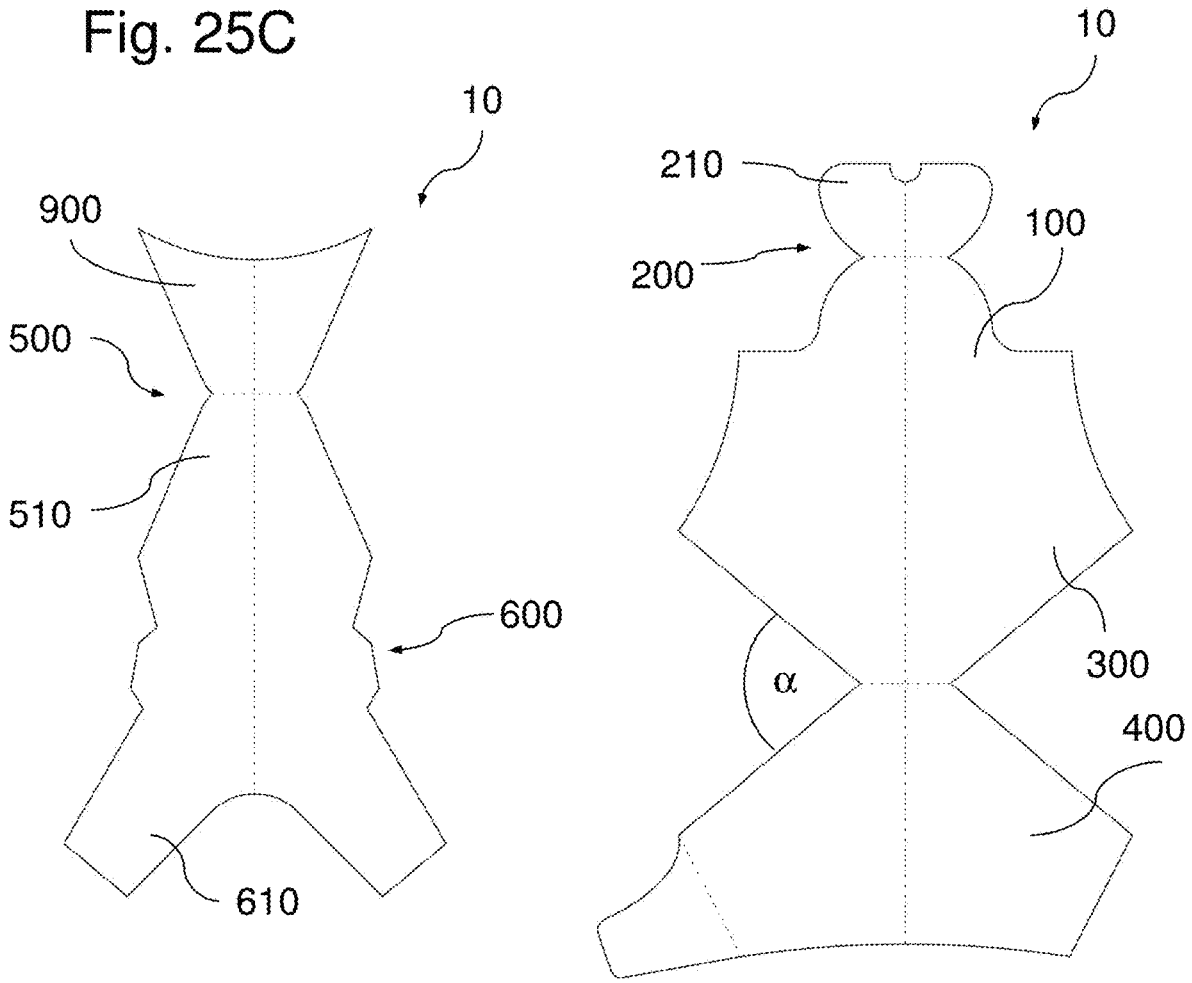

FIGS. 25A and 25B show schematic perspective views of a disposable booty 10 according to another embodiment of the invention, and FIG. 25C shows the associated cutting pattern. The disposable booty 10 shown in FIGS. 25A to 25C substantially differs from the disposable booty 10 shown in FIGS. 24A to 24C in that the instep fastening part 500 and the ankle fastening part 600 exist as a separate cutting pattern. Hence, a two-piece cutting pattern is provided. The cutting pattern for the instep fastening part 500 and the ankle fastening part 600 additionally includes a toe fastening part 900, which can be slipped over the toes. After having put on the first part comprising the sole part 100, the toe part 200, the instep part 300 and the heel part 400, one can pull the fastening part comprising the instep fastening part 500, the ankle fastening part 600 and the toe fastening part 900 over the toes and fasten it to the instep part 300 and/or the heel part 400. Due to the two-piece design of the disposable booty 10, different materials can be used for the two different areas, thus optimizing the two parts for their respective purposes of use.

The cutting pattern shown in FIG. 25C substantially differs from the cutting pattern shown in FIG. 24C in that it is designed as two parts. A second cutting pattern is provided for the instep fastening part 500, the ankle fastening part 600 and the toe fastening part 900. In particular, the toe fastening part 900 can have a toe receiving part similar to the toe receiving part 210. Furthermore, also the cutting edge corner section with the cutting edge angle α can be provided between the instep part 300 and the heel part 400. According to embodiments, the toe receiving part 210 can, as shown in FIG. 25C, have a semicircular recess in an area corresponding to the toe part 200.

Figure 26A:
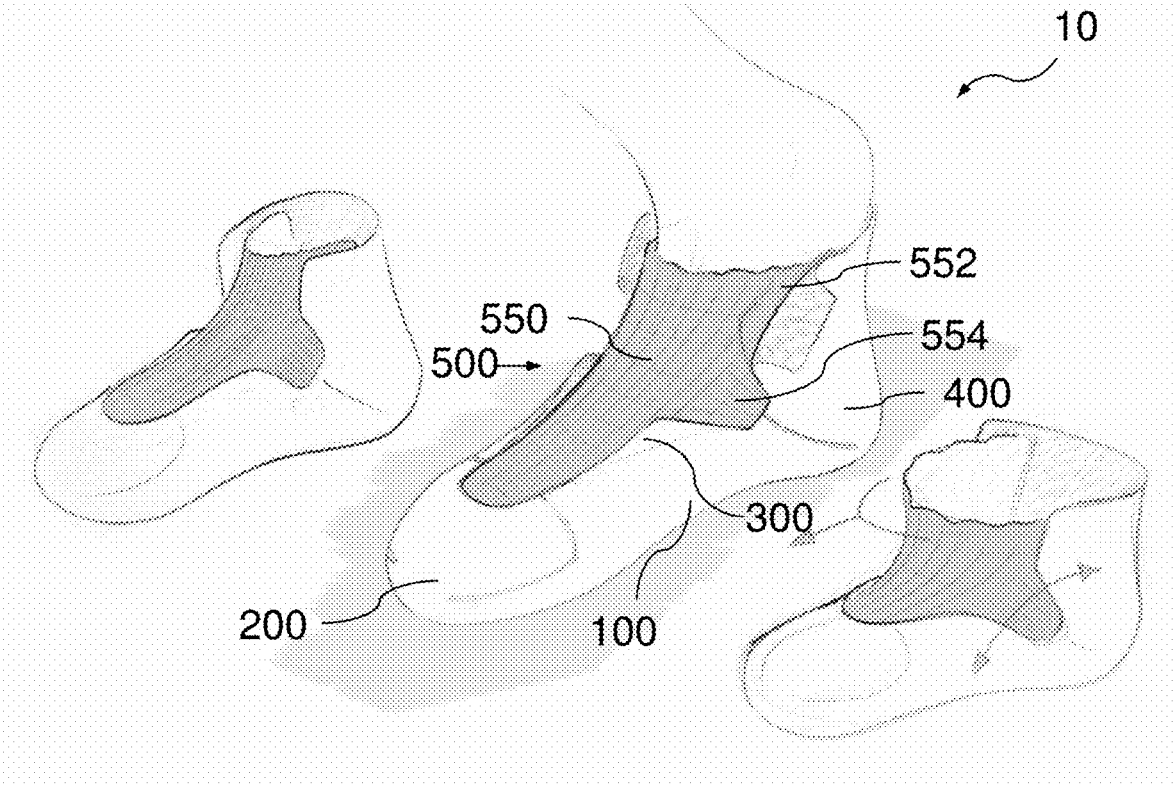
FIGS. 26A to 26C show schematic perspective views of a disposable booty according to another embodiment of the invention in an open state, in a fastened state, and of the associated cutting pattern.
Figure 26B:
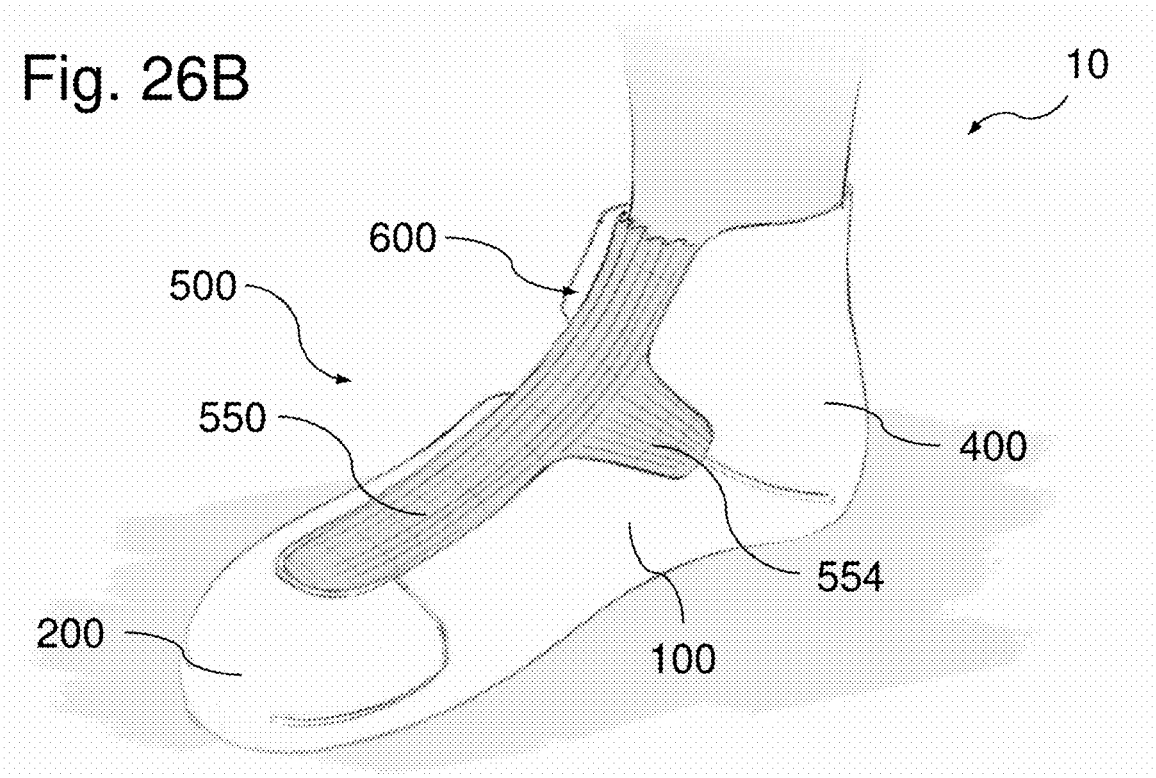
Figure 26C:
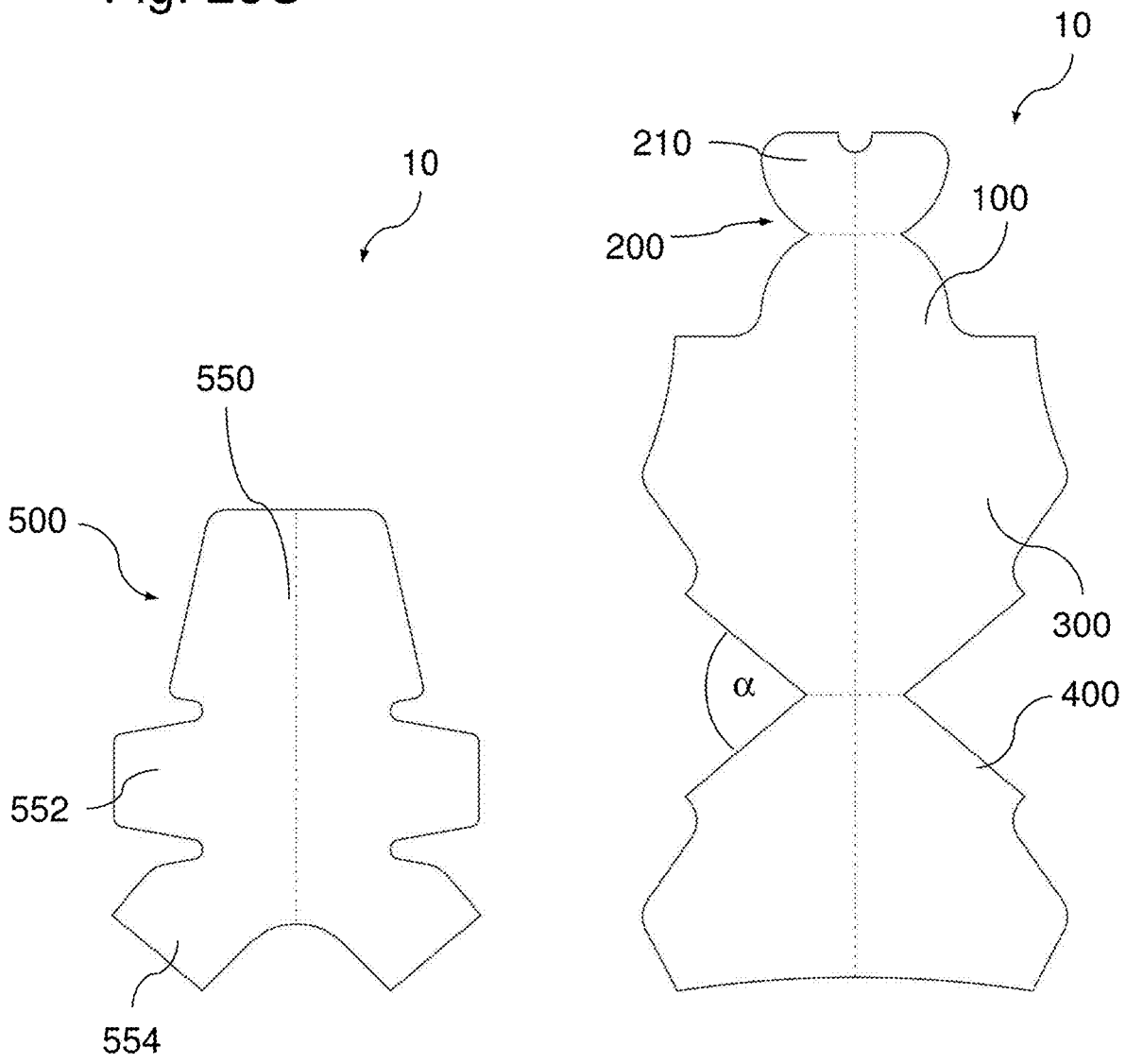

FIGS. 26A and 26B show schematic perspective views of a disposable booty 10 according to another embodiment of the invention, and FIG. 26C shows the associated cutting pattern. The disposable booty 10 shown in FIGS. 26A to 26C substantially differs from the disposable booty 10 shown in FIGS. 25A to 25C in that the instep fastening part 500 is, at least partly, fastened from the inside. Hence, a two-piece cutting pattern is provided, which is fastened, at least partly, to the first cutting pattern from the inside, i.e. from the side facing the foot.

The instep fastening part 500 has a back part 550, which is arranged above the back of the foot. A front part of the back part 550 can be slipped into the toe part 200, and a rear part facing the ankle can be slipped into the heel part 400. To fasten the rear part to the heel part 400, one, preferably two, ankle flap part(s) 552 can be provided, which can be fastened to the heel part 400 from the inside. For example, the ankle flap part 552 can be tacky or have a Velcro fastener. Furthermore, the instep fastening part 500 can include one, preferably, two lateral flap part(s) 554 in a central area, which is fastened to the instep part 300 from the outside. The lateral flap part 554 can be tacky or have a Velcro fastener.

Due to the two-piece design of the disposable booty 10, different materials can be used for the two different areas, thus optimizing the two parts for their respective purposes of use. The instep fastening part 500 preferably includes an elastic material, in particular, an elastic material as the sole part 100, the toe part 200, the instep part 300 and the heel part 400. A safe, well-fitting fastener of the disposable booty 10 with sufficient leeway can thereby be created. Furthermore, the disposable booty 10 can be adjusted to the foot 1 by moving the instep fastening part 500 relative to the sole part 100, toe part 200, instep part 300 and heel part 400 (see the arrow in the right illustration of FIG. 26A).

The cutting pattern shown in FIG. 26C substantially differs from the cutting pattern shown in FIG. 25C in that the toe fastening part 900 is not provided, and the instep fastening part 500 is provided with corresponding areas for the back part 550, the ankle flap parts 552 and the lateral flap parts 554. Furthermore, also the cutting edge corner area with the angle α can be provided between the instep part 300 and the heel part 400. According to embodiments, the toe receiving part 210 can, as shown in FIG. 26C, have a semicircular recess in an area corresponding to the toe part 200.

Figure 27A:
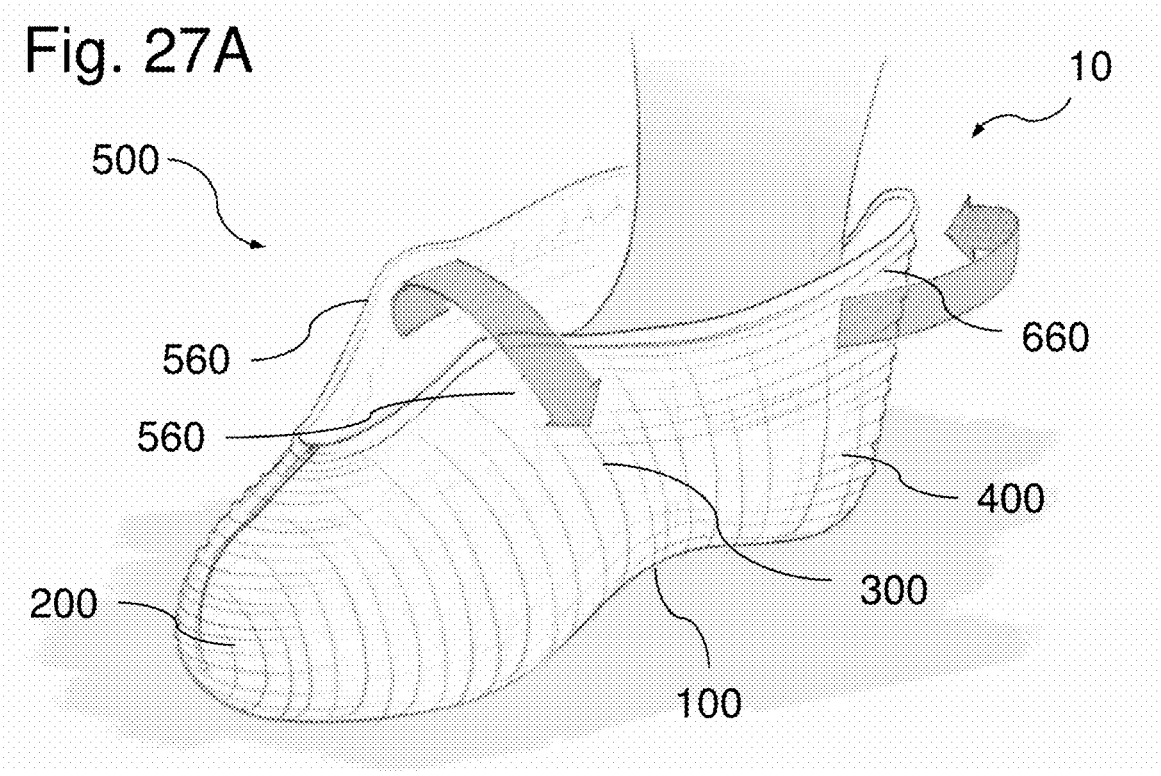
FIGS. 27A to 27C show schematic perspective views of a disposable booty according to another embodiment of the invention in an open state, in a fastened state, and of the associated cutting pattern.
Figure 27B:
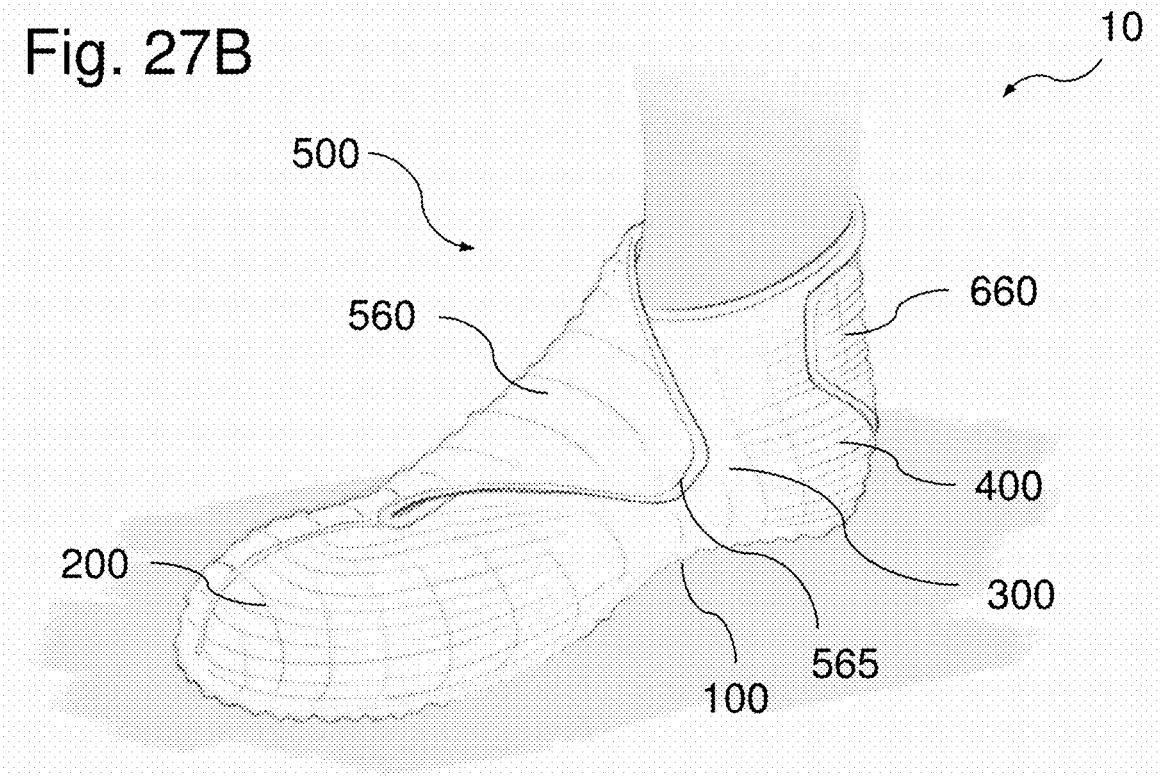
Figure 27C:
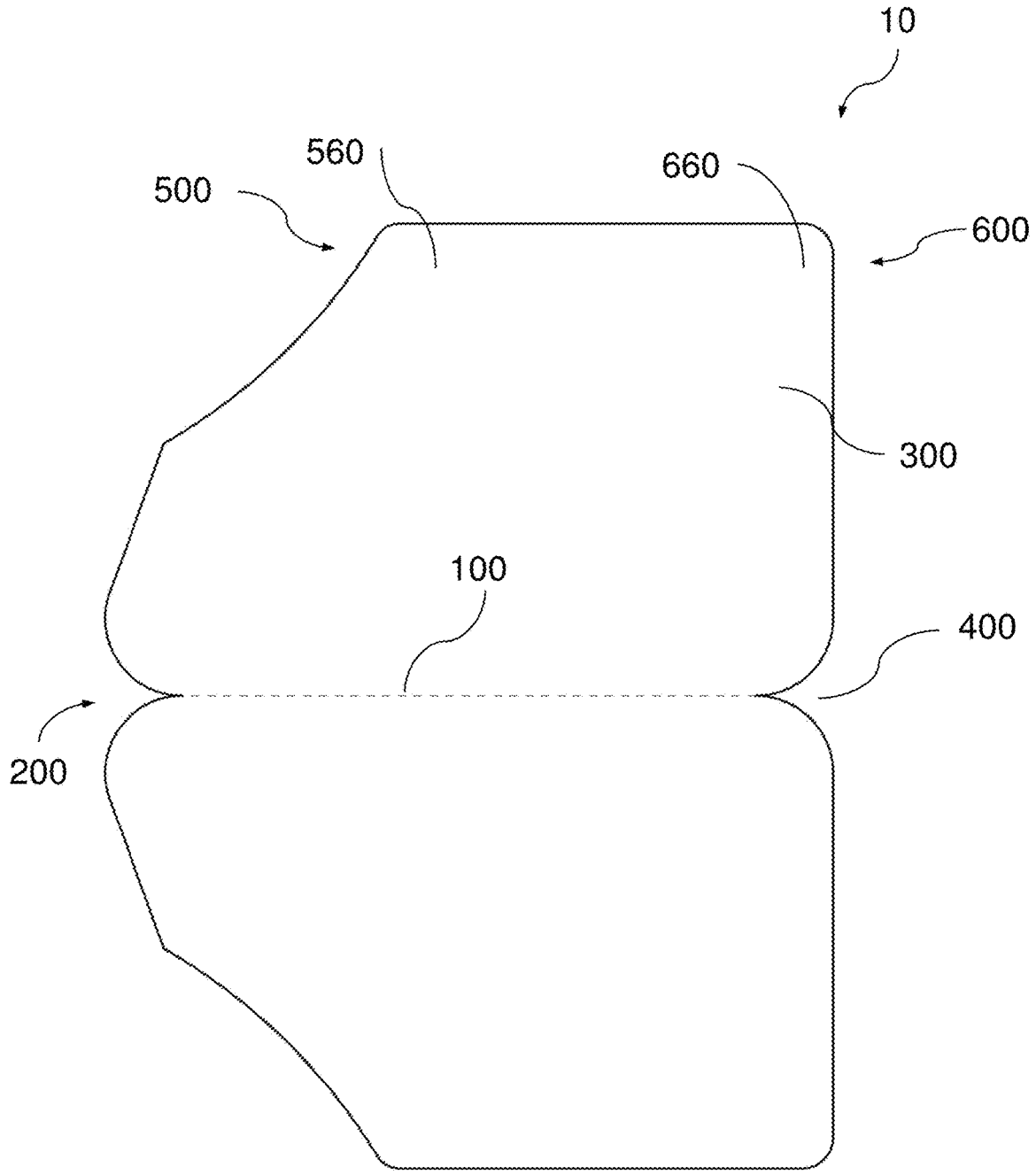

FIGS. 27A and 27B show schematic perspective views of a disposable booty 10 according to another embodiment of the invention, and FIG. 27C shows the associated cutting pattern. The disposable booty 10 shown in FIGS. 27A to 27C substantially differs from the disposable booty 10 shown in FIGS. 22A to 22C in that the instep fastening part 500 comprises two instep overlapping parts 560 instead of one flap part 510, and the ankle fastening part 600 comprises two ankle overlapping parts 660 instead of one flap part 610. The two instep overlapping parts 560 are adapted, when the disposable booty 10 is in a state applied to the foot 1, to enclose the instep part 300 at least once (see the left arrow in FIG. 27A) and be placed on top of each other, so that the instep overlapping parts 560 overlap at least partly. The two ankle overlapping parts 660 are adapted, when the disposable booty 10 is in a state applied to the foot 1, to enclose the heel part 400 at least once (see the right arrow in FIG. 27A) and be placed on top of each other, so that the ankle overlapping parts 660 overlap each other at least partly. The multi-layer material used for the disposable booty 10 shown in FIGS. 27A to 27C can preferably include a diaper material. A diaper material can, for example, be a nonwoven material and/or a stretch material, which, for example, has been manufactured by means of a stretch bond method and thus has elastic properties. In this process, the nonwoven material can have special absorption properties, in order to keep the foot dry or be able to administer an active substance to the foot for a long time. Furthermore, a flip-over part 565 of two cutting edges of the cutting pattern can be provided in a central area of the toe part 400. The flip-over part 565 can include a bonding element or Velcro fastening element on the side facing the instep part 300, in order to releasably fasten the disposable booty 10.

The cutting pattern shown in FIG. 27C substantially differs from the cutting pattern shown in FIG. 22C in that it has a particularly simple form. It is built mirror-symmetrical around an elongated centerline (see the dashed line in FIG. 27C) of the sole part 100 and has a wing-shaped form. Due to the simple form of the cutting pattern, the disposable booty 10 shown in FIGS. 27A to 27C can be manufactured particularly easily and/or can be manufactured without a seam, at least in the sole area.

Figure 28A:
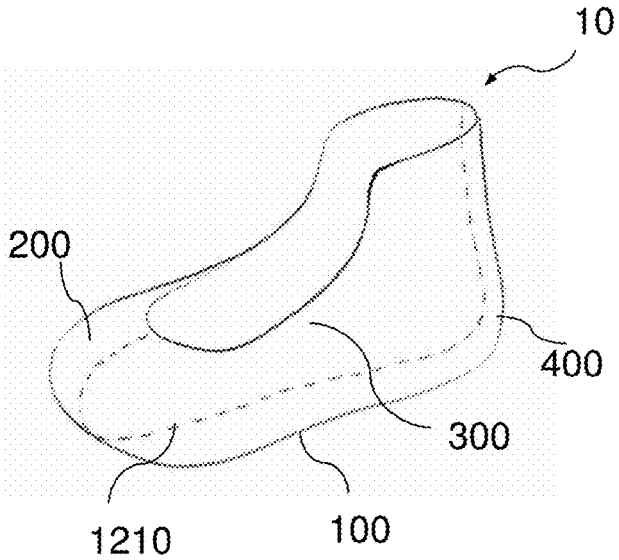
FIGS. 28A and 28B show schematic perspective views of a disposable booty according to another embodiment of the invention in a fastened state and of the associated cutting pattern.
Figure 28B:
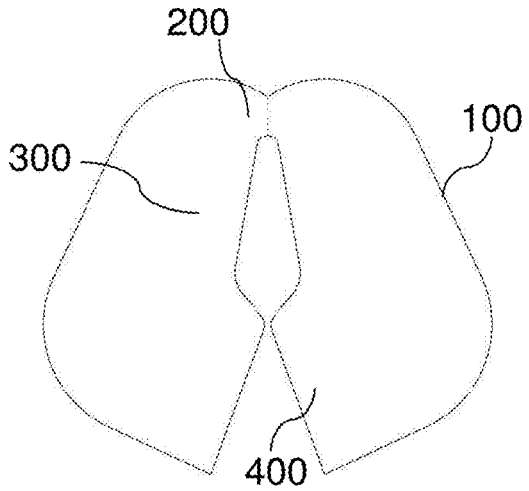

FIG. 28A shows a schematic perspective view of a disposable booty 10 according to another embodiment of the invention, and FIG. 28B shows the associated cutting pattern. As can be seen from FIGS. 22A and 22B, the disposable booty 10 or the sock 10, in particular, the disposable sock 10, further comprises, in addition to the sole part 100, the toe part 200 and the instep part 300, furthermore, the heel part 400, which is adapted, when the disposable booty 10 is donned, to cover the heel of the foot 1. Furthermore, the disposable booty 10 shown in the embodiment of FIGS. 28A and 28B includes a boundary 1210 in the sole part 100. The boundary 1210 can be a seam or a welding seam at which two cutting edges of the sole part are sewn together. Thus, a disposable booty 10 can be provided, which a user can easily pull over the foot 1. The disposable booty 10 or the sock 10, in particular, the disposable sock 10, can therefore be produced in a cost-efficient manner and provide simple handling.

As shown in FIG. 28B, the sole part 100, the heel part 400, the instep part 300, and the toe part 200 can be formed as a one-piece cutting pattern. The one-piece cutting pattern can be connected via an area corresponding to the toe part 200 and/or have cutting edges in an area corresponding to the sole part 100, which form the boundary 1210.

Figure 29A:
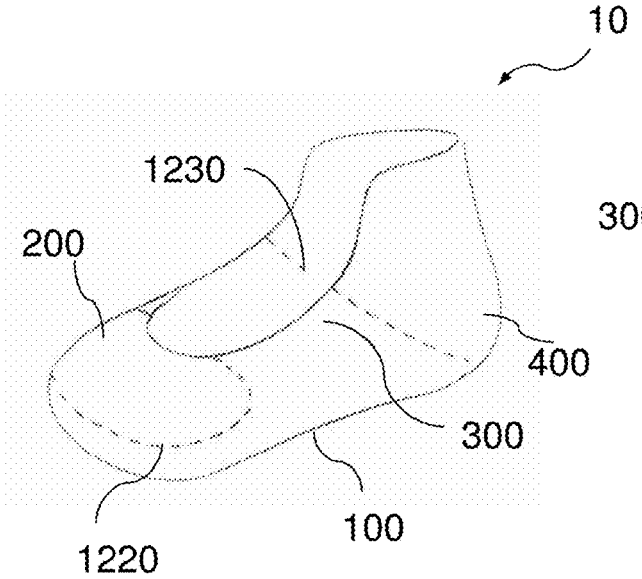
FIGS. 29A and 29B show schematic perspective views of a disposable booty according to another embodiment of the invention in a fastened state and of the associated cutting pattern.
Figure 29B:
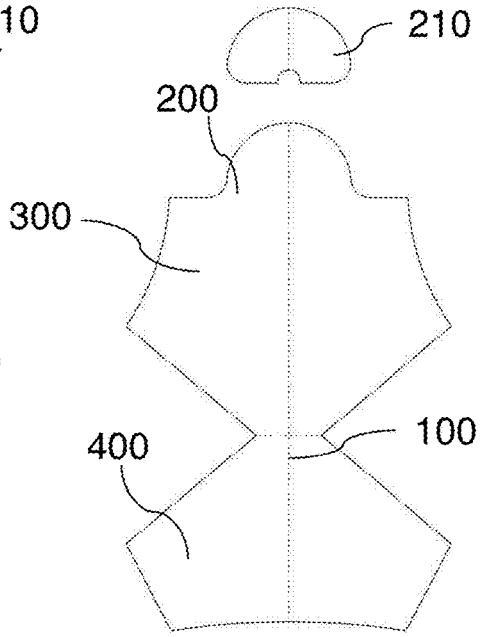

FIG. 29A shows a schematic perspective view of a disposable booty 10 according to another embodiment of the invention, and FIG. 29B shows the associated cutting pattern. The disposable booty 10 shown in FIGS. 29A and 29B substantially differs from the disposable booty 10 shown in FIGS. 28A and 28B in that it has a first boundary 1220 and a second boundary 130 instead of the boundary 1210. Thus, the seams do not run centrally across the heel area of a foot received in the disposable booty 10, but laterally, whereby a pressure point in the sole area in the region of the heel is avoided. The first boundary 1210 can fasten an upper part, such as the toe receiving part 210, to the remaining toe part 200. The second boundary 1230 can connect the heel part 400 to the instep part 300.

As shown in FIG. 28B, the sole part 100, the heel part 400, the instep part 300 and parts of the toe part 200 can be formed as a one-piece cutting pattern, whereas the toe receiving part 210 can exist as a separate cutting pattern, which is later fastened via the boundary 1220. The cutting pattern can have cutting edges in an area between an area corresponding to the instep part 300 and an area corresponding to the heel part 400, which form the boundary 1230.

Figure 30A:
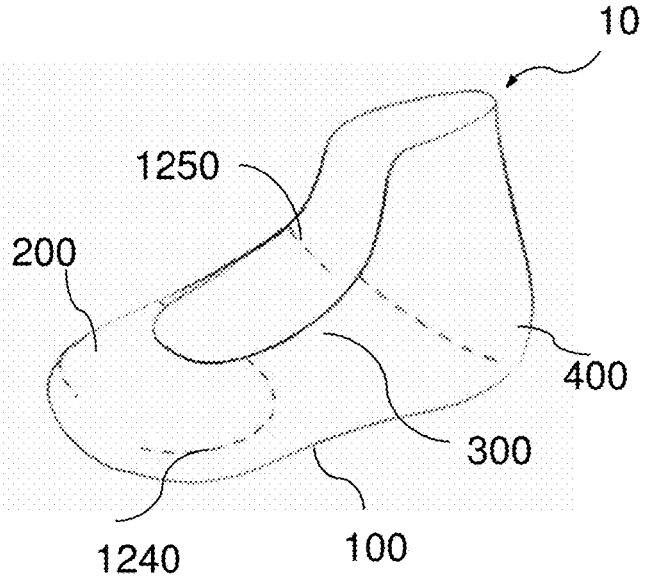
FIGS. 30A and 30B show schematic perspective views of a disposable booty according to another embodiment of the invention in a fastened state and of the associated cutting pattern.
Figure 30B:
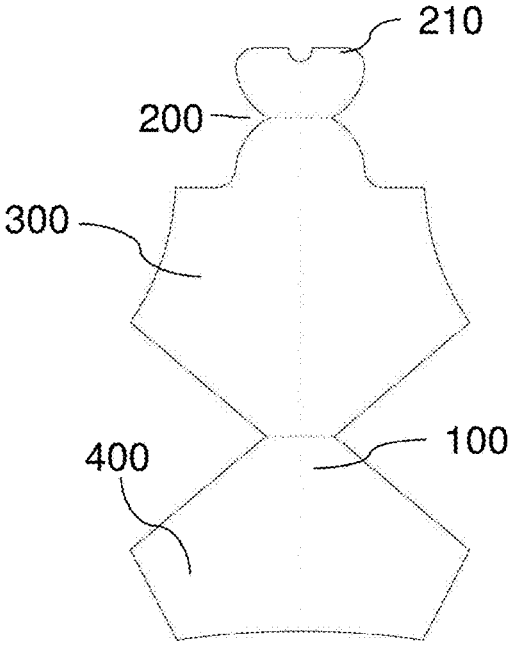

FIG. 30A shows a schematic perspective view of a disposable booty 10 according to another embodiment of the invention, and FIG. 30B shows the associated cutting pattern. The disposable booty 10 shown in FIGS. 30A and 30B substantially differs from the disposable booty 10 shown in FIGS. 29A and 29B in that it can be fabricated from a one-piece cutting pattern. For instance, a toe receiving part 210 is connected to the remainder of the toe part 200 in the cutting pattern of FIG. 30B. The cutting edges of the toe receiving part 210 form boundaries 1240, which can be connected to the toe part 200. Furthermore, boundaries 1250 exist, which correspond to the boundaries 1230. According to embodiments, the toe receiving part 210 can, as shown in FIG. 30B, have a semicircular recess in an area corresponding to the toe part 200.

Figure 31A:
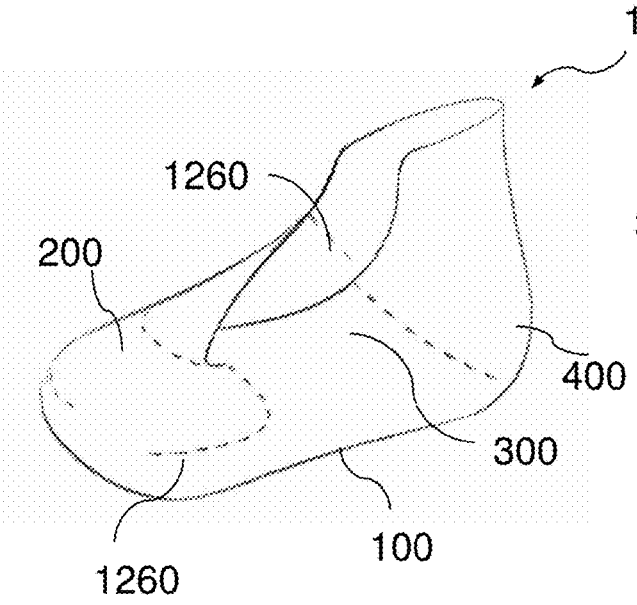
FIGS. 31A and 31B show schematic perspective views of a disposable booty according to another embodiment of the invention in a fastened state and of the associated cutting pattern.
Figure 31B:
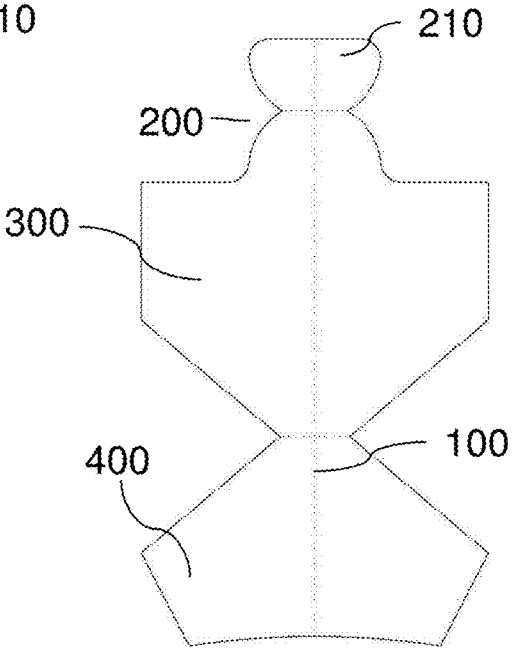

FIG. 31A shows a schematic perspective view of a disposable booty 10 according to another embodiment of the invention, and FIG. 31B shows the associated cutting pattern. The disposable booty 10 shown in FIGS. 31A and 31B substantially differs from the disposable booty 10 shown in FIGS. 30A and 30B in that parts of the instep part 300 overlap. The overlapping parts of the instep part 300 can be formed in an area close to the toe area, in order to allow a still secure hold and provide thermal insulation in the area. As shown in the cutting pattern of FIG. 31B, this cutting pattern does not then have the semicircular recess in an area corresponding to the toe part 200.

Figure 32A:
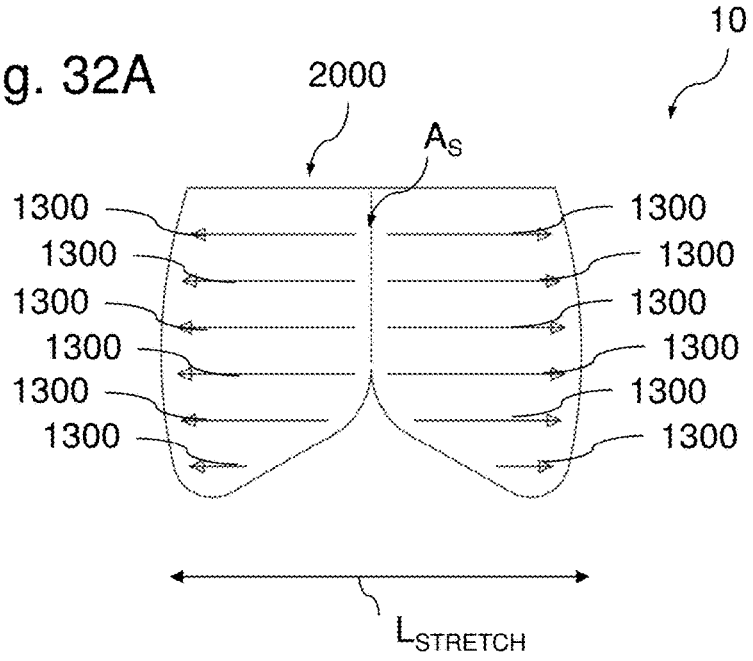
FIGS. 32A and 32B show schematic views of a cutting pattern of a sock according to an embodiment of the invention, which, in particular, can include a stretch material, in a contracted and in an extended state.
Figure 32B:
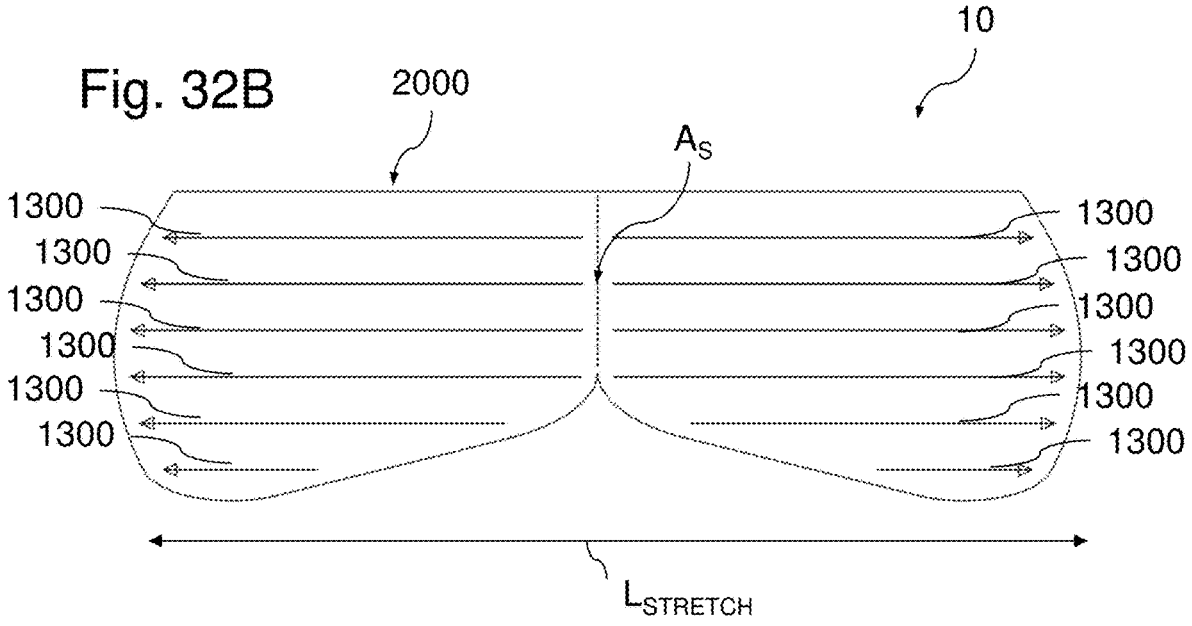

FIGS. 32A and 32B show a cutting pattern of a sock 10, in particular, a disposable sock 10, which can include a stretch material 2000. The stretch material 2000 can comprise elastifying means 1300 and at least one material layer 1000. The elastifying means 1300 can comprise the elastic strands 1120 or an elastic film 1130, as described above with reference to FIG. 21. The stretch material 2000 can comprise a composite structure made of at least a material layer 1000 and elastifying means 1300 where the at least one material layer 1000 is, in undulating, creped or accordion like form, connected to the contracted elastifying means 1300 in such a manner that the composite structure is elastically stretchable at least along a stretch direction $L_{STRETCH}$. According to an embodiment, the sock 10 is assembled from a one-piece or two-piece cutting pattern of a stretch material 2000, which only has a single stretch direction $L_{STRETCH}$, i.e. is elastically stretchable only in one direction in the area level of the flat, extensive or fabric-like stretch material 2000. Such a stretch material 2000 with only a single stretch direction $L_{STRETCH}$ has the advantage of a simple, uncomplicated and cost-efficient manufacture with a reduced number of manufacturing steps.

FIG. 32A shows the cutting pattern of a sock 10 made of a stretch material 2000 in a non-stretched state, which can correspond to a contracted state of the sock 10. FIG. 32B shows the same cutting pattern in a stretched state. The elongation between the state shown in FIG. 32A and the state shown in FIG. 32B is 100%. In this process, the elongation by a certain percentage corresponds to a change in length by this percentage compared to the non-stretched state. Accordingly, an elongation by 100% corresponds to a change in length by +100%. Thus, the cutting pattern shown in FIG. 32B has, along the elongation indicated by the arrow $L_{STRETCH}$, a length twice that of the contracted cutting pattern shown in FIG. 32A.

According to embodiments, the stretch material 2000 can have a maximally achievable elongation prior to tearing apart, i.e. a stretch or elongation at break, along the stretch direction $L_{STRETCH}$ from a contracted state to an extended state of more than 50%, or more than 100%, or more than 150%, or more than 200%, or more than 250%, or more than 300%, or more than 400%, or more than 500%, or more than 600%, or more than 700%, or more than 800%, or more than 900%, and less than 1000%. Stretch corresponds to the ability to withstand an elongation without any destruction such as tearing. The higher the stretch, the more the material can be stretched on a percentage basis. As described with regard to FIG. 21, the stretch of a stretch material 2000 can be set via the preload level of the elastifying means 1300 prior to connection to the material 1000.

For the use of the sock 10 or of the disposable sock 10, full extensibility, i.e. a perfectly elastic behavior, may not be necessary. Thus, extensibility can be less than 100%, wherein an extensibility of 100% corresponds to a perfectly elastic behavior. According to the invention, an extensibility of 100% to 30%, or from 100% to 50%, or from 100% to 70% is preferred. In this process, an extensibility of 100% means that the material fully returns into its original form, an extensibility of 0% means that the material remains in its stretched state, and an extensibility of 70%, for example, means that the material only returns 70% of the elongation back to its original form from its stretched state. Hence, the material need not completely go back to its original form following an elongation but can remain in a stretched form following initial contracting. However, full extensibility of 100% is preferred.

The cutting pattern of the sock 10 or of the disposable sock 10 shown in FIGS. 32A and 32B can be designed as one part, as illustrated. Alternatively, the cutting pattern can be designed as two parts. In this process, the cutting pattern of the sock 10 or of the disposable sock 10 can be axially symmetrical along a symmetry axis As and, in particular, consist of two mirror-symmetrical parts, which are separated from each other along the symmetry axis As (the dashed line in FIGS. 32A and 32B). Hence, the cutting pattern of the sock 10 can have a butterfly form, wherein, in the readily manufactured state of the sock 10, the folding edge of the cutting pattern along the symmetry axis As corresponds to the leg area 400*b* of the heel part 400 of the sock 10, and the cutting edges of the cutting pattern in the area of the heel area 400*a* of the heel part 400, in the area of the sole part 100, as well as in the area of the toe part 200 are connected to each other or sewn together. According to an embodiment, the stretch direction $L_{STRETCH}$ of the stretch material 2000 can run vertical to the symmetry axis As of the cutting pattern of the sock 10.

Figure 33A:
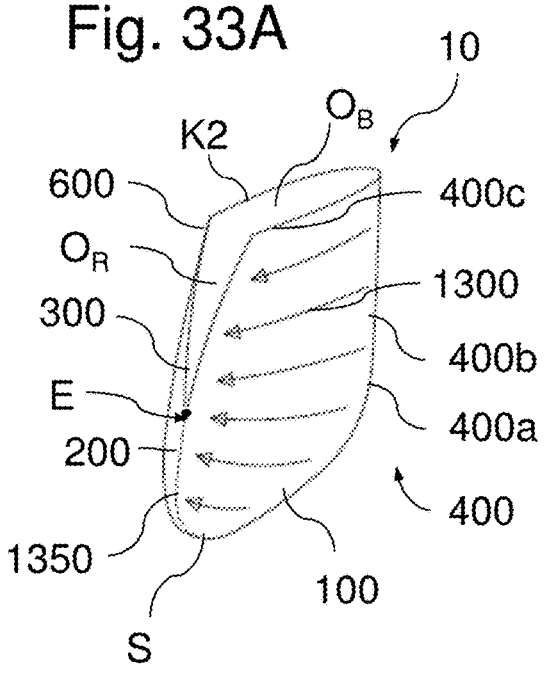
FIGS. 33A and 33B show a schematic perspective view as well as a side view of a sock according to an embodiment of the invention based on the cutting pattern according to FIG. 32A in a contracted state.
Figure 33B:
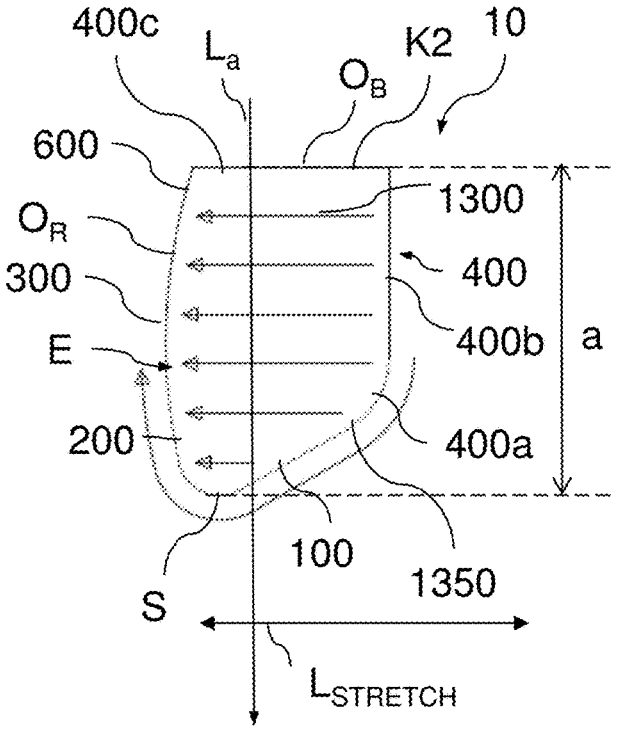
Figure 33C:
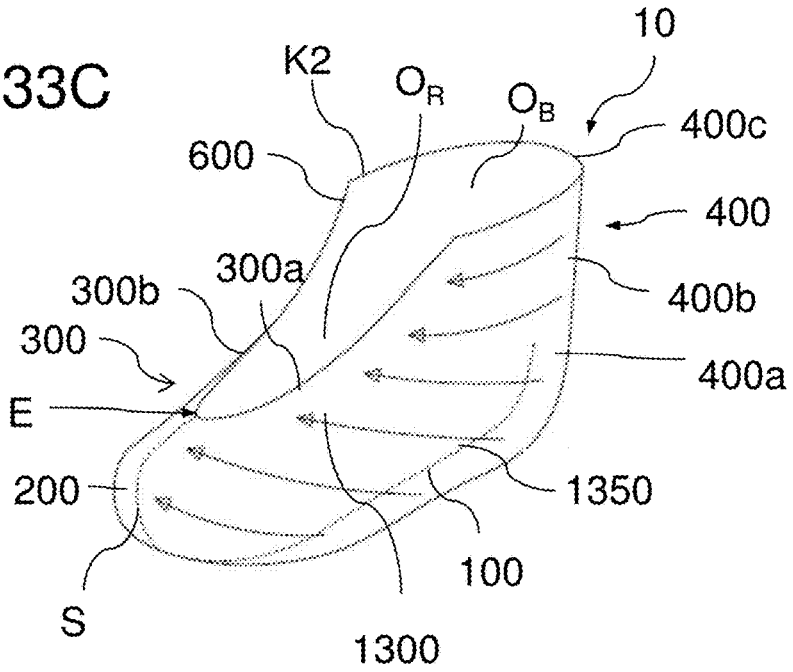
FIG. 33C shows a schematic perspective view of a sock according to FIG. 33A in an extended state.

FIG. 33A shows a schematic perspective view of a sock 10 or of a disposable sock 10 in a contracted state according to an embodiment of the invention. FIG. 33B shows a top view of a sock 10 or of a disposable sock 10 in a contracted state according to an embodiment of the invention. FIG. 33C shows a schematic perspective view of a sock 10 or of a disposable sock 10 in a stretched state according to an embodiment of the invention. FIGS. 32A and 32B show the associated cutting pattern.

As can be seen from FIGS. 33A to 33C, the sock 10 can, in addition to the sole part 100, the toe part 200 and the instep part 300, further comprise a heel part 400, which is adapted, when the disposable booty 10 is donned, to cover the heel of the foot 1. Furthermore, the sock 10 can comprise the ankle fastening part 600, which is adapted, when the sock 10 is donned, to releasably fasten it at the ankle or in the area of the ankle, or in an area below the ankle, or in an instep area of the foot 1. In this process, the heel part 400 comprises a heel area 400*a*, a leg area 400*b*, as well as a cuff area 400*c*. The leg area 400*b* comprises that area of the sock 10, which is designated as sock leg in a well-known sock. The cuff area 400*c* comprises that area of the sock 10, which, in a well-known sock, designates the sock cuff or cuff, and corresponds to the area of an upper closing edge K2 of the sock 10. In the fastened state of the sock 10 by the ankle fastening part 600, the sock 10 still has at least a cuff opening OB, through which the leg of a bearer of the sock 10 associated to the foot 1 extends. Furthermore, the sock 10 has an instep opening OR in the area of the instep part 300, which is, at least partly, fastenable by the ankle fastening part 600 when the sock 10 is donned.

FIGS. 33A to 33B show the cutting pattern shown in the unfolded state in FIG. 32A in a folded and ready-to-use joined or connected state. FIGS. 33A and 33B show the sock 10 in a contracted state. FIG. 33C shows the sock 10 in an extended state. According to embodiments, the sock 10 can, in the contracted state, have a measurement a in the longitudinal direction La of the sock 10 from the upper closing edge K2 in the cuff area 400*c* of the heel part 400 to a top S of the toe part 200, in the contracted state, of less than 40 cm, or of less than 35 cm, or of less than 30 cm, or of less than 25 cm, or of less than 20 cm, or of less than 15 cm, of less than 10 cm, and greater than 10 cm, or greater than 5 cm. The longitudinal direction La of the sock 10 in the contracted state is to be defined as a direction, which is vertical to the closing edge K2 in the cuff area 400*c* of the sock 10 or of the cuff opening OB in the cuff area 400*c* of the sock 10 and points in a longitudinal direction of the contracted sock 10. Should the closing edge K2 of the sock 10 form no straight closing edge in the contracted state of the sock 10, then the longitudinal direction La of the sock 10 is to be defined parallel to the longitudinal direction of the sock leg in the leg area 400*b*. In the case that the longitudinal direction La is not definable or difficult to define based on the above definitions, the measurement a is to be defined as a measurement of the sock 10 along a direction, along which the sock 10, in the contracted state, has the greatest measurement. It should be noted that the longitudinal direction La of the sock 10 in the contracted state does not correspond to the longitudinal direction of the foot 1 or of the sole part 100, as introduced as longitudinal direction Ls with regard to FIG. 13. In the case of the sock 10 shown in FIG. 33B, this direction Ls would rather run parallel to a cutting edge section adjacent to the sole part 100 or to a cutting edge section K4 (FIG. 35B).

In the extended, in particular, applied state, the sock 10 can have a measurement or length from the top S of the toe part 200 to the closing edge K2 in the cuff area 400*c* of the heel part 400 of more than 25 cm, or of more than 30 cm, or of more than 35 cm, or of more than 40 cm, or of more than 45 cm, or of more than 50 cm, and less than 60 cm. In particular, the sock 10 can, in a contracted state, have a measurement a along the longitudinal direction La of the sock 10 in the contracted state of less than 40 cm, or of less than 35 cm, or of less than 30 cm, or of less than 25 cm, or of less than 20 cm, or of less than 15 cm, of less than 10 cm, and can be stretched donned into an extended state in such a manner that the heel part 400 is pulled over the heel of the foot 1 and fastened at the ankle by the ankle fastening part 600.

Furthermore, the cutting pattern in FIGS. 33B and 33C can be provided with a seam 1350, which is elastic in the direction of the seam, and which connects at least two of the parts 100, 200, 300, 400, 500, 510, 600, 610 of the sock with each other. In particular, the elastic seam 1350 can be formed in the sole part 100. Hence, it can connect two parts of the sole part 100 with each other. Furthermore, the seam 1350, which is elastic in the direction of the seam, can be formed in the toe part 200. Hence, it can connect two parts of the toe part 200 with each other. Furthermore, the elastic seam 1350 can, at least partly, be formed in the heel part 400. Hence, it can, at least partly, connect two parts of the heel part 400 with each other. In this process, the seam 1350, which is elastic in the direction of the seam, can connect two parts of the heel area 400*a* with each other, wherein the leg area 400*b* in the case of a one-piece cutting pattern, as shown in FIGS. 32A and 32B, can be designed in one piece as a folding line.

According to a preferred embodiment, the elastic seam 1350 runs, when the sock 10 is donned, centrally along the foot 1 from the toe part 200 via the sole part 100 to the heel part 400. According to embodiments, the seam 1350 can be a T seam or a zigzag seam. In this process, a zigzag seam can be made by a zigzag stitch with a longer stitch length compared to a stitch length used for a non-elastic seam. However, also a non-elastic seam, for example, an ultrasound welding seam, can be provided as the seam 1350, which is elastic in the direction of the seam, which non-elastic seam connects the parts to be connected to each other in the direction of the seam under a pre-load in such a manner that it acts in the direction of the seam, in the contracted state again, like a seam, which is elastic in the direction of the seam, and is elastically stretchable. Therefore, the seam 1350, which is elastic in the direction of the seam, can be created in that two parts of the sock 10 in the stretched state are connected to each other. This is, in particular, possible when the stretch direction $L_{STRETCH}$ does not run vertically into the seam 1350, which is elastic in the direction of the seam.

As shown in FIG. 33B, the elastic seam 1350 (shown as a dashed line in FIGS. 33B and 33C) can have a U-shaped or V-shaped form. Furthermore, in the leg area 400*b* of the heel part 400, a connected or one-piece area of the cutting pattern can connect, which is folded along the symmetry axis As (FIGS. 32A and 32B) of the cutting pattern. If the cutting pattern of the sock 10 is designed as two parts, the seam 1350 can elastically connect the two parts of the leg area 400*b* along the cutting edge section K3, the two parts of the heel area 400*a*, and the two parts of the sole part 100 along the cutting edge section K4, as well as the two parts of the toe part 200 along the cutting edge section K5 with each other in the direction of the seam (see also FIGS. 35B and 35C).

The instep opening OR connects to the area connected by the seam 1350, which can extend from the heel part 400 to the toe part 200. The instep opening OR has the function to facilitate putting on the sock 10. The instep opening OR can, in particular, be a longitudinal slit which, when donned and in a not yet fastened state of the sock 10, extends from the closing edge K2 in the cuff area 400*c* of the heel part 400 in the area of the ankle of the foot 1 to the toe part 200, in particular, to the instep opening end E in the transition area between the toe part 200 and the instep part 300 of the sock 10, in particular, to the end of the seam 1350 in the transition area between the toe part 200 and the instep part 300. The instep opening OR can also be formed as a cutout, as a recess, as a cut in the sock 10. The instep opening OR can have a measurement or length of greater than 5 cm, or greater than 10 cm, or greater than 15 cm for a contracted sock 10, starting from the closing edge K2 in the cuff area 400*c* of the sock 10, in particular, starting from the area of the ankle closing part 600, to the toe part 200, in particular, to the instep opening end E in the transition area between the toe part 200 and the instep part 300, in particular, to the end of the seam 1350 in the transition area between the toe part 200 and the instep part 300. The length or measurement of the instep opening OR can be at least 20%, or at least 30%, or at least 40%, or at least 50%, or at least 60%, or at least 70%, or at least 80%, and maximally 90%, or maximally 80% of the measurement a in the longitudinal direction La of the sock 10 in the contracted state. The instep opening end E in the transition area between the toe part 200 and the instep part 300 of the sock 10 can coincide with the end of the seam 1350 if, for example, the seam 1350 runs centrally along the longitudinal direction Ls of the sole part 100 across the sock 10 in the case of a sock 10 when donned.

Hence, when applying the sock 10, a toe area of the foot 1 of a patient or of a user can, in the contracted state, be inserted into the toe art 200 of the sock 10, which receives the toe area, wherein the sole part 100, the heel part 400 and the instep part 300 of the sock 10 do not enclose or receive the remaining area of the foot 1, apart from the toe area, due to the instep opening OR opposite to the sole part 100 and the heel part 400. To completely put on the sock 10, the user or a person applying the sock, for example, a caregiver, can grab the sock 10 at the cuff area 400*c* of the heel part 400 and pull the sock 10 over the heel of the foot 1, preferably up to the ankle. In this process, the stretch material 2000 of the sock 10 is stretched along the elastifying means 1300 (for the sake of simplicity of the illustration, only one reference numeral 1300 is shown in each of FIGS. 33A to 33C). The sock 10 can thereby adjust to the foot 1 of the user and provide a secure hold at the same time.

As shown in FIG. 33B, elastifying means 1300 can, in the leg area 400*b* of the heel part 400, run vertical to a longitudinal direction La of the sock 10 in the contracted state. According to an embodiment, the stretch material of the sock 10 can have only one preferred direction, i.e. only one stretch direction LSTRETCH, which, in particular, can correspond to a direction of the arrangement of the elastifying means 1300. The user pulls the sock 10 upward over the heel along the direction La. Since the elastifying means 1300 run here vertical to the pulling direction caused while putting on of the sock 10, an elongation in the pulling direction does not take place in the leg area 400*b* while putting on of the sock 10, whereby convenient donning is made possible.

According to embodiments, the sock 10 can, donned, have an angle equal to or greater than 80°, in particular, equal to or greater than 85°, and/or equal to or less than 100°, in particular, equal to or less than 95° and/or preferably approximately equal to 90° at the ankle fastening part 600. A load transmission vertical to the user's foot can thereby be ensured.

In the area of the elastic seam 1350, the elastifying means 1300 preferably run at an oblique angle to the elastic seam 1350. If the elastic seam 1350 has a U-shaped or V-shaped form, the elastifying means 1300 can intersect the elastic seam 1350 at an acute angle in the area of the heel area 400*a* of the heel part 400 and/or of the sole part 100. The elastifying means 1300 can further run from the heel part 400 and/or the sole part 100 to the instep part 300 and/or the toe part 200. The elastifying means 1300 can intersect the elastic seam 1350 at an acute angle again in the toe part 200. This applies, in particular, to elastifying means 1300, which intersect the elastic seam 1350 in the sole part 100. Furthermore, elastifying means 1300 can intersect the instep opening OR in the area of the instep part 300 at an acute angle. This applies, in particular, to elastifying means 1300, which intersect the elastic seam 1350 in the sole part 100 and/or the heel area 400*a* of the heel part 400. Therefore, the angle between the elastic seam 1350 in the area of the sole part 100 or a cutting edge section K4 of the sock 10 adjacent to the heel area 400*a* of the heel part 400 as well as adjacent to the sole part 100 and the stretch direction $L_{STRETCH}$ can deviate in a range between 10° and 80°, or between 10° and 70°, or between 10° and 60°, or between 10° and 50° from an orthogonal to the seam direction of the seam 1350. Hence, the stretch material 2000 can have a stretch direction $L_{STRETCH}$, which, in the contracted state of the stretch material 2000, runs substantially parallel to a closing edge K2 in a cuff area 400*c* of the heel part 400, and intersects a cutting edge section K4 adjacent to the sole area 100 at an angle in the range between 10° and 80° in deviation of the normal direction of the cutting edge section K4. In this process, the stretch direction $L_{STRETCH}$ can further intersect substantially vertical a cutting edge section K3 adjacent to the leg area 400*b* of the heel part 400.

The sock 10 can thereby adjust to the user's foot 1 not only along its longitudinal direction Ls, but also in a width direction and in a height direction. Hence, the stretch direction $L_{STRETCH}$ runs in the area of the sole part 100 in the area of the seam 1350 diagonally to the elastic seam 1350 and not vertically thereto, whereby an elasticity in the seam direction of the seam 1350 is created due to the elastifying means 1300 running in a V-shaped manner into the seam 1350. Thus, the heel area 400*a* of the heel part 400 and/or of the sole part 100 in the longitudinal direction of the foot 1 and along the seam direction of the elastic seam 1350 in the sole part 100 is elastic, whereby the sock 10 advantageously can provide a sole part 100 with variable size for different foot sizes, which can elastically adjust to the corresponding sizes. However, in the leg area 400*b* of the heel area 400, the stretch direction $L_{STRETCH}$ can run vertical to the longitudinal direction La of the sock 10 in the contracted state, so that an elasticity exists along the sock cuff in the cuff area 400*c* of the heel part 400. Since the ankle fastening part 600 has a fastening direction parallel to the opening plane of the cuff opening OB, the ankle fastening part 600 in the fastened state is preloaded by the elastic cuff area 400*b* due to the elastifying means 1300.

Figure 34A:
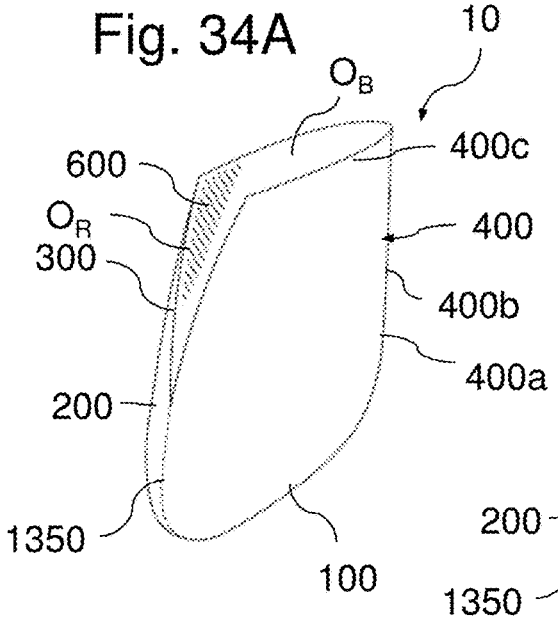
FIGS. 34A to 34D show schematic perspective views of a sock according to another embodiment of the invention.
Figure 34B:
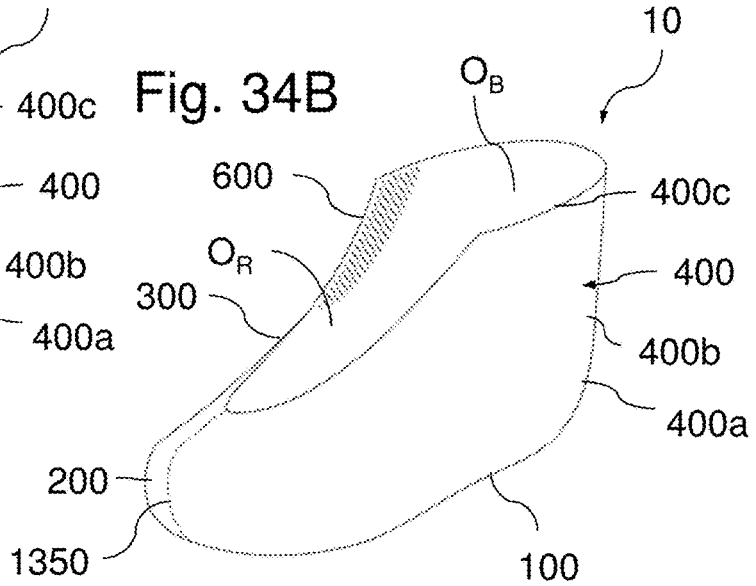
Figure 34C:
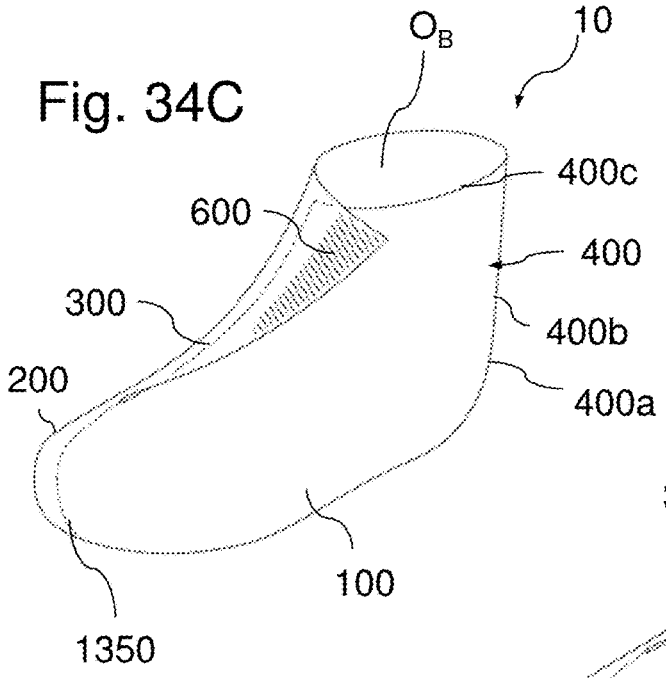

FIGS. 34A to 34D show schematic perspective views of a sock 10 according to another embodiment of the invention. The sock 10 shown in FIGS. 34A to 34D substantially corresponds to the sock 10 shown in FIGS. 33A to 33C. Furthermore, the ankle fastening part 600 is illustrated as a hatched area. FIG. 34A shows the sock 10 in a contracted state. FIG. 34B shows the sock 10 in a stretched state with the ankle fastening part 600 open. FIG. 34C shows the sock 10 in an stretched state with the ankle fastening part 600 fastened, wherein the section of the instep fastening part 600 opposite to the instep part 300 is displayed as a dashed line compared to the illustration how the ankle fastening part 600 rests on the instep part 300 in the fastened state of the sock 10.

Figure 34D:
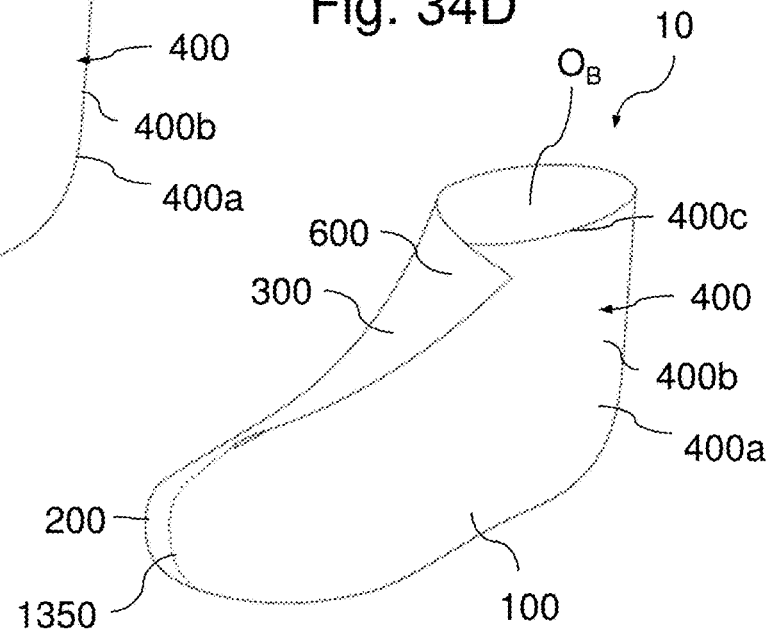

FIG. 34D shows the sock 10 in a stretched state with the ankle fastening part 600 fastened. According to embodiments, the instep opening OR extends, starting from the toe part 200, to the ankle fastening part 600. The sock 10 therefore includes a sole part 100, a toe part 200 formed as a bag, an instep part 300 and a heel part 400, wherein the instep part 300 is separated into a first, in the foot direction left part 300*a* and into a second, in the foot direction right part 300*b* by the instep opening OR opposite to the sole part 100 and running along the longitudinal direction of the foot 1, i.e. along the back of the foot 1, wherein the instep opening OR is, at least partly, fastenable by the ankle fastening part 600. In other words, the sock 10 is a sock slit open from the cuff area 400*c* to the toe part 200 on the side of the instep part 300, i.e. on the upper side of the foot 1 and on the front side of the leg. The instep opening OR of the sock 10 is then fastened by the ankle fastening part 600. In this process, the ankle fastening part 600 can extend across the whole length of the opening O, or, as described above, an instep fastening part 500 can be additionally inserted, in order to fasten the instep opening OR in the area of the instep part 300.

The ankle fastening part 600 can include the adhesive elements or adhesives described herein. For example, the ankle fastening part 600 can include a high tensile Velcro, an adhesive or a tacky material, so that it can connect with the material located below it. A fastener, for example, similar to those for diapers, would be possible which enables repeated adjustment up to optimum fit. In particular, the ankle fastening part 600 can include the same material as the bonding element 515, 615 and/or have the same properties as the bonding element 515, 615.

Alternatively or additionally, a flap (see the dashed line in FIGS. 35B and 35C) can be provided as the ankle fastening part 600 in the area of the instep part 300, which, when donned, fits to the ankle of the foot 1. When donned, the flap can be placed around the ankle from one side of the instep part 300 to an opposite side of the instep part 300, in order to secure the sock 10 to the ankle.

Figure 35A:
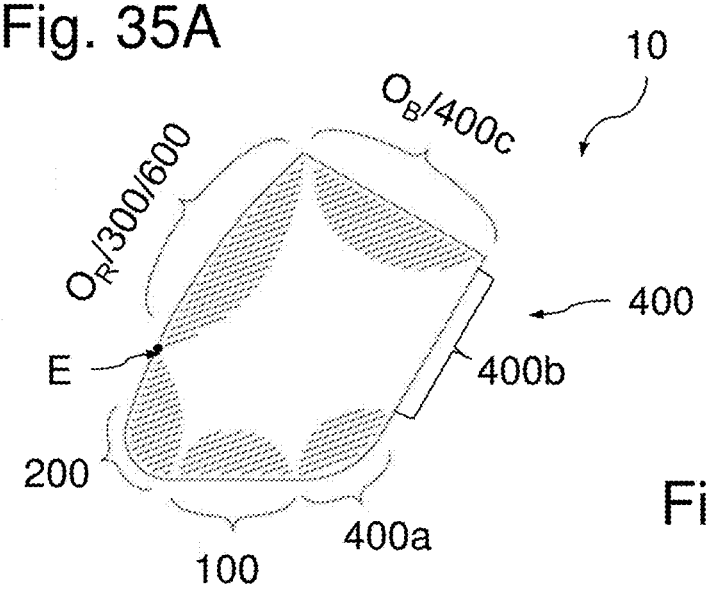
FIG. 35A to 35C show a top view of a sock in a folded state.
Figure 35B:
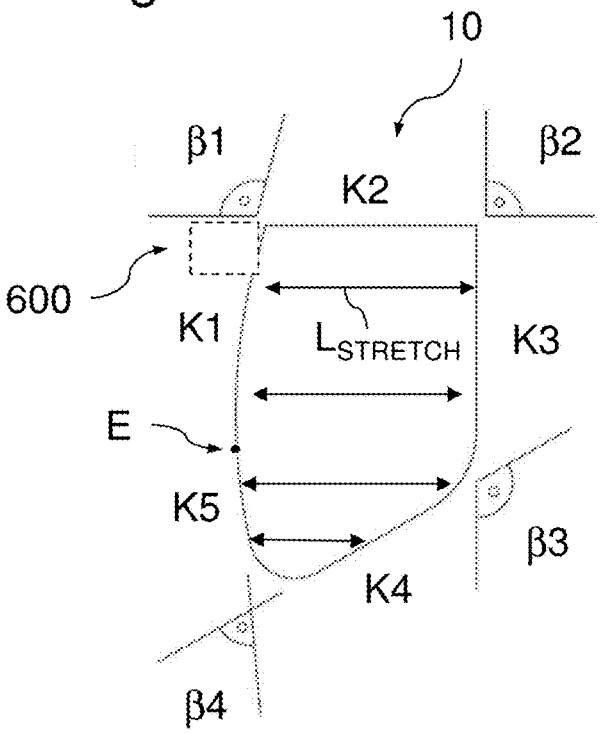

FIGS. 35A to 35 C show the cutting pattern of the sock 10 in a folded state. In FIG. 35A, those areas of the cutting pattern are marked as a hatched area, which correspond to the sole part, the toe part, the instep part 300, the heel part 400, the ankle fastening part 600 and the opening O.

In FIG. 35B, angles between the cutting edges corresponding to various parts are shown. In particular, interior angles are shown here, whereas exterior angles are shown in FIGS. 22C, 23C, 24C, 25C and 26C.

Between a cutting edge section K1 of the sock 10 adjacent to the instep opening OR and a cutting edge section K2 of the sock 10 adjacent to the cuff opening OB, which is the above introduced closing edge K2 of the sock 10, a cutting edge corner section in the area of the ankle fastening part 600 can be provided, which has a first angle β1 in a range between 80° and 130°, or between 85° and 120°, or between 85° and 110°, or between 85° and 95°. The first angle β1 can, in particular, be equal to or greater than 80°, in particular, equal to or greater than 85°, and/or equal to or less than 100°, in particular, equal to or less than 95° and/or preferably approximately equal to 90°.

A cutting edge corner section can include a second angle β2 between a cutting edge section K2 of the sock 10 adjacent to the cuff opening OB, i.e. the closing edge K2 of the sock 10, and a cutting edge section K3 of the sock 10 adjacent to a leg area 400*b* of the heel part 400. The second angle β2 can be greater than or equal to 80° and/or less than or equal to 100°. A cutting edge corner section can include a third angle β3 between a cutting edge section K3 of the sock 10 adjacent to the leg area 400*b* of the heel part 400 and a cutting edge section K4 of the sock 10 adjacent to the heel area 400*a* of the heel part 400 as well as the sole part 100. The third angle β3 can be greater than or equal to 100° and/or less than or equal to 140°. As described above, the cutting edge section K3 can also be formed as a folding edge K3 in the case of a one-piece cutting pattern. A cutting edge corner section can include a fourth angle β4 between a cutting edge section K4 of the sock 10 adjacent to the sole part 100 and a cutting edge section K5 adjacent to the toe part 200. The fourth angle β4 can be greater than or equal to 50° and/or less than or equal to 90°. According to an embodiment, the stretch direction $L_{STRETCH}$ of the stretch material 2000 can run parallel to the closing edge K2 as well as vertical to the cutting edge section K3 or to the folding edge K3.

Figure 35C:
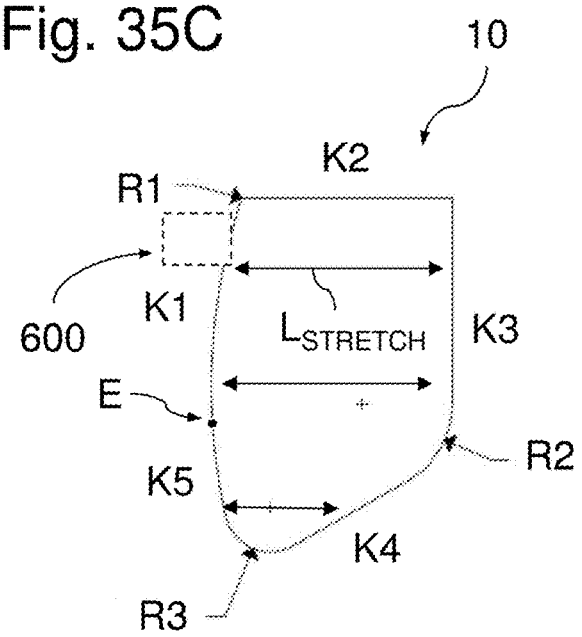

In FIG. 35C, radii between the cutting edges corresponding to various parts are shown. In this process, a radius of 0 mm means an angle between two cutting edges, which is not rounded by a curvature. The curvature with which the angle is rounded is the greater, the greater the corresponding radii specification is. The radii specification is given in millimeters. The first angle β1 can be rounded with a radius R1. The first radius R1 can be greater than or equal to 0 mm and/or less than or equal to 100 mm. The second angle β2 is preferably not rounded. The third angle β2 can be rounded with a third radius R3. The third radius R3 can be greater than or equal to 30 mm and/or less than or equal to 100 mm. The fourth angle β4 can be rounded with a third radius R4. The third radius R4 can be greater than or equal to 5 mm and/or less than or equal to 50 mm.

Although, according to the invention, a disposable booty 10 is preferred, all features of the aforedescribed disposable booty 10 as well as all described method steps for its manufacture, also in the case of a reusable booty, a bandage sock, a sock or booty, a disposable sock, a bandage shoe, a booty or a shoe, are preferred according to the invention and covered by the disclosure of the application. In particular, a disposable booty can be regarded as a sock within the scope of the present disclosure, and, the other way around, a sock as a disposable booty. In this process, the disposable booty or sock according to the invention can extend from the heel to the ankle or even beyond the ankle.

The invention claimed is:

1. A sock, comprising:

a sole part, which is adapted, when the sock is donned, to cover a sole of a foot;

a toe part, the toe part together with the sole part is adapted, when the sock is donned, to completely receive a toe area of the foot;

an instep part, which is adapted, when the sock is donned, to cover, at least partly, an instep of the foot;

a heel part, which is adapted, when the sock is donned, to cover a heel of the foot; and an ankle fastening flap, which is adapted, when the sock is donned, to releasably fasten the sock at an ankle of the foot, wherein at least one of the sole part, the toe part, the instep part, the heel part and the ankle fastenting flap is made of a prefabricated flat, non-woven stretch material, wherein the stretch material has only a single stretch direction, which, in a contracted state of the stretch material, runs substantially parallel to a closing edge in a cuff area of the heel part, wherein the stretch direction intersects substantially vertical a cutting edge section adjacent to a leg area of the heel part, and wherein the stretch direction intersects a cutting edge section adjacent to the sole part at an angle in the range between 10° and 50°.

2. The sock according to claim 1, wherein the instep part is separated into a left part and into a right part of the instep part by an instep opening opposite to the sole part and configured to run toward a back of the foot, and wherein the instep opening, at least partly, is closable by the ankle fastening flap.

3. The sock according to claim 2, wherein the instep opening extends from an instep opening end, in a transition area from the toe part to the instep part, to the closing edge in the cuff area of the sock.

4. The sock according to claim 3, wherein the instep opening is formed as a slit or a cutout.

5. The sock according to claim 2, wherein, between a cutting edge section of the sock adjacent to the instep opening and a cutting edge section of the sock adjacent to a cuff opening, a cutting edge corner section is provided in an area of the ankle fastening flap, which has an angle in a range between 80° and 130°.

6. The sock according to claim 1, wherein the sock is a disposable sock.

7. The sock according to claim 1, wherein the stretch material has a stretch of at least 50%.

8. The sock according to claim 1, wherein the stretch material has a stretch of at least 100%.

9. The sock according to claim 1, wherein the stretch material has an extensibility of 30% to 100%.

10. The sock according to claim 1, wherein the stretch material comprises a composite structure made of:

a material layer; and elastic strands or an elastic film, wherein the material layer is connected to the elastic strands or the elastic film in such a manner that the composite structure is stretchable at least along the single stretch direction.

11. The sock according to claim 1, wherein at least two of the sole part, the toe part, the instep part, the heel part and the ankle fastenting flap include a seam which is elastic in a direction of the seam.

12. The sock according to claim 1, wherein the sock, in a contracted state, has a measurement along a longitudinal direction of the sock of less than 40 cm in the contracted state, and, donned, is stretched into an extended state in such a manner that the heel part is pulled over the heel of the foot and fastened at the ankle by the ankle fastening part.

13. The sock according to claim 1, further comprising an elastifying means running in a V-shaped manner into an elastic seam.

* * * * *